US010259552B1

(12) United States Patent
Walkowiak

(10) Patent No.: US 10,259,552 B1
(45) Date of Patent: Apr. 16, 2019

(54) RUDDER DEVICE FOR A HYDROJET VESSEL

(71) Applicant: Jeffrey T. Walkowiak, Pinellas Park, FL (US)

(72) Inventor: Jeffrey T. Walkowiak, Pinellas Park, FL (US)

( * ) Notice: Subject to any disclaimer, the term of this patent is extended or adjusted under 35 U.S.C. 154(b) by 0 days.

(21) Appl. No.: 15/481,946

(22) Filed: Apr. 7, 2017

Related U.S. Application Data

(60) Provisional application No. 62/320,443, filed on Apr. 8, 2016.

(51) Int. Cl.

| | |
|---|---|
| ***B63H 11/113*** | (2006.01) |
| ***B63H 11/00*** | (2006.01) |
| ***B63H 25/06*** | (2006.01) |
| ***B63H 25/38*** | (2006.01) |
| ***B63H 25/46*** | (2006.01) |

(52) U.S. Cl.
CPC ..... *B63H 11/113* (2013.01); *B63H 25/38* (2013.01); *B63H 25/46* (2013.01); *B63B 2751/00* (2013.01); *B63H 2011/008* (2013.01); *B63H 2025/066* (2013.01); *B63H 2025/387* (2013.01)

(58) Field of Classification Search
CPC ..... B63H 11/113; B63H 25/46; B63H 25/38; B63H 2025/066; B63H 2025/387; B63H 2011/008; B63B 2751/00
USPC ..... 440/38, 41, 42, 43; 114/162, 163
See application file for complete search history.

(56) References Cited

U.S. PATENT DOCUMENTS

| | | | | |
|---|---|---|---|---|
| 3,244,135 | A | 4/1966 | Mayerhoff | |
| 3,961,591 | A | 6/1976 | Fuller | |
| 3,982,494 | A | 9/1976 | Posti | |
| 4,421,489 | A | 12/1983 | Van Weldhuizen | |
| 5,167,547 | A | 12/1992 | Kobayashi et al. | |
| 5,429,533 | A * | 7/1995 | Kobayashi | B63B 35/731 440/42 |
| 5,967,864 | A * | 10/1999 | Koyano | B63H 11/08 440/38 |
| 6,086,437 | A | 7/2000 | Murray | |
| 6,202,630 | B1 | 3/2001 | Yip | |
| 6,302,047 | B1 | 10/2001 | Cannon | |
| 6,336,833 | B1 * | 1/2002 | Rheault | B63H 21/21 114/144 R |
| 6,336,834 | B1 | 1/2002 | Nedderman, Jr. et al. | |
| 6,415,729 | B1 | 7/2002 | Nedderman, Jr. et al. | |

(Continued)

FOREIGN PATENT DOCUMENTS

| | | | |
|---|---|---|---|
| JP | 55094894 | A * | 7/1980 |
| JP | 55136690 | A * | 10/1980 |

*Primary Examiner* — Anthony D Wiest
(74) *Attorney, Agent, or Firm* — Frijouf, Rust & Pyle, P.A.

(57) ABSTRACT

A rudder device is disclosed for a hydrojet vessel. The rudder device comprises a first mounting bracket coupled to a first hydrojet. A first rudder is coupled to the first hydrojet and the first mounting bracket. A second mounting bracket is coupled to a second hydrojet. A second rudder is coupled to the second hydrojet and the second mounting bracket. A coupling rod is pivotably coupled to the first hydrojet, the second hydrojet and a hull rudder for pivoting in alignment and in unison the first rudder with the first hydrojet and the second rudder with the second hydrojet relative to the hull rudder. The first rudder and the second rudder provide steerage to the vessel during non directional thrust absent from the first hydrojet and the second hydrojet.

9 Claims, 63 Drawing Sheets

(56) References Cited

U.S. PATENT DOCUMENTS

| | | | |
|---|---|---|---|
| 6,561,858 | B1 | 5/2003 | Wallkowiak |
| 6,702,630 | B2 | 3/2004 | Wallkowiak |
| 7,018,252 | B2 | 3/2006 | Simard et al. |
| 7,168,996 | B2 | 1/2007 | Morvillo |
| 8,425,269 | B2 | 4/2013 | Wallkowiak |
| 8,712,003 | B2 | 4/2014 | Ishide et al. |
| 2006/0037521 | A1 | 2/2006 | Jamison |
| 2010/0183113 | A1 | 7/2010 | Ishida et al. |
| 2012/0132119 | A1 | 5/2012 | Watts |
| 2012/0285355 | A1 | 11/2012 | Walkowiak |
| 2014/0165896 | A1 | 6/2014 | Watts |

* cited by examiner

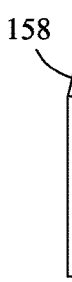
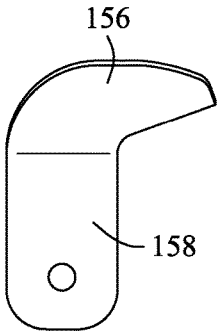
FIG. 16 FIG. 15
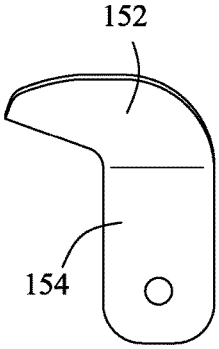
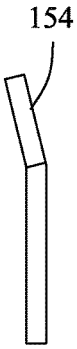
FIG. 17 FIG. 18
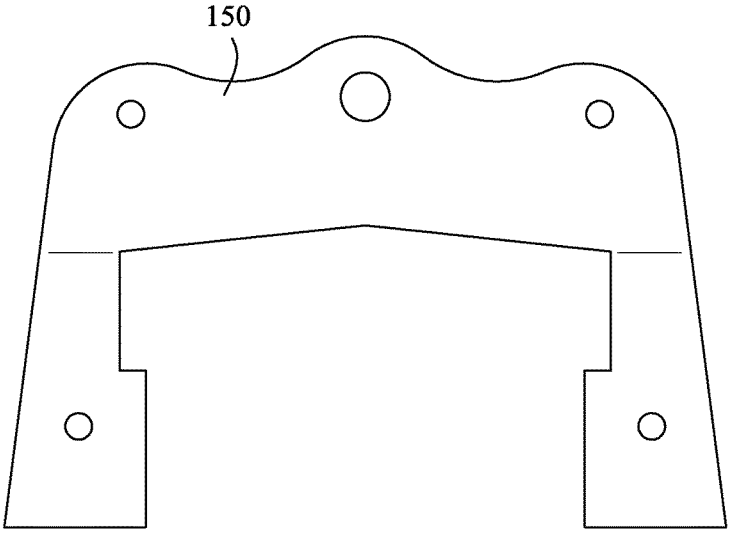
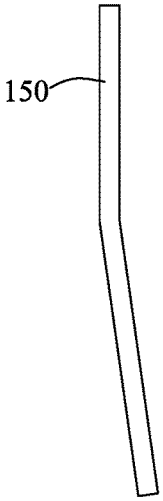
FIG. 19 FIG. 20

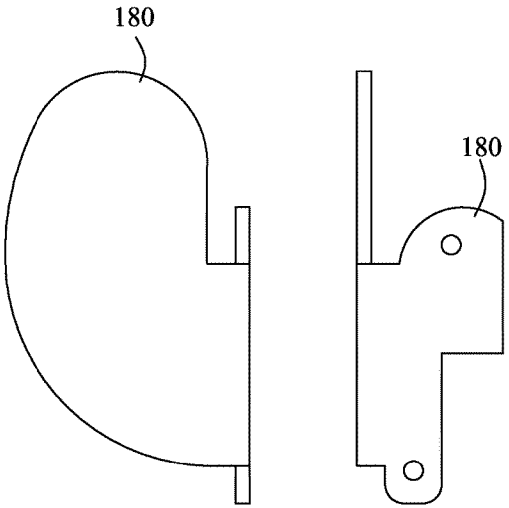
FIG. 21
FIG. 22
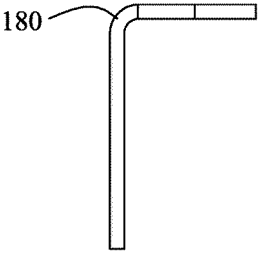
FIG. 23
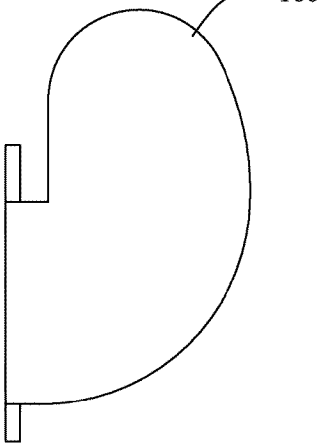
FIG. 24
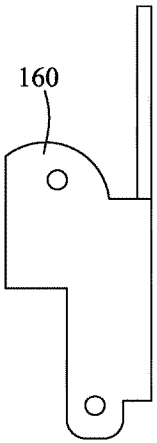
FIG. 25
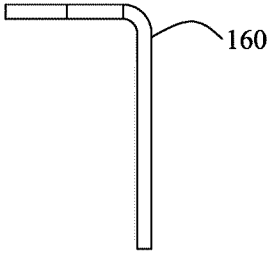
FIG. 26

RUDDER DEVICE FOR A HYDROJET VESSEL

CROSS-REFERENCE TO RELATED APPLICATIONS

This application claims benefit of U.S. Patent Provisional Application No. 62/320,443 filed Apr. 8, 2016. All subject matter set forth in Provisional Application No. 62/320,443 is hereby incorporated by reference into the present application as if fully set forth herein.

BACKGROUND OF THE INVENTION

Field of the Invention

This invention relates to steering and more particularly to a rudder device for hydrojet vessel.

Background of the Invention

Since their introduction by the recreational watercraft industry in the 1960's, personal watercraft (PWC) and water jet powered boats have increased in popularity. The increase in popularity of these vessels can be attributed to many factors, including their unique propulsion and control systems. The waterjet propulsion system comprises an inboard engine driving a high volume water pump which expels water through a discharge nozzle located on the stern of the craft. Lateral movement of the nozzle provides directed thrust to steer the vessel. A reverse mode is accomplished by application of a clamshell-like device over the discharge nozzle which then diverts the discharged water toward the front of the vessel, thereby effecting a reverse thrust.

Since there is no external propeller, this type of propulsion and directional control system is inherently safer than a conventionally propelled vessel. However, since directional control is accomplished by directing the water jet by means of the moveable nozzle, off throttle steering is minimal to non existent. This deficiency has contributed to numerous accidents in which the PWC strikes another fixed or moving object. When confronting and obstacle or obstruction, the operator's normal reflex reaction would be to reduce the throttle and turn the steering system. In this off-throttle condition, the nozzle movement has no effect on the direction of the vessel, potentially creating a major problem for the operator.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 3,244,135 to Meyerhoff discloses a control system for a ship having a means for propelling the ship in response to the movement of a flow of liquid with respect to the hull of the ship in a predetermined direction. The system comprises a duct having a substantially concave-convex foil-shaped longitudinal wall section mounted without the hull. The inner surface of the duct being concave, and is adapted to develop a lift force in response to the flow of liquid with respect thereto. The leading and trailing portions of the duct extend substantially in a transverse direction with respect to the predetermined direction of the flow. A means is provided for deflecting the flow extending from adjacent the trailing portion in order to change the direction of flow with respect to the duct whereby the deflecting of the flow extending from adjacent the trailing portion varies the flow upstream thereof to induce a control lift force upon the duct.

U.S. Pat. No. 3,961,591 to Fuller discloses a propeller nozzle or duct in which the walls thereof terminate in two or more planes inclined symmetrically about an axis normal to the nozzle or duct centerline with one or more deflector rudders pivotedly mounted across the opening so formed such that by swinging the rudder(s) one half of the exit area may be closed and the propeller race diverted through the remaining open area under the guidance of the rudder(s) upon which the race reacts to develop a steering force. The turning capabilities of a fixed nozzle or duct are thereby improved whilst wetted area may be reduced and propulsive efficiency increased by recovery of rotational energy otherwise lost to the wake. When used in conjunction with a pivoted steering nozzle a reverse thrust may be developed.

U.S. Pat. No. 3,982,494 to Posti discloses an auxiliary rudder apparatus for a water craft having a jet propulsion pump comprising an auxiliary rudder element coupled to the craft for movement between a raised inoperative position and a lowered operative position. A hydraulic cylinder operated by water pressure is coupled to the rudder element to move the same automatically to inoperative position when the craft is driven at sufficiently high speed that the water pressure of the pump is adequate to operate the hydraulic cylinder. The hydraulic cylinder is inoperative to move the rudder element to raised position both in forward and reverse travel of the craft below this high speed.

U.S. Pat. No. 4,421,489 to Van Weldhuizen discloses a vehicle to be propelled by a rearward discharge of fluid therefrom and including fluid jet developing structure for discharging a rearward jet of fluid along a predetermined path for propelling the vehicle forwardly. A pair of upstanding steering vanes are mounted for rotation about upstanding axes spaced transversely apart and disposed on opposite sides of the center line of the aforementioned path. Control structure is also provided and operative to simultaneously similarly angularly displace the vanes about their axes of oscillation and the control structure further includes adjustment structure for selectively relatively angularly displacing the vanes about their axes of oscillation. The vanes extend rearwardly of their axes of oscillation distances greater than one-half the distance between the axes of oscillation of the vanes, whereby opposite relative angular displacement of the vanes to forwardly and outwardly inclined positions displaced generally 50° to 60° from front-to-rear extending positions will cause the rear ends of the vanes to swing into close juxtaposed positions U.S. Pat. No. 5,167,547 to Kobayashi et al. discloses several embodiments of jet propelled watercraft including steering rudders pivotally supported by the steering nozzle of the jet propulsion unit for providing a steering affect at low speeds and when coasting. The steering rudder is selectively moveable between its steering position and non-steering position so as to permit unincumbered high speed operation. An arrangement is incorporated that permits the rudder to pivot automatically from its steering position to an out of the way position when an underwater obstacle is struck.

U.S. Pat. No. 6,086,437 to Murray discloses a blow back rudder consisting of a rudder blade, rudder shaft and a plate assembly that is pivotally mounted to the nozzle of a jet nozzle of a personal water craft. The blow back rudder is spring biased in the steering mode and is positioned out of the water by the impingement force of the jet stream discharging from the nozzle acting on the plate. This provides off throttle steering. The plate is contoured to allow the plate to remain in the jet stream at low thrust and water craft speeds for rudder steering. In another embodiment, these features are contained and the plate is contoured with a concave face and its position relative to the discharge port of the jet nozzle is controlled in order to obtain reversing of the water craft.

U.S. Pat. No. 6,202,630 to Yip discloses a method for controlling engine torque during a closed to open throttle transition in order to eliminate undesirable accelerations and oscillations from the powertrain.

U.S. Pat. No. 6,302,047 to Cannon discloses a retractable rudder assembly for use in steering a personal watercraft. The rudder assembly includes at least one planar rudder operably coupled to an elongate shaft rotatably mounted on a water jet drive nozzle. The rudder is biased into a normally extended position in which the rudder extends away from the water jet drive nozzle for use in steering the watercraft at a throttle-off position. A paddle is affixed to the shaft and is positioned within a water jet flow path defined within the water jet nozzle so that the force of a water jet passed therethrough and striking the paddle at a throttle-on position urges the rudder into a retracted position with respect to the water jet drive nozzle. When the water jet drive is moved into the throttle-off position, the rudder is biased into its extended position for use in steering the watercraft U.S. Pat. No. 6,336,834 to Nedderman, Jr. et al. discloses a rudder assembly attached to the nozzle of a jet-powered watercraft by a spring-loaded pivot so as to turn with the nozzle when the craft is steered. The rudder assembly has two flat plate rudders with a baffle plate attached perpendicularly between the rudders. The baffle plate partially covers the nozzle when the watercraft is at rest and is held in position by the spring-loaded pivot. At slow speeds the rudders are parallel to the water jet flow from the nozzle to aid in steering the watercraft. At higher speeds, the force of the water jet against the baffle plate overcomes the spring force to pivot the rudder assembly up and away from the nozzle such that steering is provided by directing the nozzle. In an imminent high-speed collision situation, the panic reaction is to shut off the throttle, which abruptly ends the jet flow from the nozzle. The spring-loaded pivot forces the baffle plate back over the nozzle and the rudders are again positioned parallel with the nozzle to provide steering without any flow from the nozzle.

U.S. Pat. No. 6,415,729 to Nedderman et al. discloses an improved steering system for a water craft and an improved method of steering. The steering system includes at least two variable camber plates or rudders mounted to a hull of the water craft for imparting a steering force to the water craft. Each of the variable camber plates is preferably formed from a flexible material and has a leading edge affixed to the hull. A linkage mechanism is attached to a steering device on the water craft and causes at least one of the plates to move relative to the hull and thereby vary the camber of the at least one plate.

U.S. Pat. No. 6,561,858 to Wallkowiak discloses an auxiliary system for providing positive steering to marine crafts using jet propulsion systems, typically personal jet driven watercrafts such as jet boats and jet skis. In one embodiment, it includes, among other features, a combination of keel members attached to a stern section of a hull. The keels are interconnected using tie rods to the directional steering drive assembly. In other embodiments, the keels are instead attached directly to the directional nozzle or integrally made with the nozzle, and where a hood is included in the directional nozzle assembly, notches may be included in the keels to allow for full operation of the hood into its lowest position.

U.S. Pat. No. 6,702,630 to Wallkowiak discloses an auxiliary system for providing positive steering to marine crafts using jet propulsion systems, typically personal jet driven watercrafts such as jet boats and jet skis. In one embodiment, it includes, among other features, a combination of keel members attached to a stern section of a hull. The keels are interconnected using tie rods to the directional steering drive assembly. In other embodiments, the keels are instead attached directly to the directional nozzle or integrally made with the nozzle, and where a hood is included in the directional nozzle assembly, notches may be included in the keels to allow for full operation of the hood into its lowest position.

U.S. Pat. No. 7,018,252 to Simard et al. discloses a watercraft including a watercraft control mechanism that is capable of steering, decelerating, and/or trimming a watercraft without causing the stern to elevate and the bow to dive. The mechanism steers or assists steering in off-power situations; steers, trims and/or decelerates a watercraft, or assists in steering, trimming, and/or decelerating a watercraft. Further, the mechanism can be stowed or retracted to minimize hydrodynamic drag at high speeds; steers, trims and/or decelerates a watercraft, or assists in steering, trimming, and/or decelerating a watercraft that does not become clogged or jammed by seaweed or flotsam or foreign objects floating in the water; and decelerates or assists in decelerating a watercraft in a smooth and stable manner when the watercraft is travelling at high speeds.

U.S. Pat. No. 7,168,996 to Morvillo discloses a thrust control system including a control apparatus having water jet deflectors that deflect water to provide a reversing/backing thrust and a trim force to marine vessels using water jet propulsion. Other aspects include an electromechanical control lever assembly for operating actuators, the assembly comprising a mechanical lever coupled to a transducer that generates an electrical output. Yet other aspects comprise a load-sensing hydraulic circuit comprising at least two loads and a control system for controlling at least one of the loads, that prevents unwanted pressure transients in the circuit.

U.S. Pat. No. 8,425,269 to Wallkowiak discloses a rudder system that uses a dual purpose thrust operated actuator. The actuator is selectively positioned for use in an up or constant down mode. While in the up mode, the actuator uses the force of the jet pump to raise the rudders out of the water at speed, and with the actuator set in the down mode, the invention uses the force of the jet pump water to hold the rudder in the water. In an alternative embodiment, the invention includes anti-oscillating veins attached to the thrust operated actuator. In another alternative embodiment, the travel of the actuator is limited by configuring it to come into contact with a rudder stabilizer bar. Another embodiment includes providing adjustable fin positions relative to the side force stabilizer.

U.S. Pat. No. 8,712,003 to Ishida et al. discloses a jet pump having a plurality of nozzles installed to a nozzle base, a throat and a diffuser. A first nozzle straight-tube portion, a first nozzle narrowing portion, a second nozzle straight-tube portion, a second nozzle narrowing portion, and a nozzle lower end portion formed in those nozzles are disposed in this order from the nozzle base to a ejection outlet. A narrowing angle of the second nozzle narrowing portion is larger than of the first nozzle narrowing portion. The jet pump forms, in a lower end portion of the throat, a flow passage narrowing portion having a flow passage cross-sectional area that gradually diminishes. This flow passage narrowing portion is inserted into an upper end portion of the diffuser.

United States Patent Application US2006/0037521 to Jamison discloses a conversion arrangement for kayak with stabilizer, keel, rudder, and rudder pedals. A functional accessory arrangement for converting a kayak that will use the same kites as the kite surfer's use for propulsion. The conversion includes a rudder, keel and stabilizer. The stabilizer is designed to keep the kayak upright even if the kite is 90 degrees to the vessels beam and it allows the kayak to tack into the wind.

United States Patent Application US2010/0183113 to Ishida et al. discloses a jet pump having a plurality of nozzles installed to a nozzle base, a throat and a diffuser. A first nozzle straight-tube portion, a first nozzle narrowing portion, a second nozzle straight-tube portion, a second nozzle narrowing portion, and a nozzle lower end portion formed in those nozzles are disposed in this order from the nozzle base to a ejection outlet. A narrowing angle of the second nozzle narrowing portion is larger than of the first nozzle narrowing portion. The jet pump forms, in a lower end portion of the throat, a flow passage narrowing portion having a flow passage cross-sectional area that gradually diminishes. This flow passage narrowing portion is inserted into an upper end portion of the diffuser.

Although the aforementioned prior art have contributed to the development of the art of rudder systems for water jet powered vessels none of these prior art patents have solved the needs of this art.

Therefore, it is an object of the present invention to provide an improved steering system for water jet powered craft.

Another object of this invention is to provide an improved improved steering system for water jet powered craft which does not produce underwater drag when operating at on-throttle ranges.

Another object of this invention is to provide an improved steering system for water jet powered craft which may be installed as an aftermarket accessory.

Another object of this invention is to provide an improved steering system for water jet powered craft that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to an improved rudder redivce for a hydrojet vessel. The rudder device comprises a first mounting bracket coupled to the first hydrojet. A first rudder is coupled to the first hydrojet and the first mounting bracket. A second mounting bracket is coupled to the second hydrojet. A second rudder is coupled to the second hydrojet and the second mounting bracket. A coupling rod is pivotably coupled to the first hydrojet, the second hydrojet and the hull rudder for pivoting in alignment and in unison the first rudder with the first hydrojet and the second rudder with the second hydrojet relative to the hull rudder. The first rudder and the second rudder provide steerage to the vessel during non directional thrust created by the first hydrojet and the second hydrojet.

In another embodiment of the invention, a rudder device includes a first general U-shaped mounting bracket coupled to the first hydrojet and partially encircling the first hydrojet. A first primary J-shaped locking tab is coupled to the first general U-shaped mounting bracket. The first general U-shape mounting bracket and the first primary J-shaped locking tab compress the first hydrojet there between for defining a first primary clamp. A first secondary J-shaped locking tab is coupled to the first general U-shaped mounting bracket. The first general U-shape mounting bracket and the first secondary J-shaped locking tab compress the first hydrojet there between for defining a first secondary clamp. A first steering assist rudder is coupled to the first general U-shape mounting bracket. The first steering assist rudder is positioned ahead of the first vertical pivot for assisting in pivoting the first hydrojet during forward displacement of the vessel through a body of water. A second general U-shaped mounting bracket is coupled to the second hydrojet and partially encircling the second hydrojet. A second primary J-shaped locking tab is coupled to the second general U-shaped mounting bracket. The second general U-shape mounting bracket and the second primary J-shaped locking tab compress the second hydrojet there between for defining a second primary clamp. A second secondary J-shaped locking tab is coupled to the second general U-shaped mounting bracket. The second general U-shape mounting bracket and the second secondary J-shaped locking tab compress the second hydrojet there between for defining a second secondary clamp. A second steering assist rudder is coupled to the second general U-shape mounting bracket. The second steering assist rudder is positioned ahead of the second vertical pivot for assisting in pivoting the second hydrojet during forward displacement of the vessel through a body of water.

In another embodiment of the invention, the first rudder is pivotably coupled to the first hydrojet by a first primary horizontal pivot. A first side plate is pivotably coupled to the first hydrojet by a first secondary horizontal pivot. A first coupling plate is coupled between the first rudder and the first side plate. A first coil spring engages the first primary horizontal pivot for promoting the first rudder and the first side plate being positioned in a non-pivoted position. A second general U-shaped mounting bracket is coupled to the second hydrojet and partially encircling the second hydrojet. A second rudder is pivotably coupled to the second hydrojet by a second primary horizontal pivot. A second side plate is pivotably coupled to the second hydrojet by a second secondary horizontal pivot. A second coupling plate is coupled between the second rudder and the second side plate. A second coil spring engages the second primary horizontal pivot for promoting the second rudder and the second side plate being positioned in a non-pivoted position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 15 is a top view of a first J-shaped locking tab of FIG. 11;

FIG. 16 is a left side view of FIG. 15;

FIG. 17 is a top view of a second J-shaped locking tab of FIG. 11;

FIG. 18 is a right side view of FIG. 17;

FIG. 19 is a top view of a general U-shaped mounting bracket of FIG. 11;

FIG. 20 is a right side view of FIG. 19;

FIG. 21 is a view of a first steering assist rudder of FIG. 11;

FIG. 22 is a top view of FIG. 21;

FIG. 23 is a right side view of FIG. 21;

FIG. 24 is a view of a second steering assist rudder of FIG. 11;

FIG. 25 is a top view of FIG. 24;

FIG. 26 is a right side view of FIG. 24;

Similar reference characters refer to similar parts throughout the several Figures of the drawings.

DETAILED DISCUSSION

Figure 1:
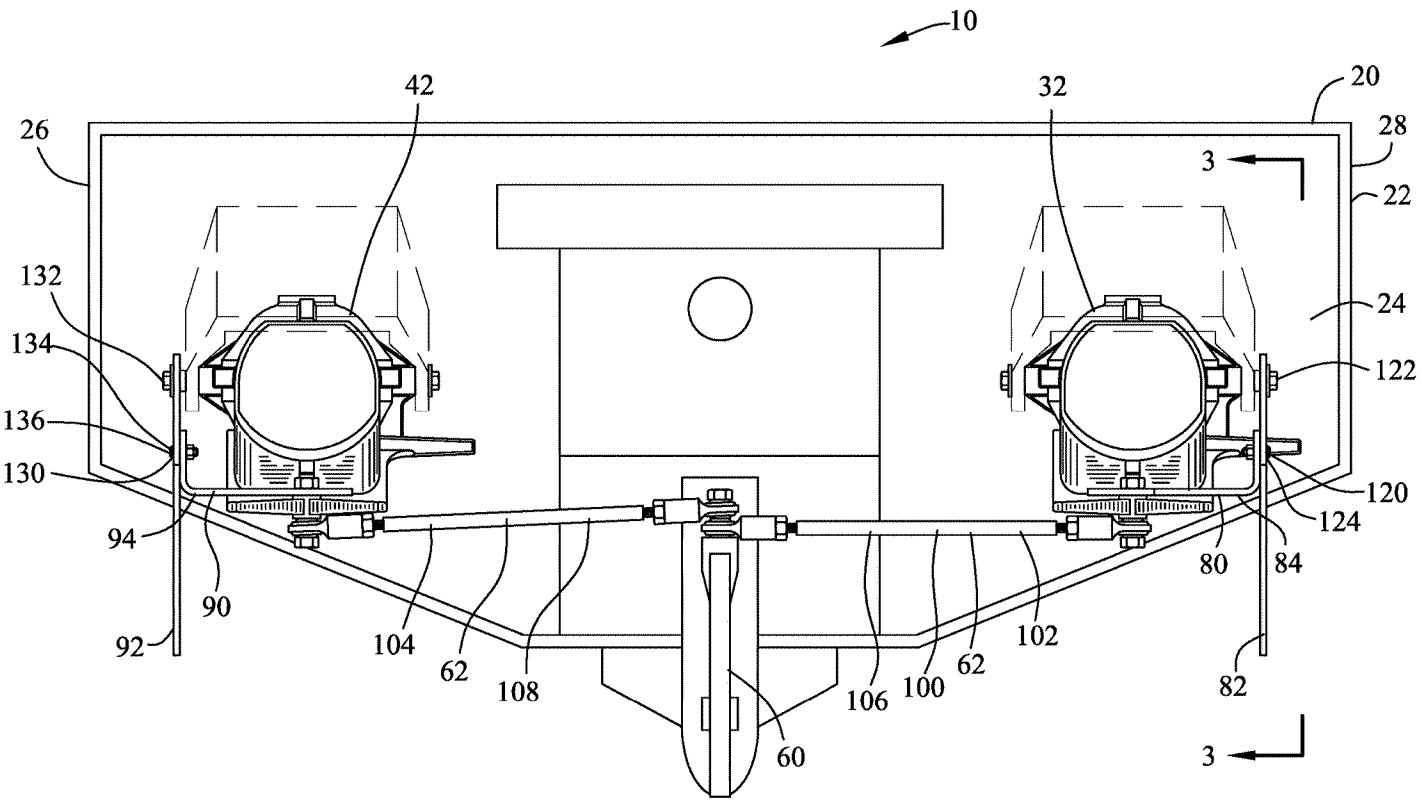
FIG. 1 is a rear view of a hydrojet vessel incorporation a first embodiment of the present invention.
Figure 2:
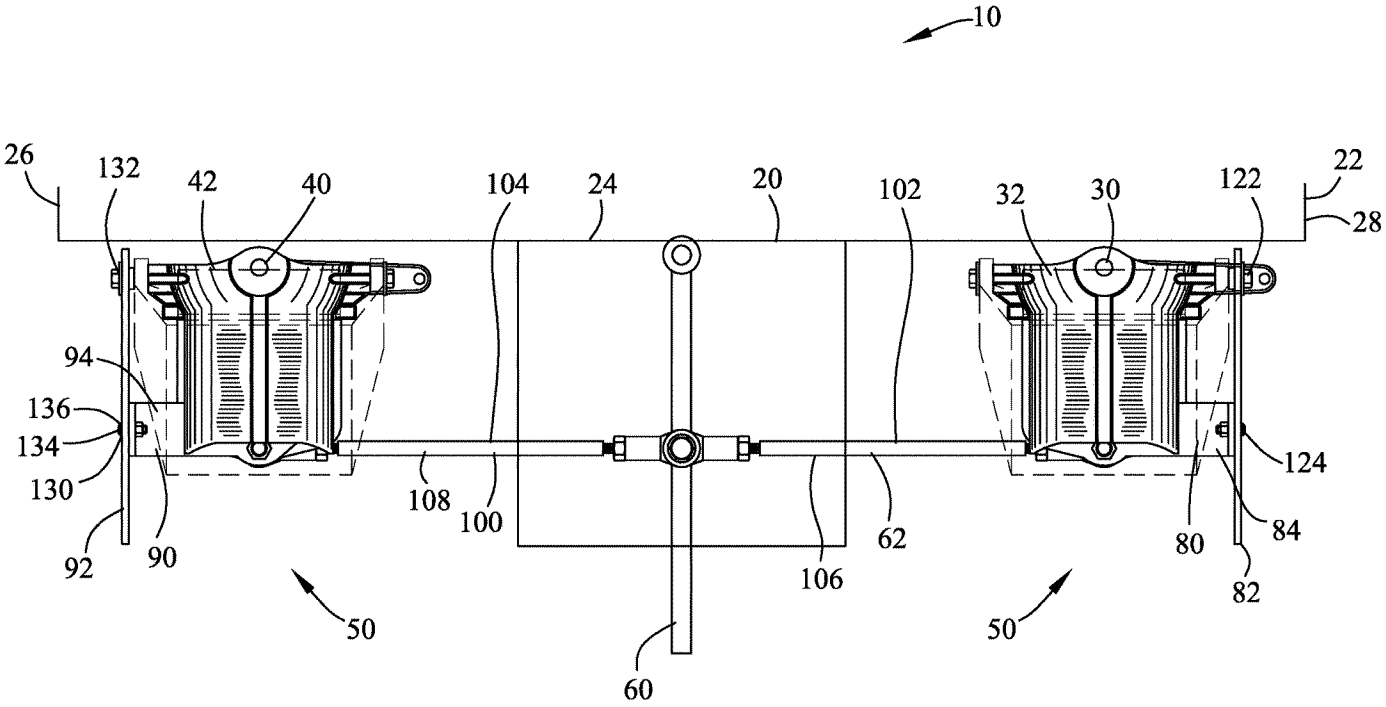
FIG. 2 is a top view of FIG. 1.
Figure 93:
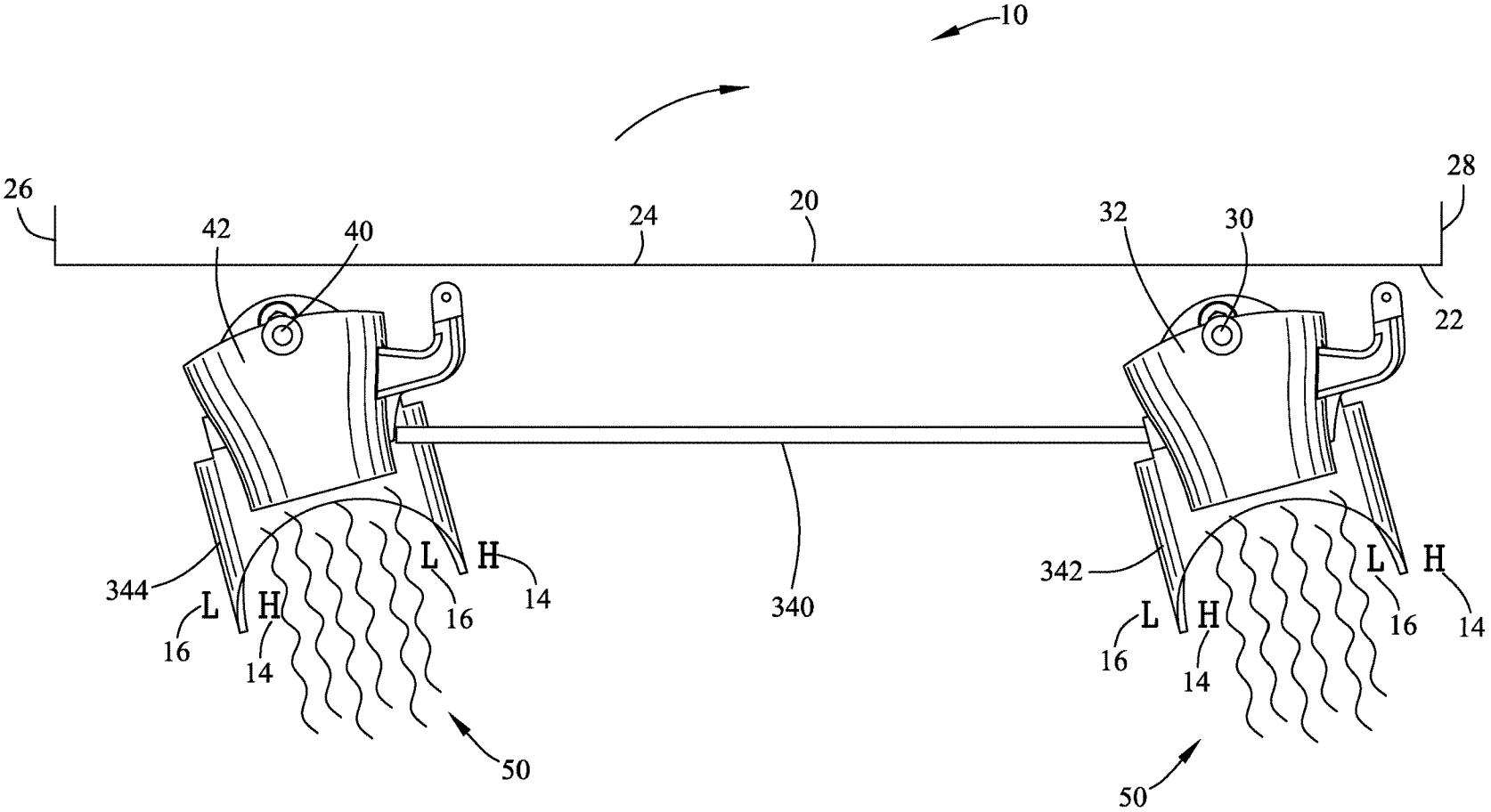
FIG. 93 is a view similar to FIG. 82 illustrating the rudder device within the body of water providing steerage to the vessel during non directional thrust and during directional thrust from the hydrojet.
Figure 94:
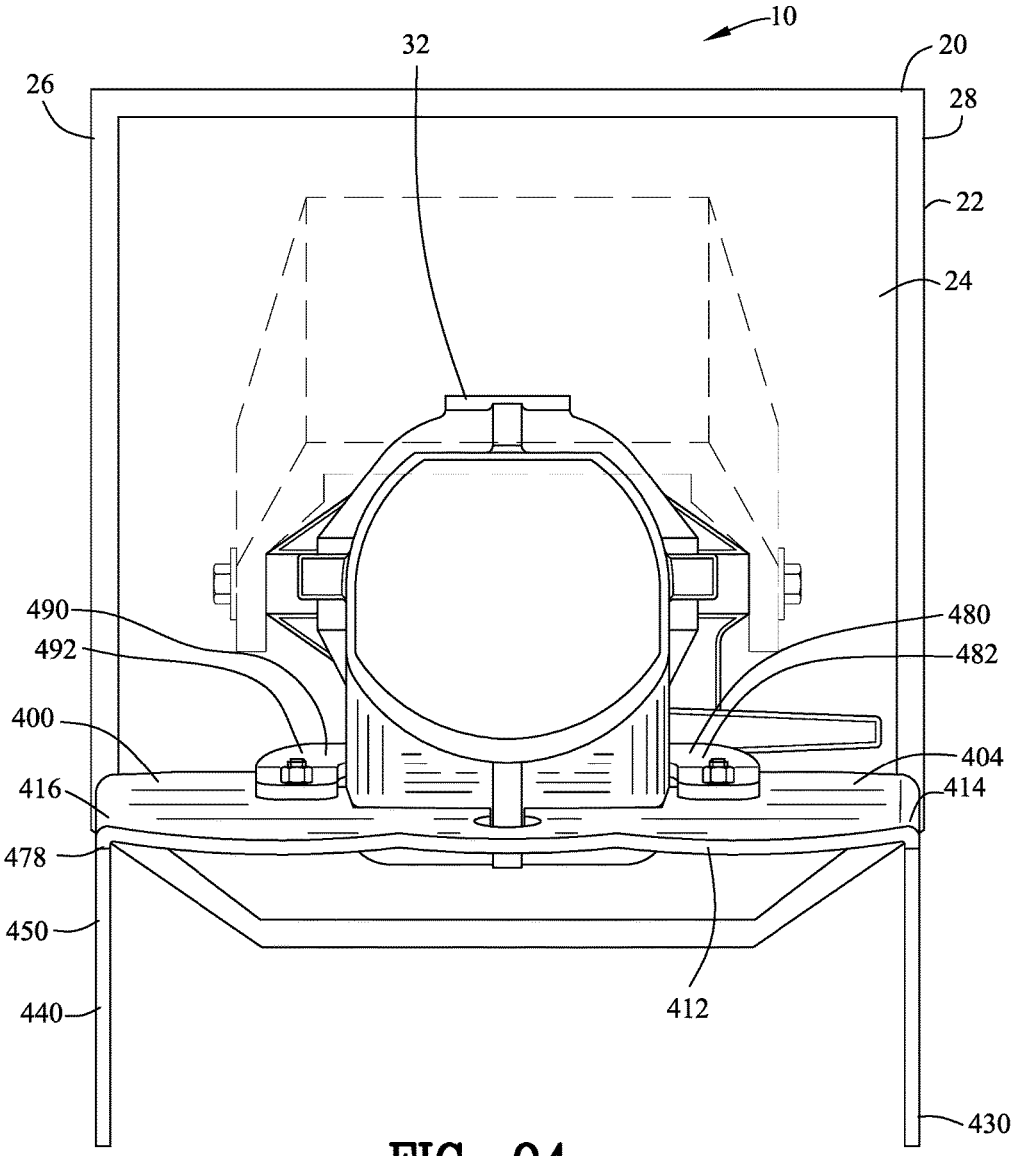
FIG. 94 is a rear view of a hydrojet vessel incorporation a twelfth embodiment of the present invention.
Figure 95:
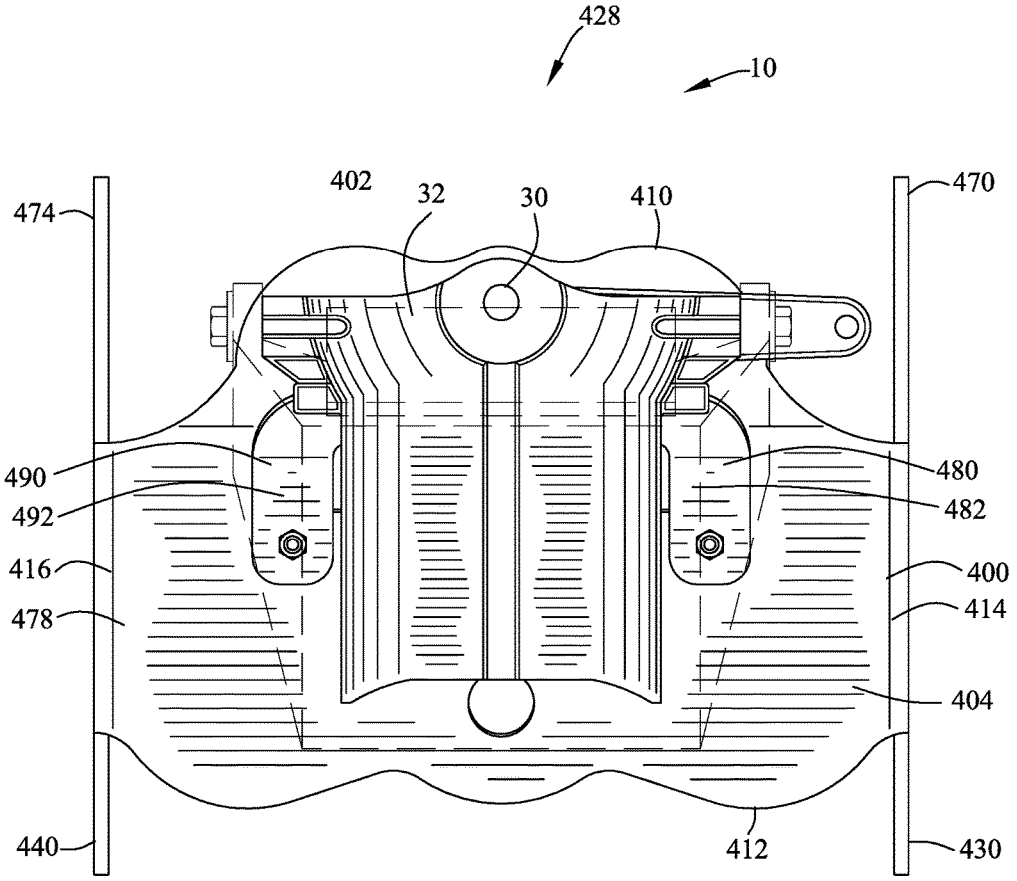
FIG. 95 is a top view of FIG. 94.
Figure 96:
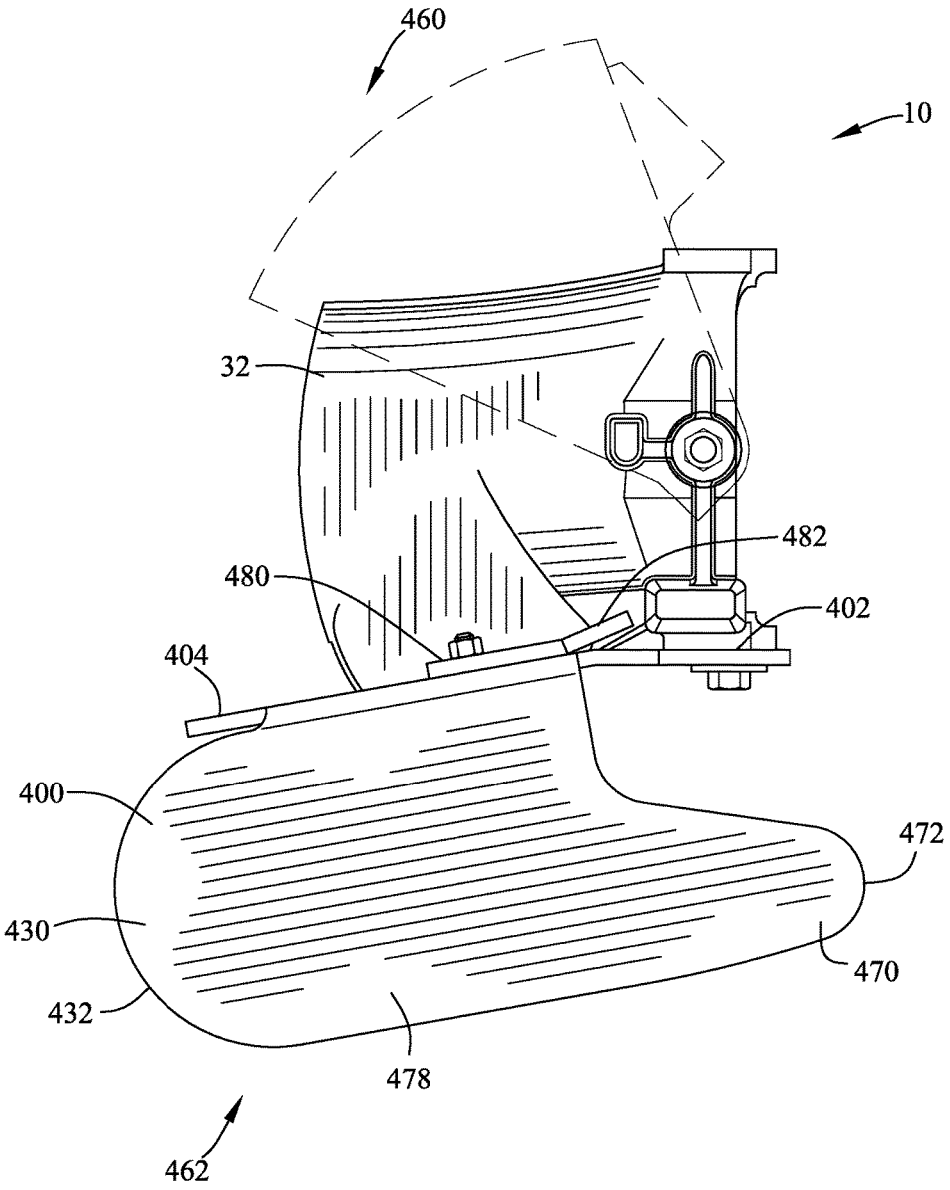
FIG. 96 is a right side view of FIG. 94.
Figure 97:
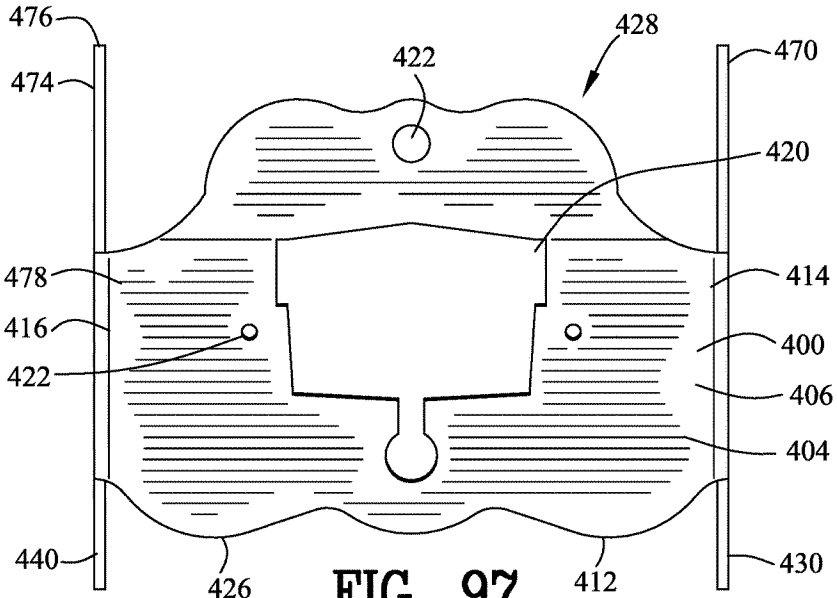
FIG. 97 is a top view of the rudder device of FIG. 94.
Figure 98:
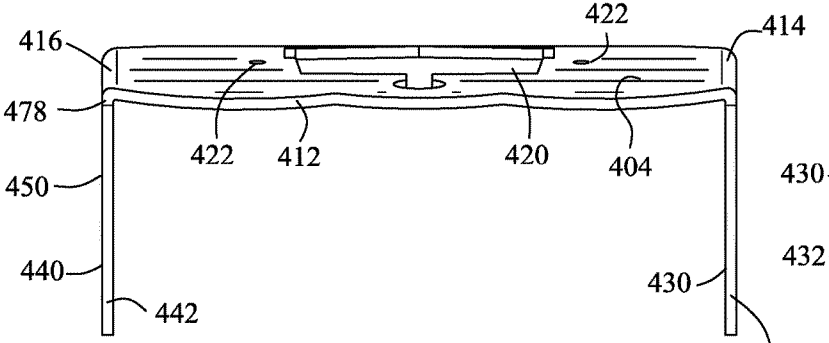
FIG. 98 is a front view of FIG. 97.
Figure 99:
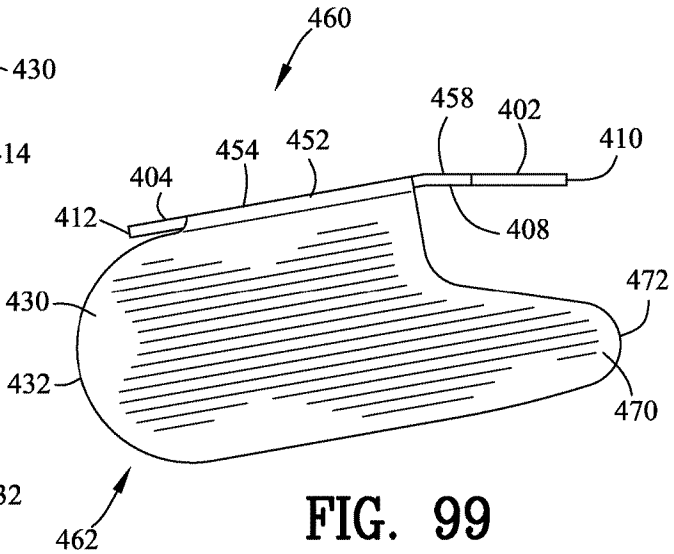
FIG. 99 is a right side view of FIG. 97.
Figure 100:
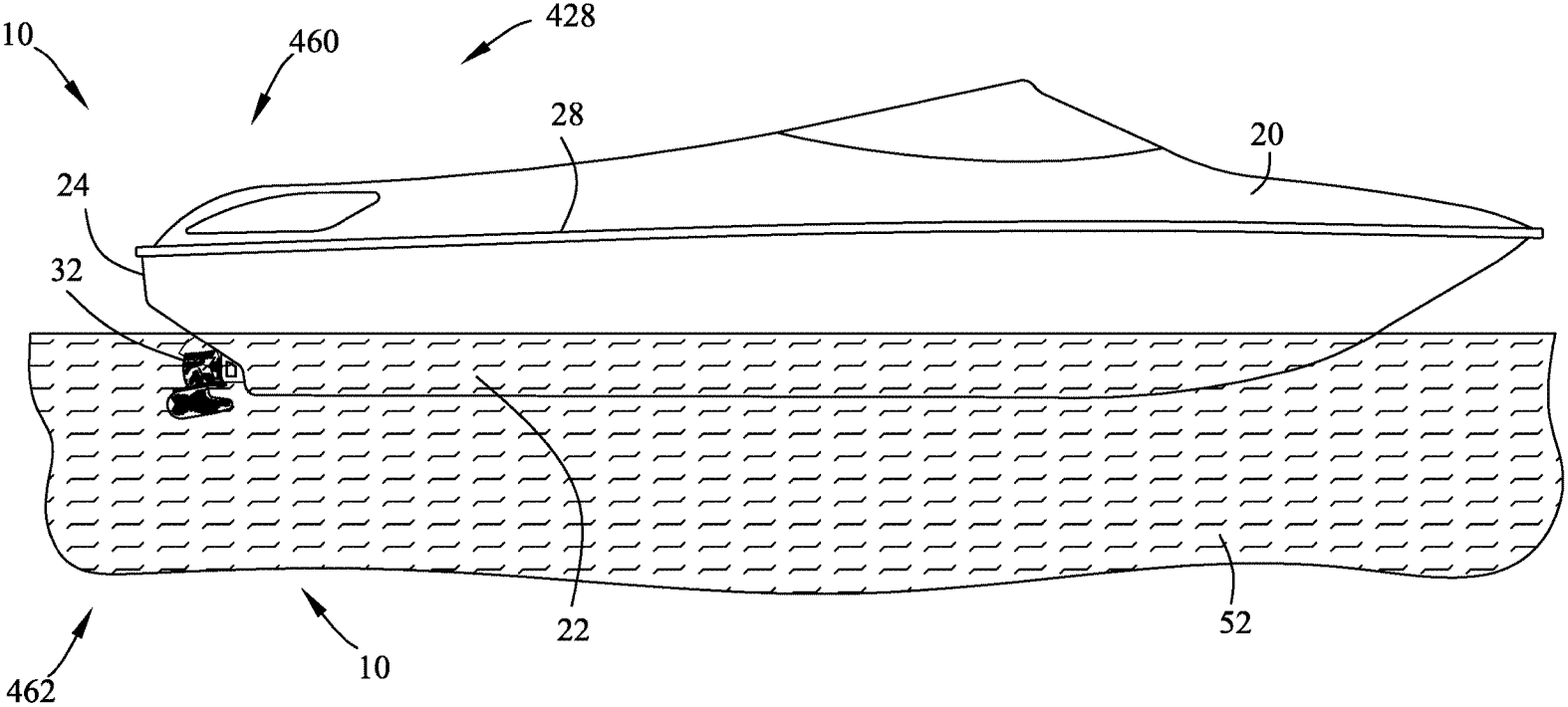
FIG. 100 is a view similar to FIG. 96 illustrating the twelfth embodiment secured to a hydrojet vessel.
Figure 101:
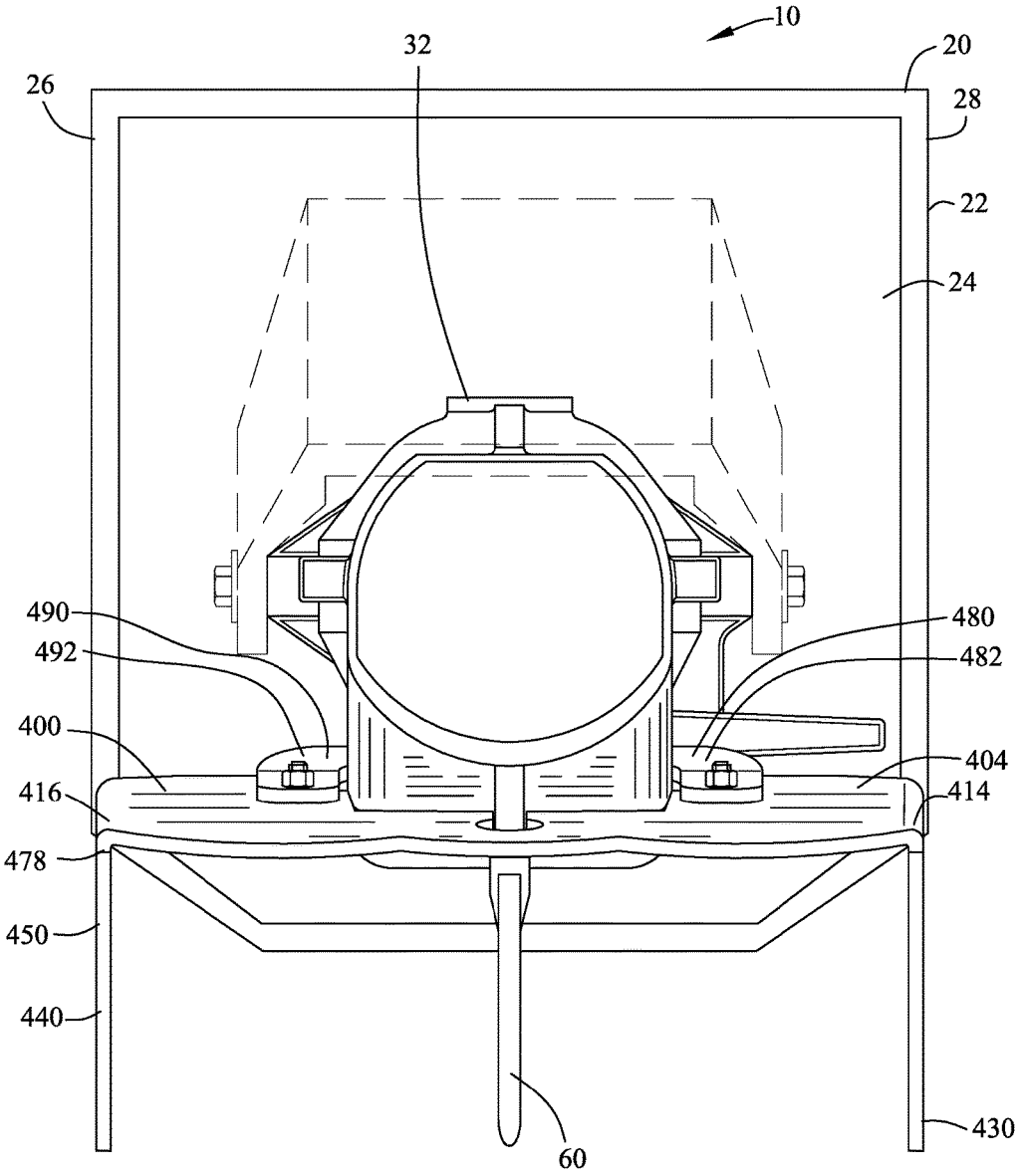
FIG. 101 is a view similar to FIG. 94 illustrating the twelfth embodiment utilized with a vessel including a hull rudder.

FIGS. 1-93 illustrate multiple embodiments of a rudder device 10 for a hydrojet vessel 20. FIGS. 1-64 and 90-92 include the hydrojet vessel 20 having a hull 22 including a stern 24, a port side 26 and a starboard side 28. A first vertical pivot 30 pivotably couples a first hydrojet 32 and a second vertical pivot 40 pivotably coupling a second hydrojet 42 to the stern 24 for producing a directional thrust 50 and propelling the hydrojet vessel 20 through a body of water 52. A hull rudder 60 is pivotably coupled to the stern 24 between the first hydrojet 32 and the second hydrojet 42. A linkage 62 couples the first hydrojet 32 with the hull rudder 60 for pivoting the hull rudder 60 relative to the first hydrojet 32.

FIGS. 1-10 and 90 illustrate the rudder device 10 comprises a first mounting bracket 80 coupled to the first hydrojet 32. A first rudder 82 is coupled to the first hydrojet 32 and the first mounting bracket 80. A second mounting bracket 90 is coupled to the second hydrojet 42. A second rudder 92 is coupled to the second hydrojet 42 and the second mounting bracket 90.

A coupling rod 100 is pivotably coupled to the first hydrojet 32, the second hydrojet 42 and the hull rudder 60 for pivoting in alignment and in unison the first rudder 82 with the first hydrojet 32 and the second rudder 92 with the second hydrojet 42 relative to the hull rudder 60. The first rudder 82 and the second rudder 92 provide steerage to the vessel 20 during non directional thrust absent from the first hydrojet 32 and the second hydrojet 42.

The coupling rod 100 may include a first length adjusting tie rod 102 and a second length adjusting tie rod 104. The first length adjusting tie rod 102 is coupled between the first hydrojet 32 and the hull rudder 60. The first length adjusting tie rod 102 alters a first length 106 in the first length adjusting tie rod 102 for aligning the first rudder 82, the first hydrojet 32 and the hull rudder 60. The second length adjusting tie rod 104 is coupled between the second hydrojet 42 and the hull rudder 60. The second length adjusting tie rod 104 alters a second length 108 in the second length adjusting tie rod 104 for aligning the second rudder 92, the second hydrojet 42 and the hull rudder 60.

A first plurality of apertures 120 are in the first rudder 82. A first horizontal pivot 122 pivotably couples the first rudder 82 with the first hydrojet 32. A first removable fastener 124 engages the first mounting bracket 80 and one of the first plurality of apertures 120 in the first rudder 82. The first removable fastener 124, the first mounting bracket 80 and the first plurality of apertures 120 define a first adjustable rudder elevation 126 for pivoting the first rudder 82 on the first horizontal pivot 122 and alters the elevation of the first rudder 82.

A second plurality of apertures 130 are in the second rudder 92. A second horizontal pivot 132 pivotably couples the second rudder 92 with the second hydrojet 42. A second removable fastener 134 engages the second mounting bracket 90 and one of the second plurality of apertures 130 in the second rudder 92. The second removable fastener 134, the second mounting bracket 90 and the second plurality of apertures 130 define a second adjustable rudder elevation 136 for pivoting the second rudder 92 on the second horizontal pivot 132 and altering the elevation of the second rudder 92.

Figure 3:
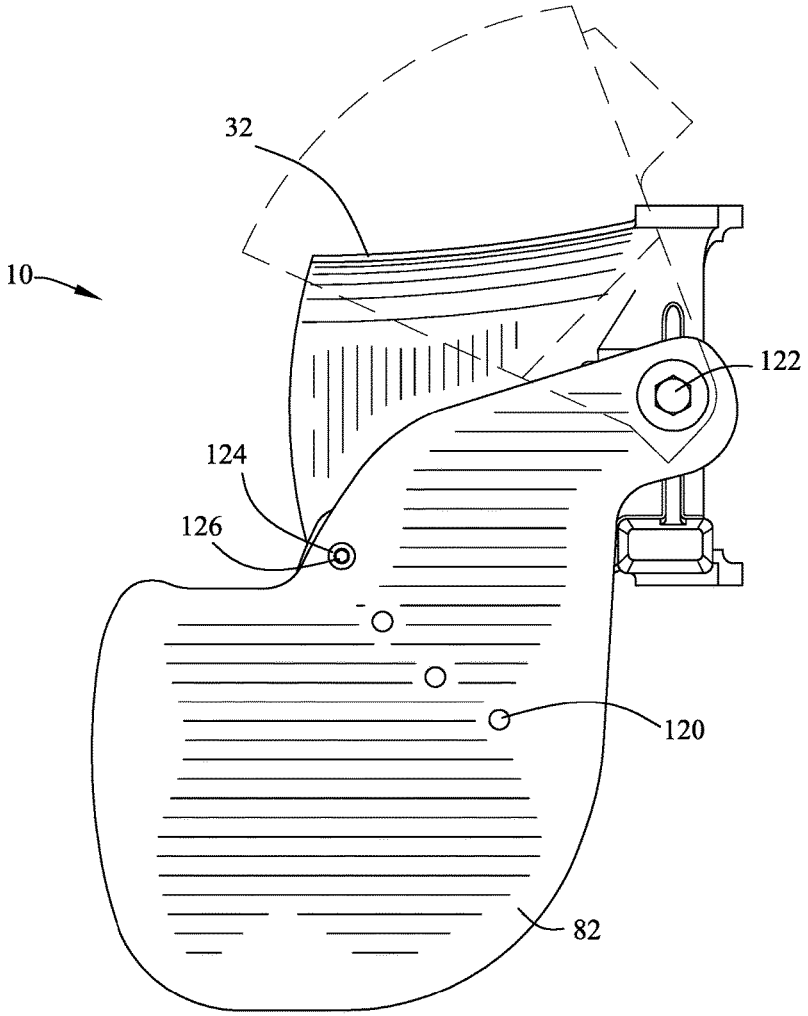
FIG. 3 is a view along line 3-3 of FIG. 1.
Figure 4:
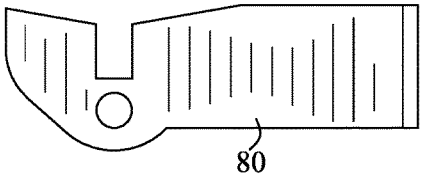
FIG. 4 is a top view of a mounting bracket of FIG. 1.
Figure 5:
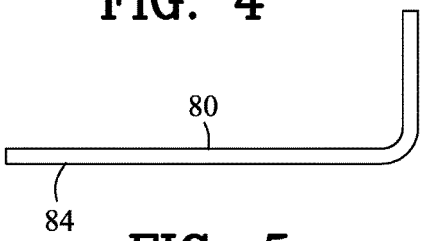
FIG. 5 is a front view of FIG. 4.
Figure 6:
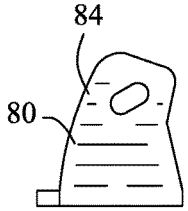
FIG. 6 is a right side view of FIG. 5.
Figure 7:
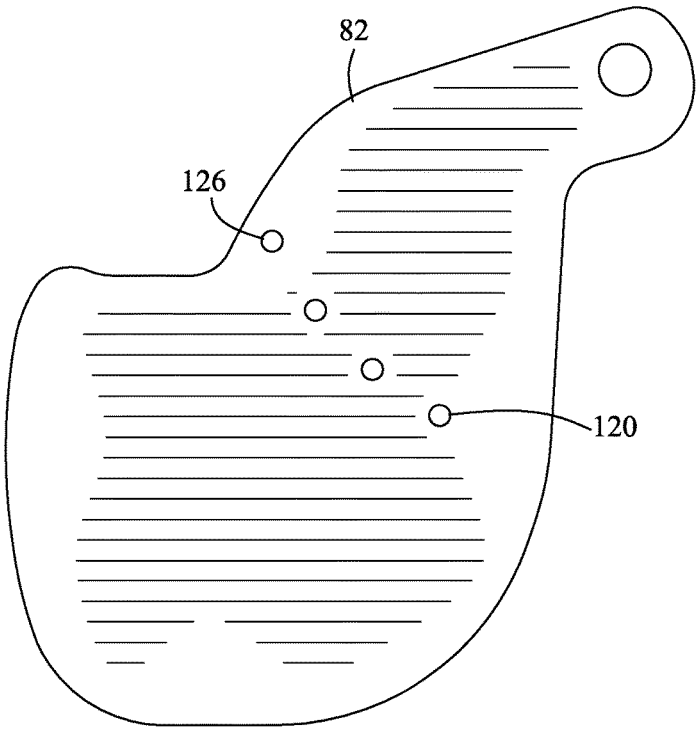
FIG. 7 is a left side view of a rudder of FIG. 3.
Figure 8:
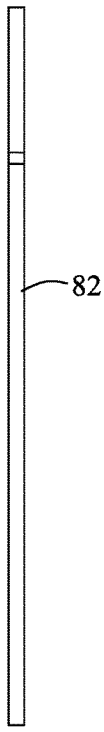
FIG. 8 is a right side view of FIG. 7.
Figure 9:
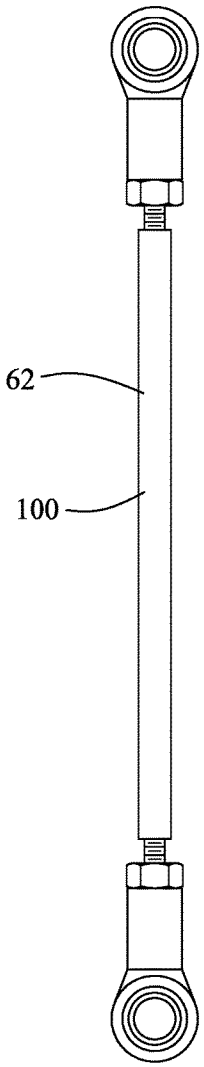
FIG. 9 is a top view of a length adjusting tie rod of FIG. 2.
Figure 10:
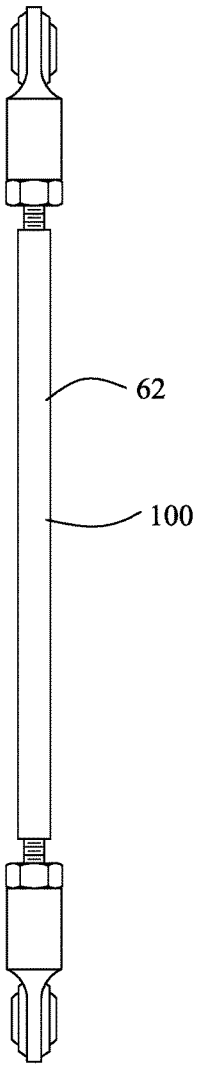
FIG. 10 is a right side view of FIG. 9.
Figure 11:
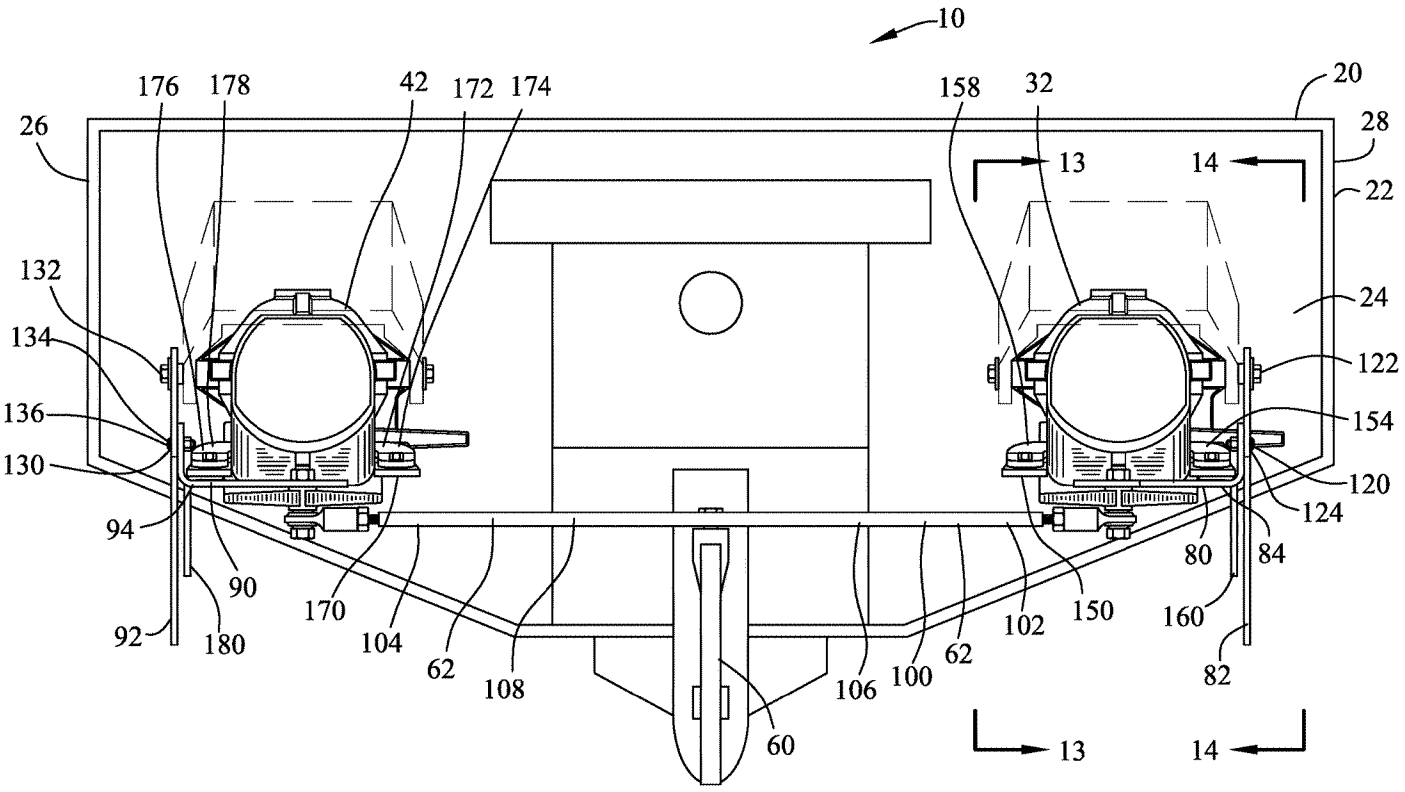
FIG. 11 is a rear view of a hydrojet vessel incorporation a second embodiment of the present invention.
Figure 12:
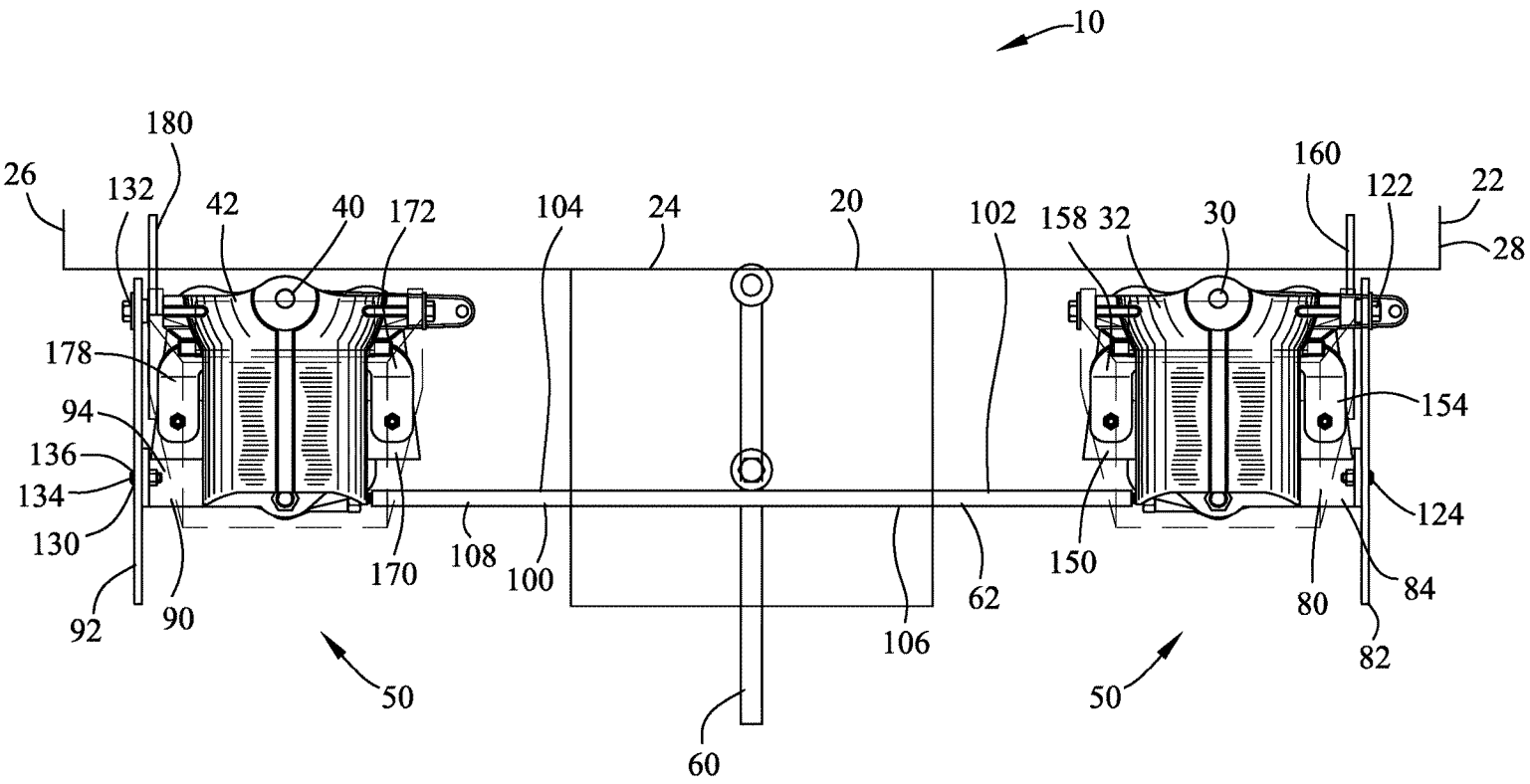
FIG. 12 is a top view of FIG. 11.
Figure 13:
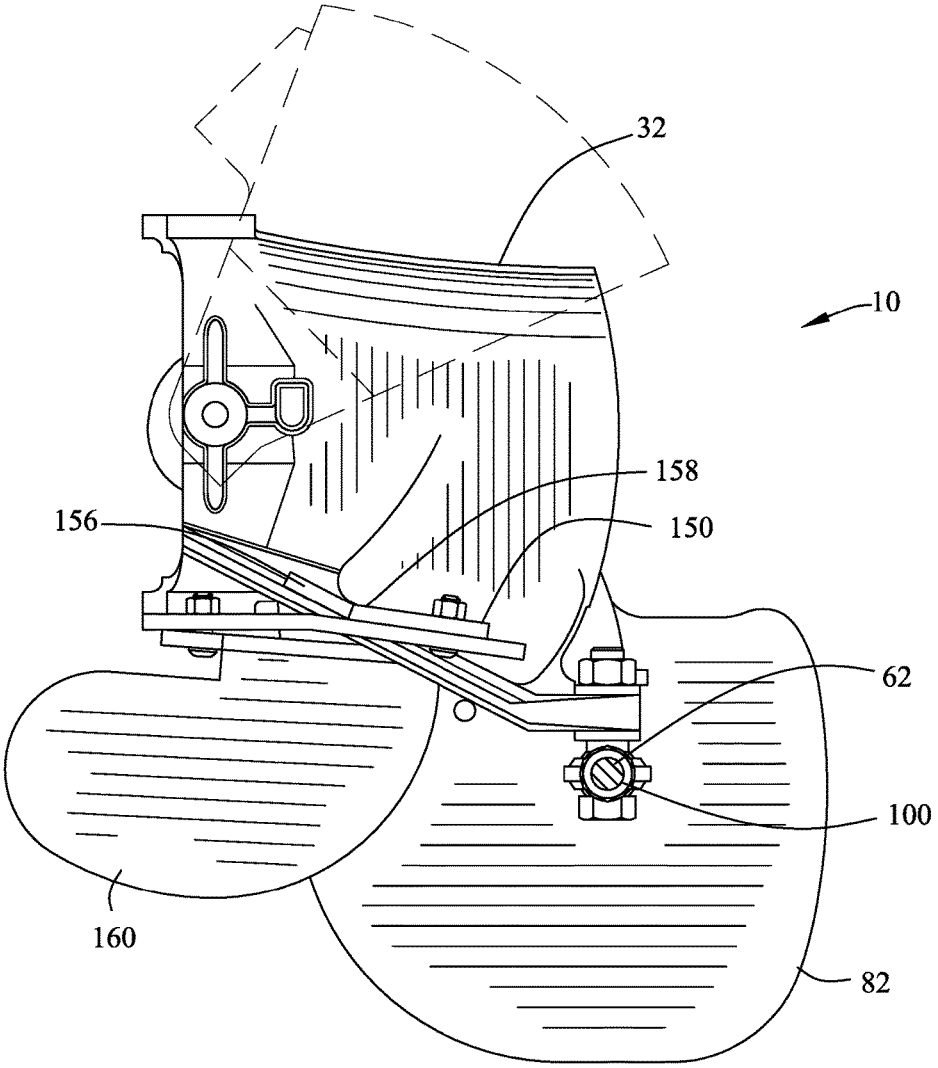
FIG. 13 is a view along line 13-13 in FIG. 11.
Figure 14:
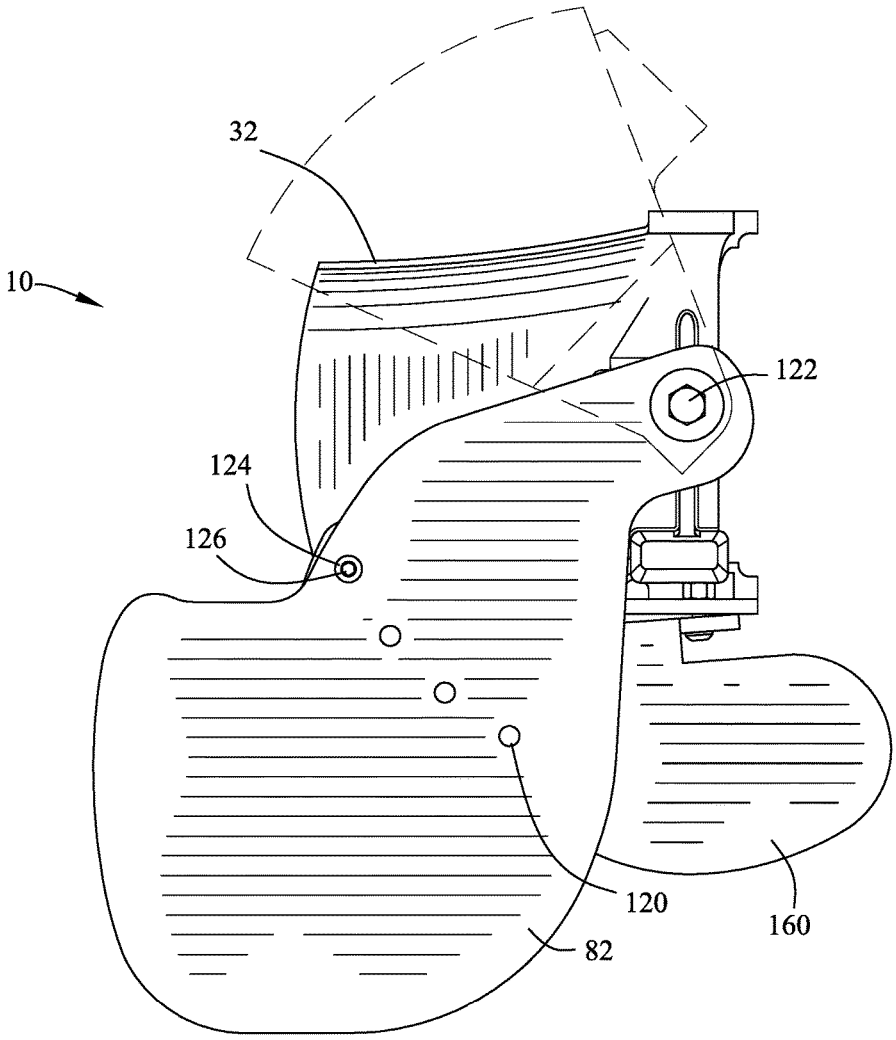
FIG. 14 is a view along line 14-14 in FIG. 11.
Figure 27:
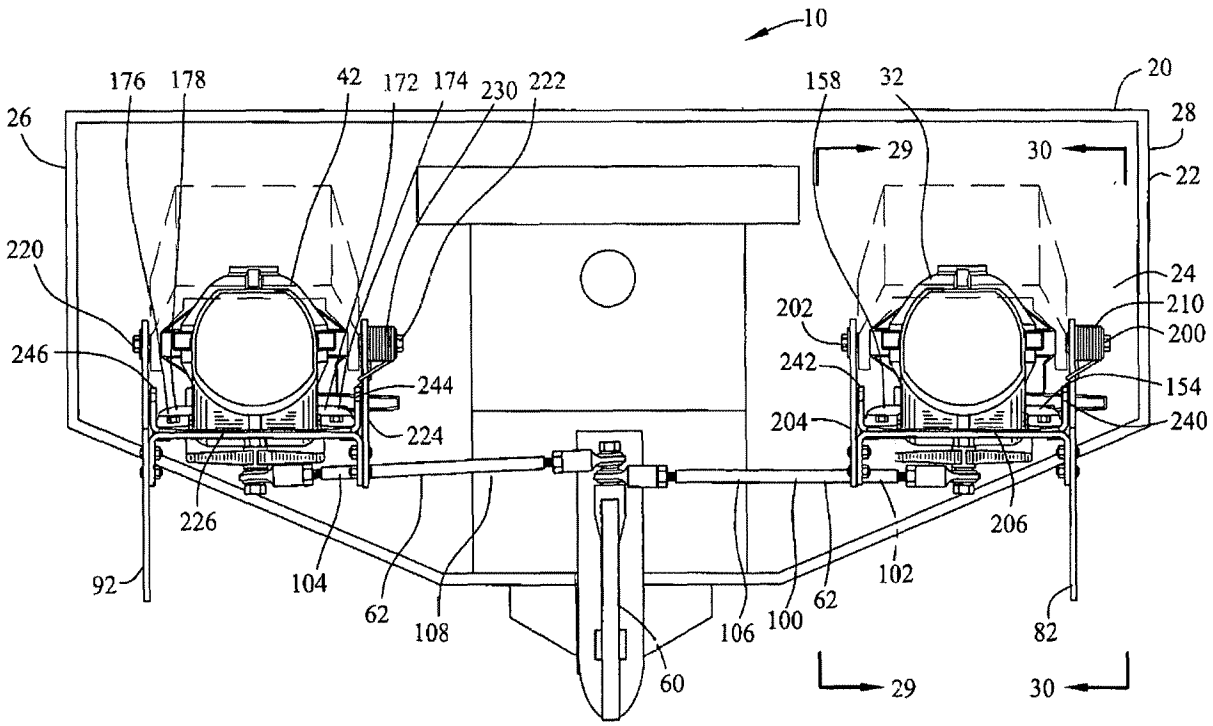
FIG. 27 is a rear view of a hydrojet vessel incorporation a third embodiment of the present invention.
Figure 28:
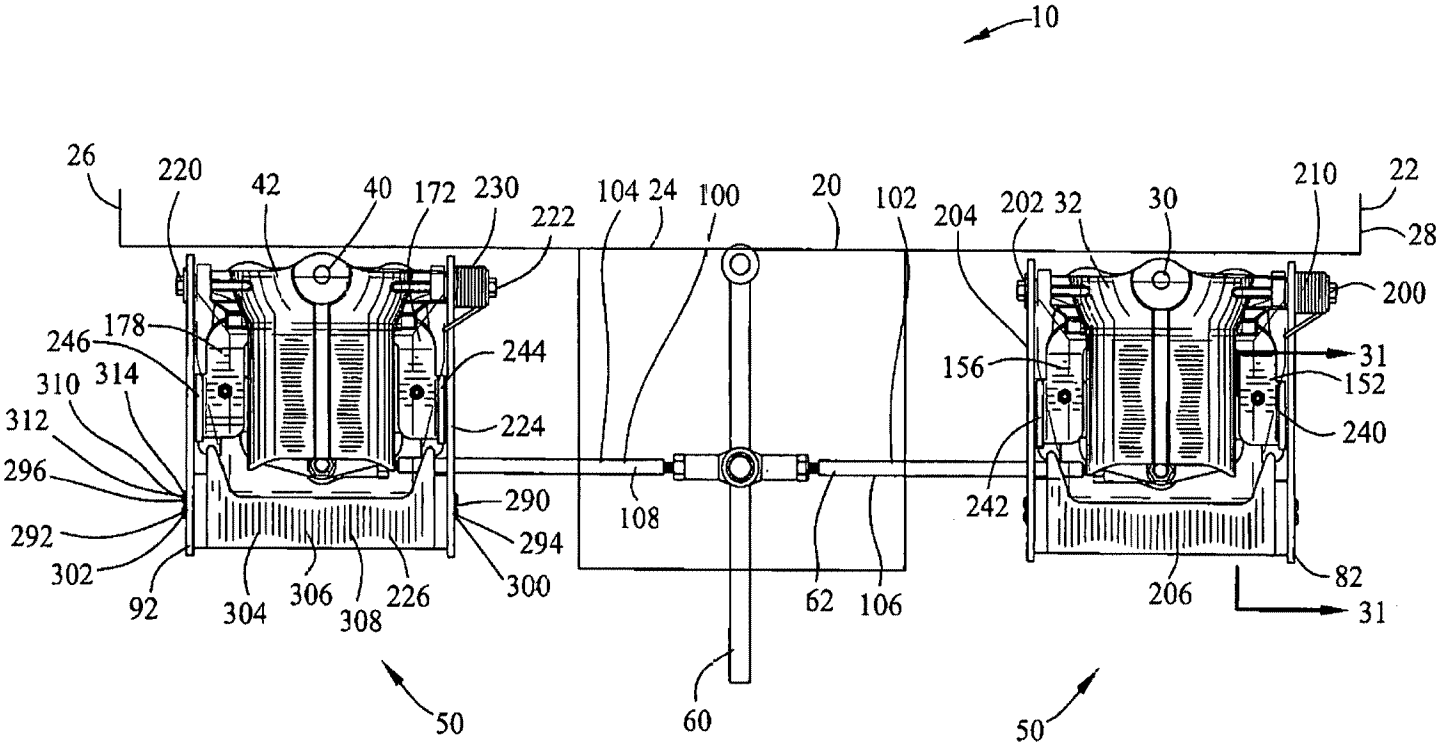
FIG. 28 is a top view of FIG. 27.
Figure 29:
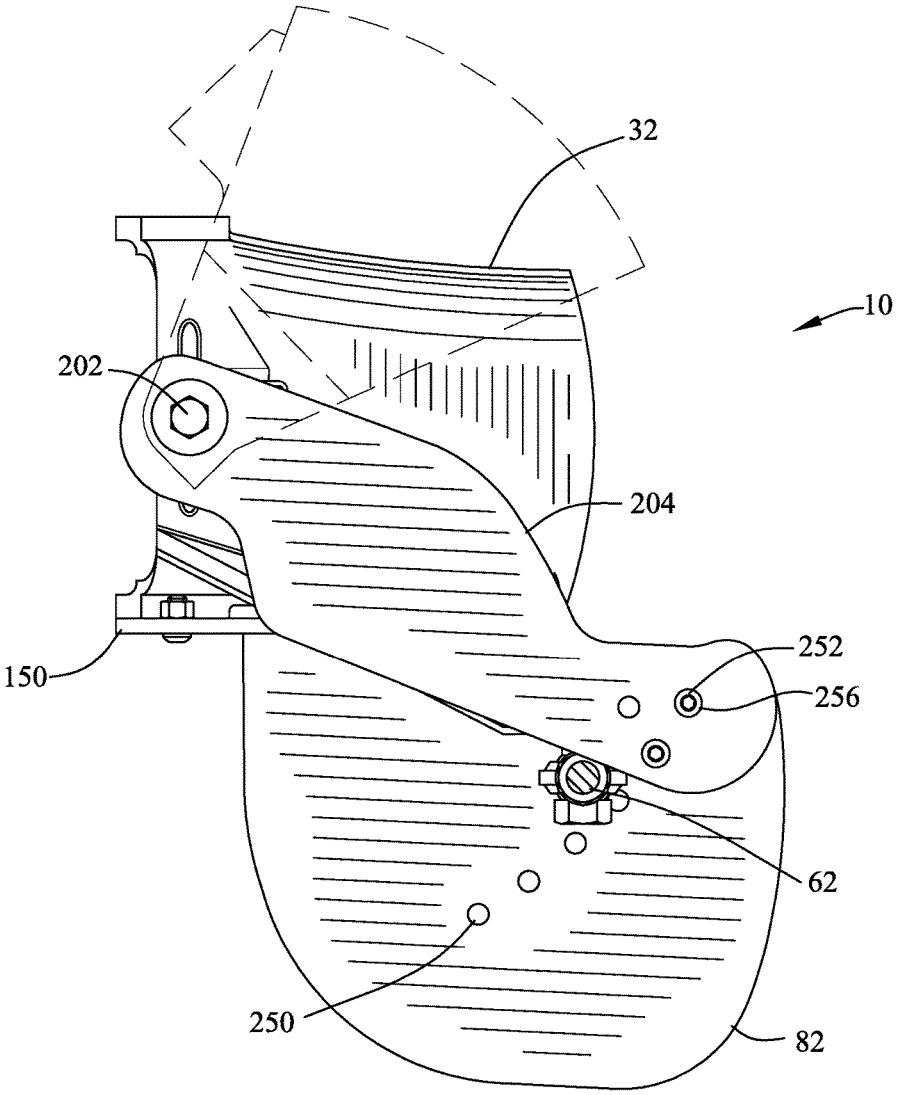
FIG. 29 is a view along line 29-29 of FIG. 27.
Figure 30:
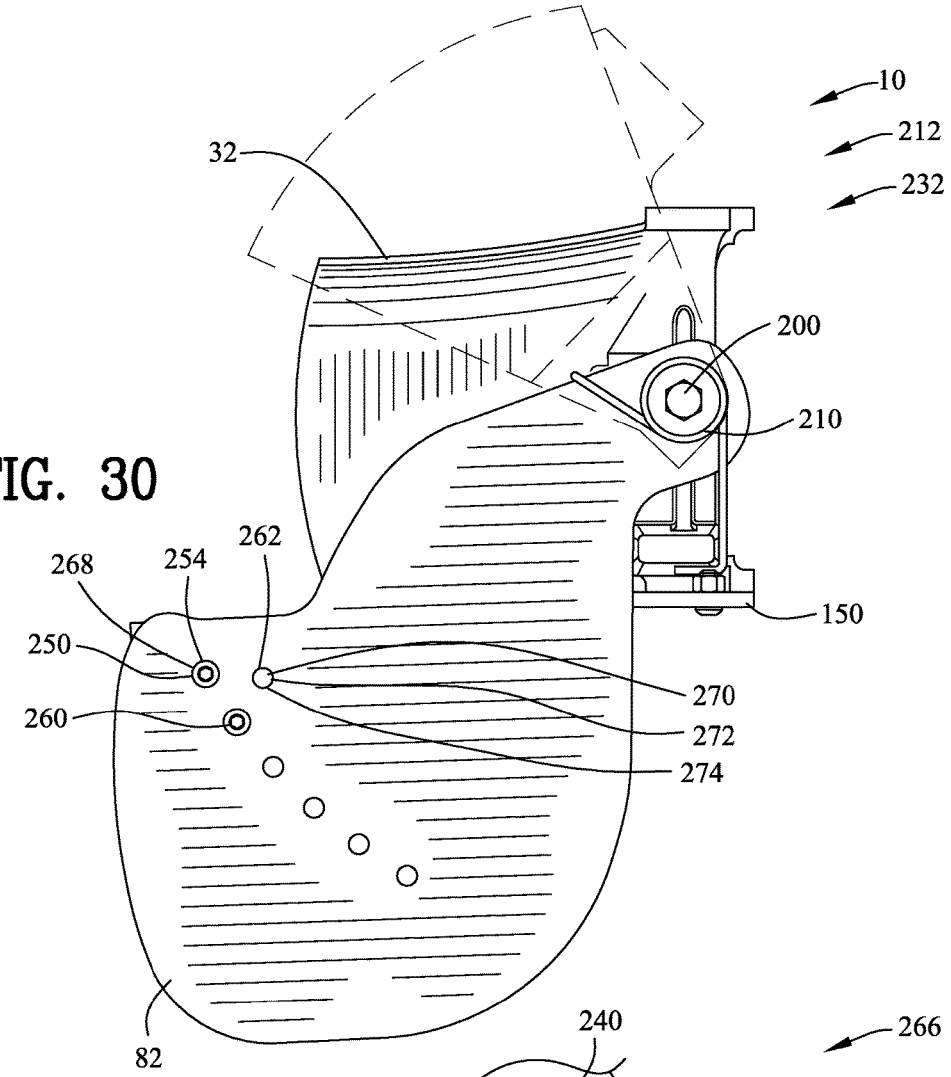
FIG. 30 is a view along line 30-30 of FIG. 27.
Figure 31:
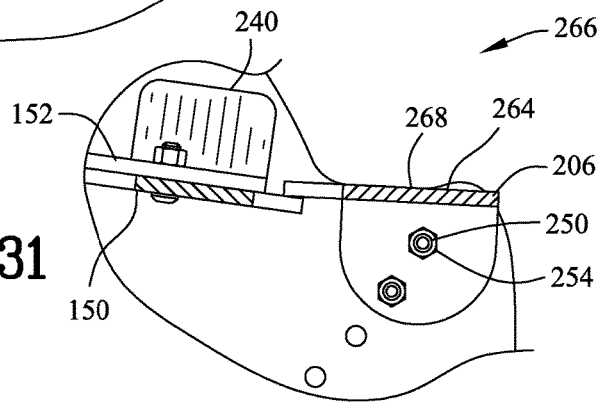
FIG. 31 is a section view along line 31-31 in FIG. 28.
Figure 32:
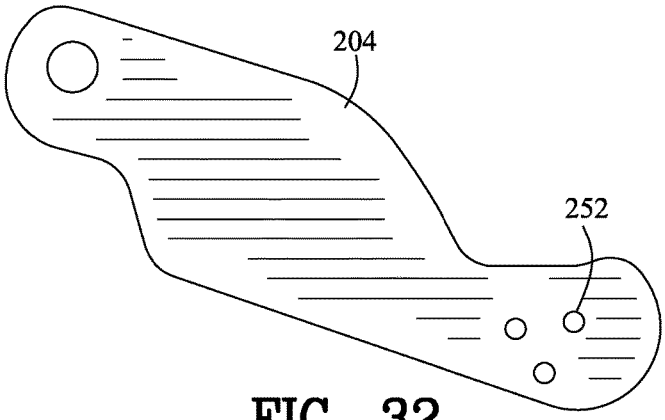
FIG. 32 is a side view of a side plate in FIG. 29
Figure 33:
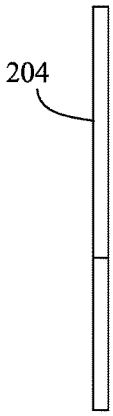
FIG. 33 is a right side of FIG. 32.
Figures 34, 35:
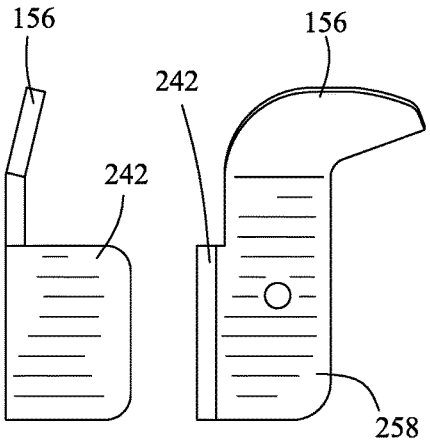
FIG. 34 is a top view of a first J-shaped locking tab having a first vertical side stabilizing plate.
FIG. 35 is a left side view of FIG. 34.
Figures 36, 37:
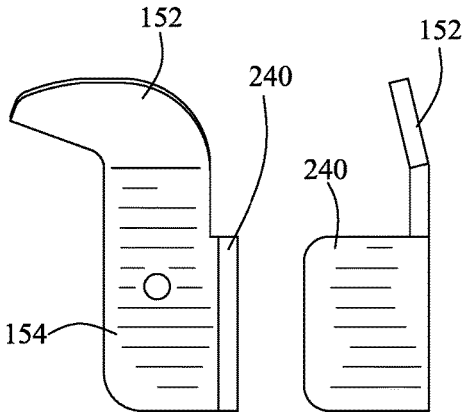
FIG. 36 is a top view of a second J-shaped locking tab having a second vertical side stabilizing plate.
FIG. 37 is a right side view of FIG. 36.
Figure 38:
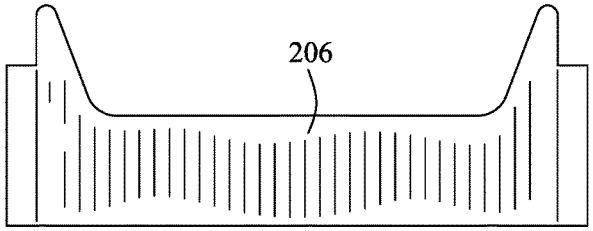
FIG. 38 is a top view of a coupling plate in FIG. 27.
Figure 39:
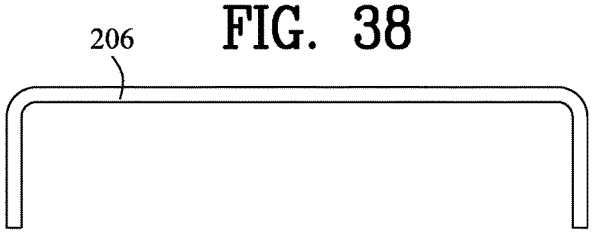
FIG. 39 is a front view of FIG. 38.
Figure 40:
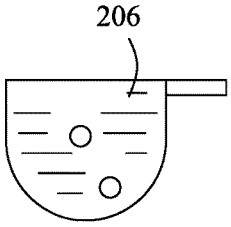
FIG. 40 is a right side view of FIG. 39.
Figure 41:
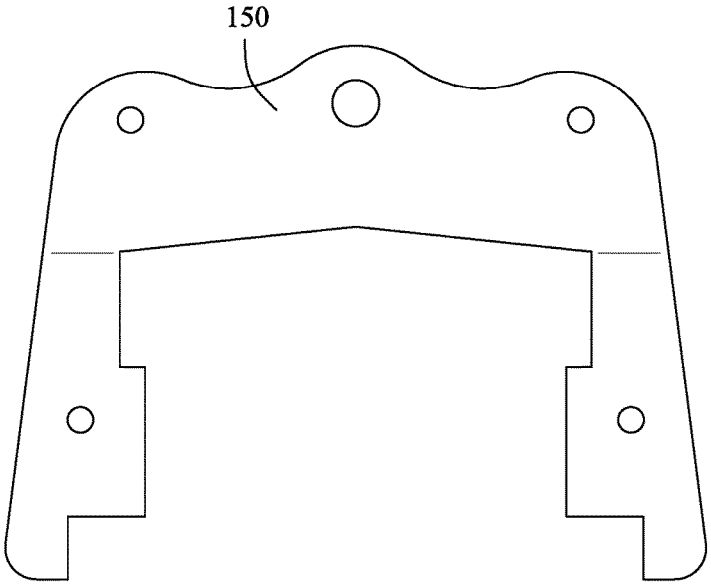
FIG. 41 is a top view of a of a general U-shaped mounting bracket of FIG. 27.
Figure 42:
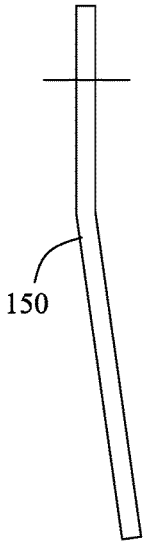
FIG. 42 is a right side view of FIG. 41.
Figure 44:
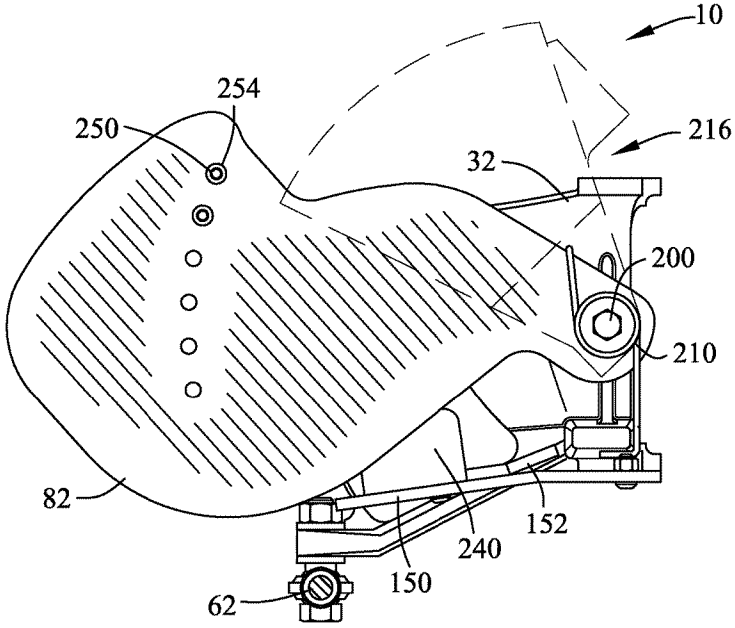
FIG. 44 is a view similar to FIG. 43 illustrating the rudder further pivoting relative to a hydrojet.

The first adjustable rudder elevation 126 and the second adjustable rudder elevation 136 serve to alter the maneuverability and the response of the hydrojet vessel 20. As shown in FIG. 3, the rudder device 10 provides a high maneuverability and high response for the hydrojet vessel 20 if the first adjustable rudder elevation 126 and the second adjustable rudder elevation 136 are positioned into the upper first plurality of apertures 120 and second plurality of apertures 130 respectively. Alternatively, the rudder device 10 provides a lower maneuverability and lower response for the hydrojet vessel 20 if the first adjustable rudder elevation 126 and the second adjustable rudder elevation 136 are positioned into the lower first plurality of apertures 120 and second plurality of apertures 130 respectively. The first mounting bracket 80 may define a first general L-shape bracket 84. The second mounting bracket 90 may defines a second general L-bracket 94.

FIGS. 11-26, 91 and 45-50 illustrate the rudder device 10 including a first general U-shaped mounting bracket 150 coupled to the first hydrojet 32 and partially encircling the first hydrojet 32. A first primary J-shaped locking tab 152 is coupled to the first general U-shaped mounting bracket 150. The first general U-shape mounting bracket 150 and the first primary J-shaped locking tab 152 compress the first hydrojet 32 there between for defining a first primary clamp 154.

A first secondary J-shaped locking tab 156 is coupled to the first general U-shaped mounting bracket 150. The first general U-shape mounting bracket 150 and the first secondary J-shaped locking tab 156 compress the first hydrojet 32 there between for defining a first secondary clamp 158.

A first steering assist rudder 160 is coupled to the first general U-shape mounting bracket 150. The first steering assist rudder 160 is positioned ahead of the first vertical pivot 30 for assisting in pivoting the first hydrojet 32 during forward displacement of the vessel 20 through a body of water 52.

A second general U-shaped mounting bracket 170 is coupled to the second hydrojet 42 and partially encircling the second hydrojet 42. A second primary J-shaped locking tab 172 is coupled to the second general U-shaped mounting bracket 170. The second general U-shape mounting bracket 170 and the second primary J-shaped locking tab 172 compress the second hydrojet 42 there between for defining a second primary clamp 174.

A second secondary J-shaped locking tab 176 is coupled to the second general U-shaped mounting bracket 170. The second general U-shape mounting bracket 170 and the second secondary J-shaped locking tab 176 compress the second hydrojet 42 there between for defining a second secondary clamp 178.

A second steering assist rudder 180 is coupled to the second general U-shape mounting bracket 170. The second steering assist rudder 180 is positioned ahead of the second vertical pivot 40 for assisting in pivoting the second hydrojet 42 during forward displacement of the vessel 20 through a body of water 52.

The first steering assist rudder 160 and the second steering assist rudder 180 creates a high (H) water pressure 14 and a low (L) water pressure 16 on the opposing side upon altering the first rudder 82 and the second rudder 92 from a aligned orientation relative to the hull 22. The greater the angular displacement of the first rudder 82 and the second rudder 92 from the aligned orientation, the greater the high (H) water pressure and the low (L) water pressure on the opposing side of the first steering assist rudder 160 and the second steering assist rudder 180 further assisting in the steerage of the vessel 20. Furthermore, the first steering assist rudder 160 and the second steering assist rudder 180 release pressure on the steering cable system of the vessel 20. The first steering assist rudder 160 and the second steering assist rudder 180 greatly reduces the force required for an individual to steer the vessel 20 either to the left or the right.

FIGS. 27-44 illustrate a rudder device 10 including the first rudder 82 pivotably coupled to the first hydrojet 32 by a first primary horizontal pivot 200. A first side plate 204 is pivotably coupled to the first hydrojet 32 by a first secondary horizontal pivot 202. A first coupling plate 206 is coupled between the first rudder 82 and the first side plate 204. A first coil spring 210 engages the first primary horizontal pivot 200 for promoting the first rudder 82 and the first side plate 204 being positioned in a non-pivoted position 212.

The second rudder 92 is pivotably coupled to the second hydrojet 42 by a second primary horizontal pivot 220. A second side plate 224 is pivotably coupled to the second hydrojet 42 by a second secondary horizontal pivot 222. A second coupling plate 226 is coupled between the second rudder 92 and the second side plate 224. A second coil spring 230 engages the second primary horizontal pivot 220 for promoting the second rudder 92 and the second side plate 224 being positioned in a non-pivoted position 232.

A first primary vertical side stabilizing plate 240 is coupled to the first primary J-shaped locking tab 152 for preventing lateral displacement of the first rudder 82. A first secondary vertical side stabilizing plate 242 is coupled to the first secondary J-shaped locking tab 156 for preventing lateral displacement of the first side plate 204.

A second primary vertical side stabilizing plate 244 is coupled to the second primary J-shaped locking tab 172 for preventing lateral displacement of the second rudder 92. A second secondary vertical side stabilizing plate 246 is coupled to the second secondary J-shaped locking tab 176 for preventing lateral displacement of the second side plate 224.

A first primary plurality of apertures 250 are in the first rudder 82. A first secondary plurality of apertures 252 are in the first side plate 204. A first primary removable fastener 254 engages the first coupling plate 206 and one of the first primary plurality of apertures 250 in the first rudder 82. A first secondary removable fastener 256 engages the first coupling plate 206 and one of the first secondary plurality of apertures 252 in the first side plate 204.

The first primary removable fastener 254, the first secondary removable fastener 256, the first coupling plate 206 and the first plurality of apertures 250 define a first adjustable rudder elevation 260 for pivoting the first rudder 82 on the first horizontal pivot and altering the elevation of the first rudder. The first primary removable fastener 254, the first secondary removable fastener 256, the first coupling plate 206 and the first plurality of apertures 250 define an adjustable angle 262 of the first coupling plate 206 relative to the first hydrojet 32.

The adjustable angle 262 defining a non-angle 264 of the first coupling plate 206 relative to the first hydrojet 32 provides a non-upward force 266 during forward displacement of the vessel 20 through a body of water 52 and maintaining the first rudder 82 in a non-elevated position 268. The adjustable angled 262 defining an angle 270 of the first coupling plate 206 relative to the first hydrojet 32 provides an upward force 272 during forward displacement of the vessel 20 through a body of water 52 and pivoting the first rudder 82 in an elevated position 274.

A second primary plurality of apertures 290 are in the second rudder 92. A second secondary plurality of apertures 292 are in the second side plate 224. A second primary removable fastener 294 engage the second coupling plate 226 and one of the second primary plurality of apertures 290 in the second rudder 92. A second secondary removable fastener 296 engage the second coupling plate 226 and one of the second secondary plurality of apertures 292 in the second side plate 224.

The second primary removable fastener 294, the second secondary removable fastener 296, the second coupling plate 226 and the second plurality of apertures 290 define a second adjustable rudder elevation 300 for pivoting the second rudder 92 on the second horizontal pivot 220 and altering the elevation of the second rudder 92. The second removable fastener 294, the second secondary removable fastener 296, the second coupling plate 226 and the second plurality of apertures 292 define an adjustable angled 302 of the second coupling plate 226 relative to the second hydrojet 42. The adjustable angle 302 defining a non-angle 304 of the second coupling plate 226 relative to the second hydrojet 42 provides a non-upward force 306 during forward displacement of the vessel 20 through a body of water 52 and maintaining the second rudder 92 in a non-elevated position 308. The adjustable angled 302 defining an angle 310 of the second coupling plate 226 relative to the second hydrojet 42 provides an upward force 312 during forward displacement of the vessel 20 through a body of water 52 and pivoting the second rudder 92 in an elevated position 314.

Figure 43:
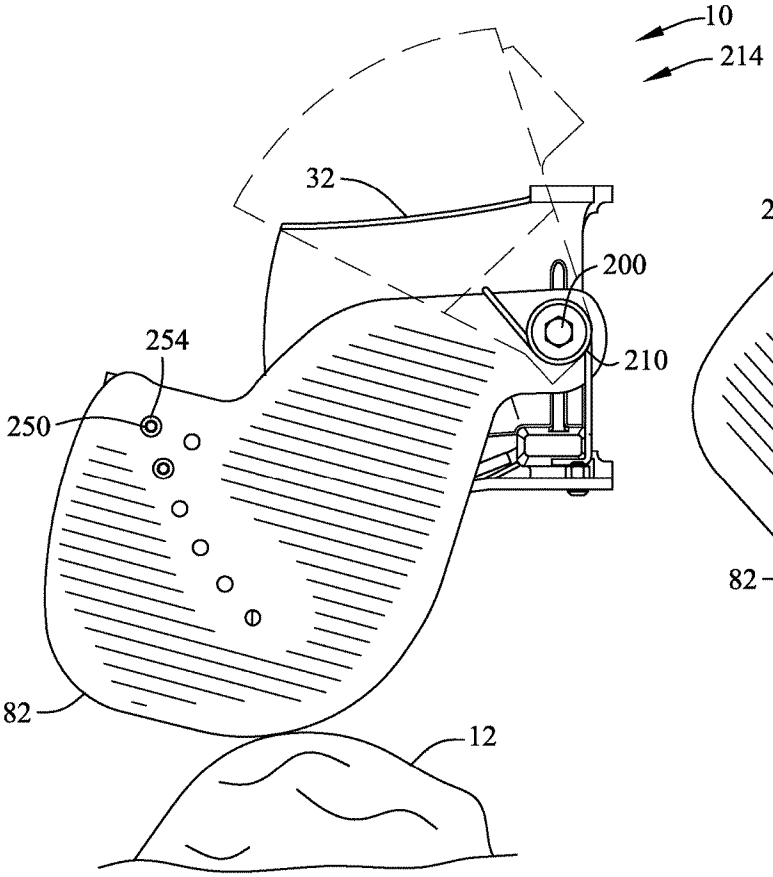
FIG. 43 is a view similar to FIG. 30 wherein the rudder to stuck an object within the water and causing the rudder to pivot in an elevated position.
Figure 45:
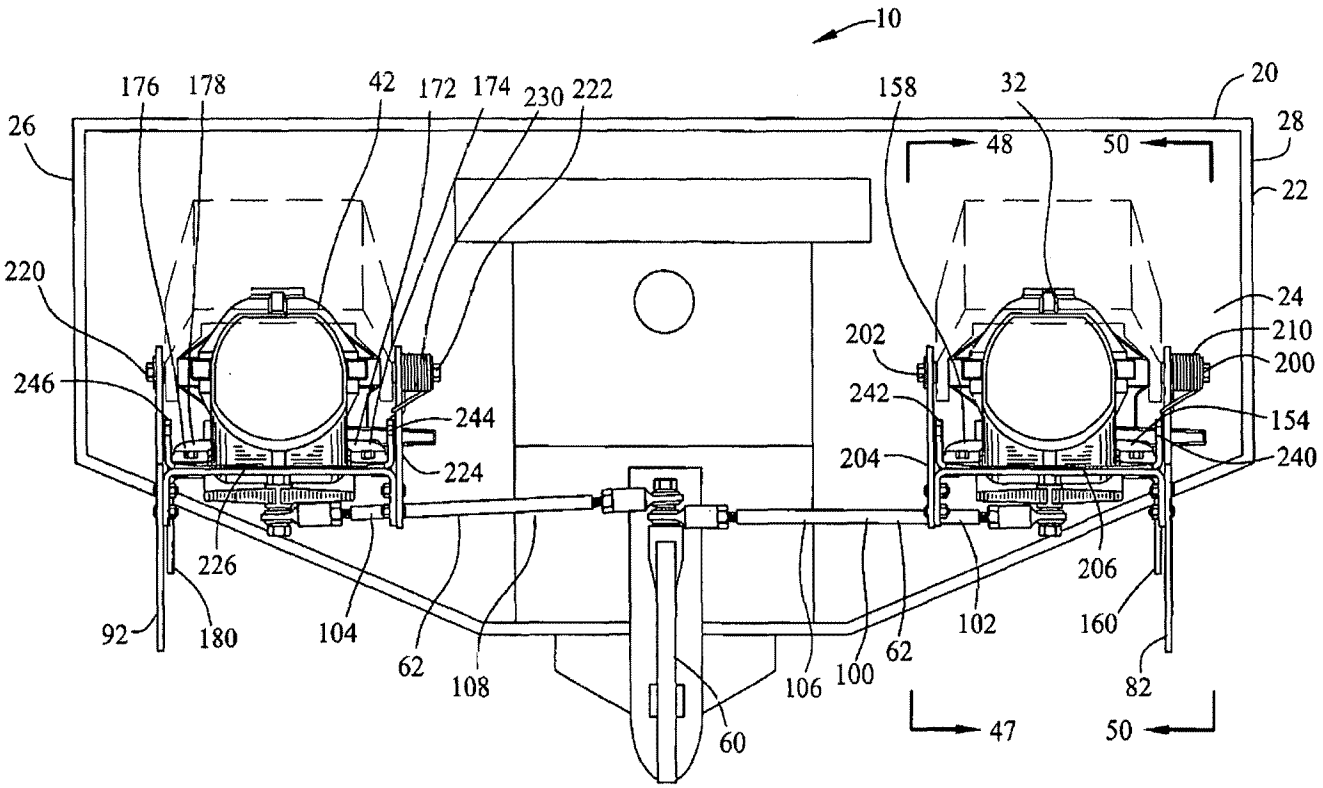
FIG. 45 is a rear view of a hydrojet vessel incorporation a fourth embodiment of the present invention.
Figure 46:
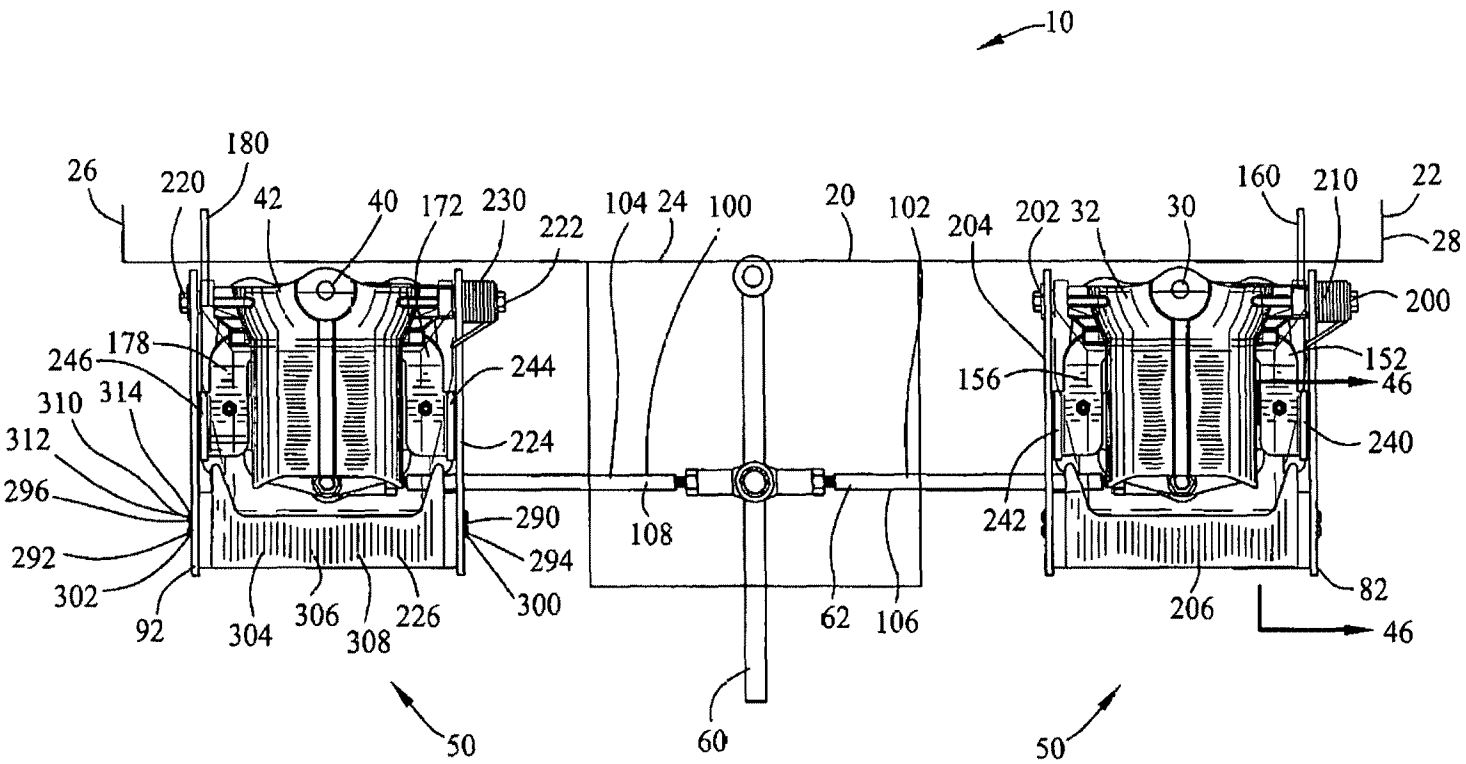
FIG. 46 is a top view of FIG. 45.
Figure 47:
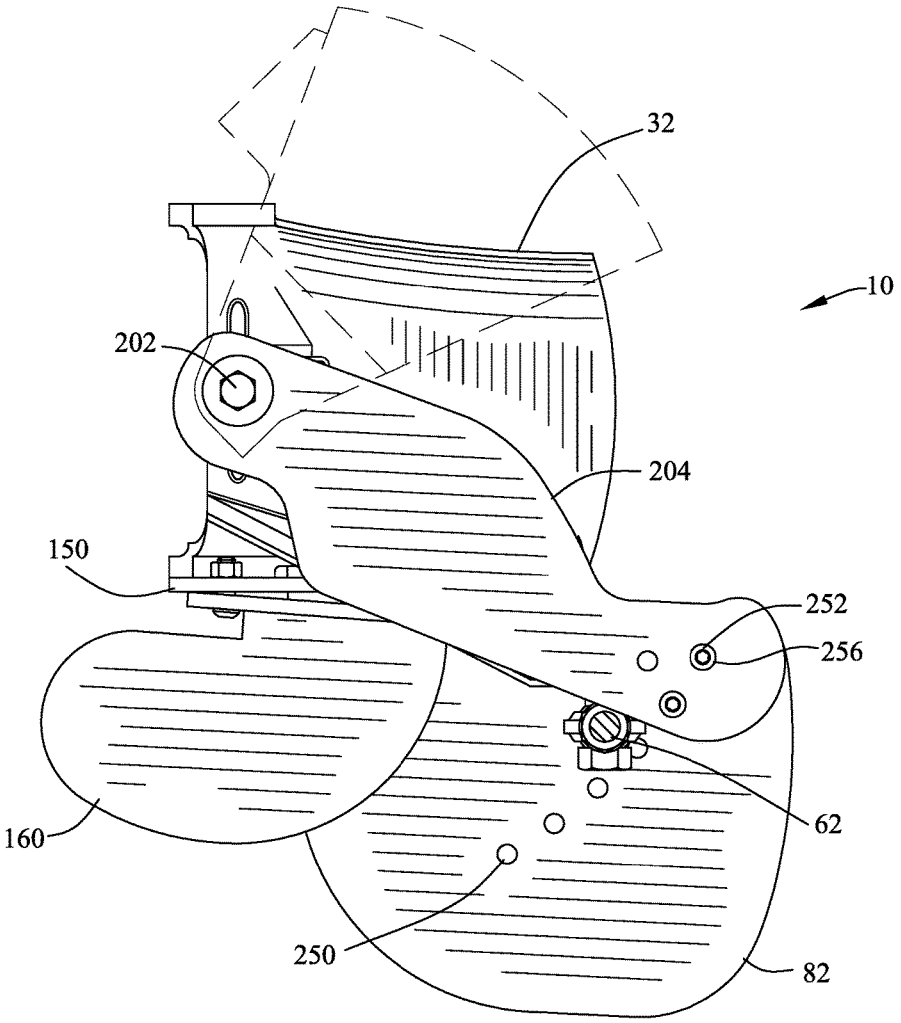
FIG. 47 is a view along line 47-47 of FIG. 45.
Figure 48:
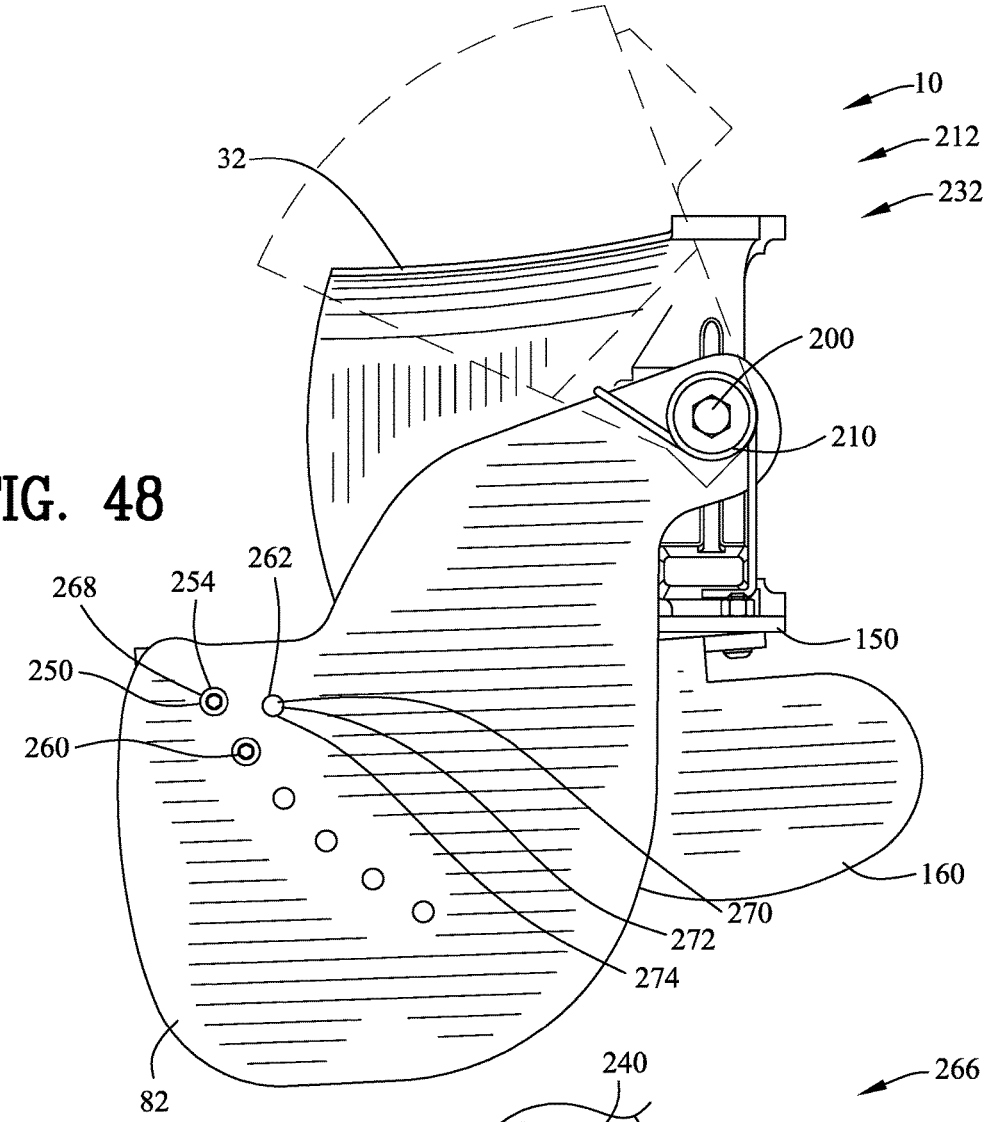
FIG. 48 is a view along line 48-48 of FIG. 45.
Figure 49:
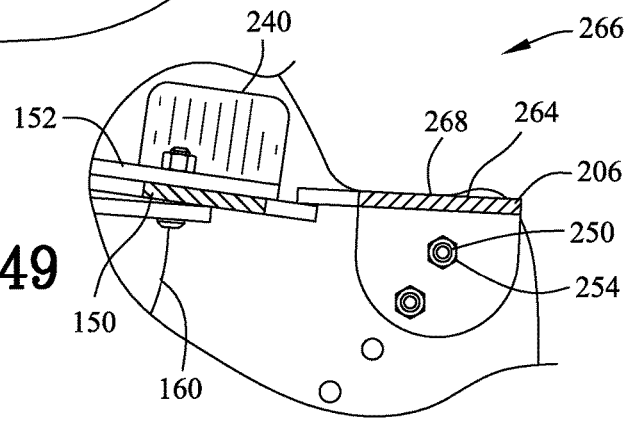
FIG. 49 is a section view along line 49-49 in FIG. 46.
Figure 50:
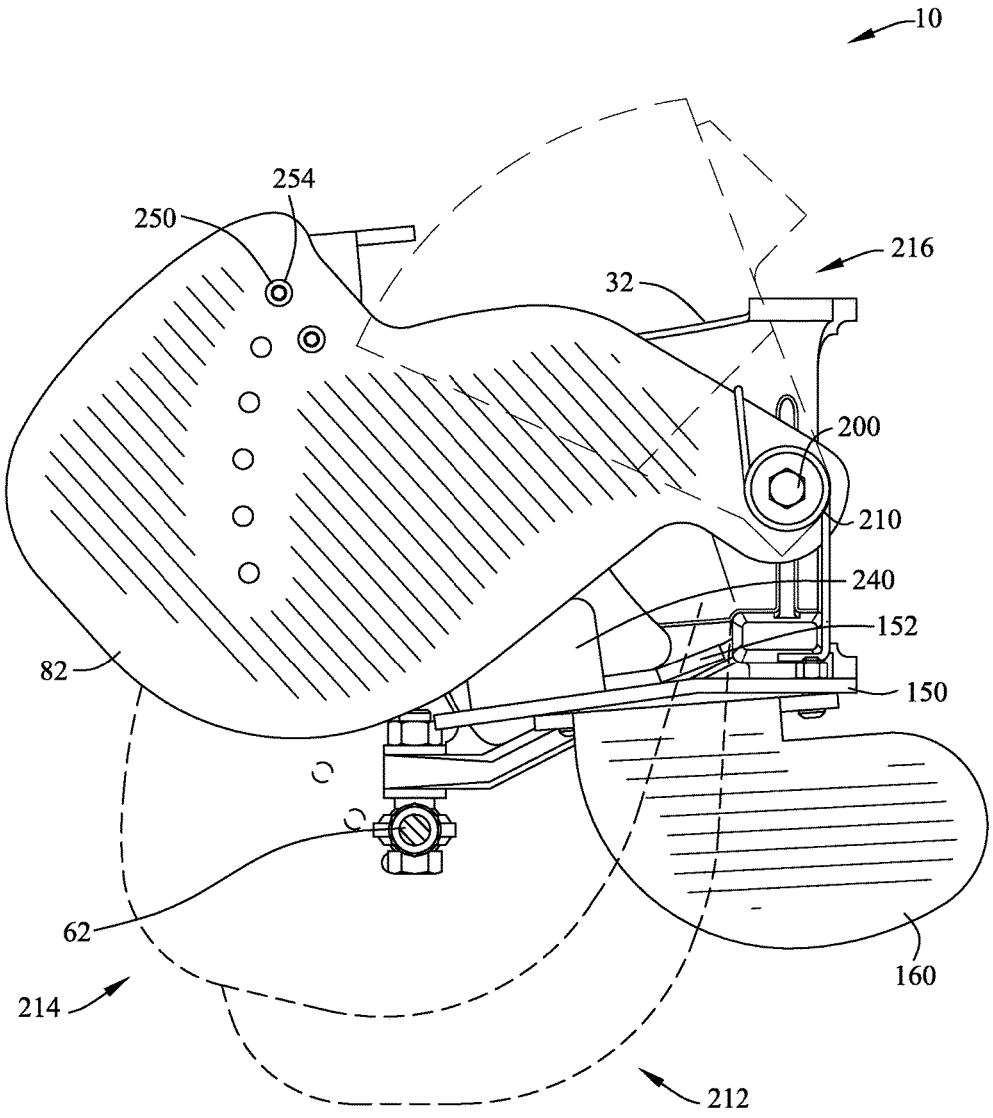
FIG. 50 is a view similar to FIG. 48 illustrating the rudder pivoting relative to a hydrojet.
Figure 51:
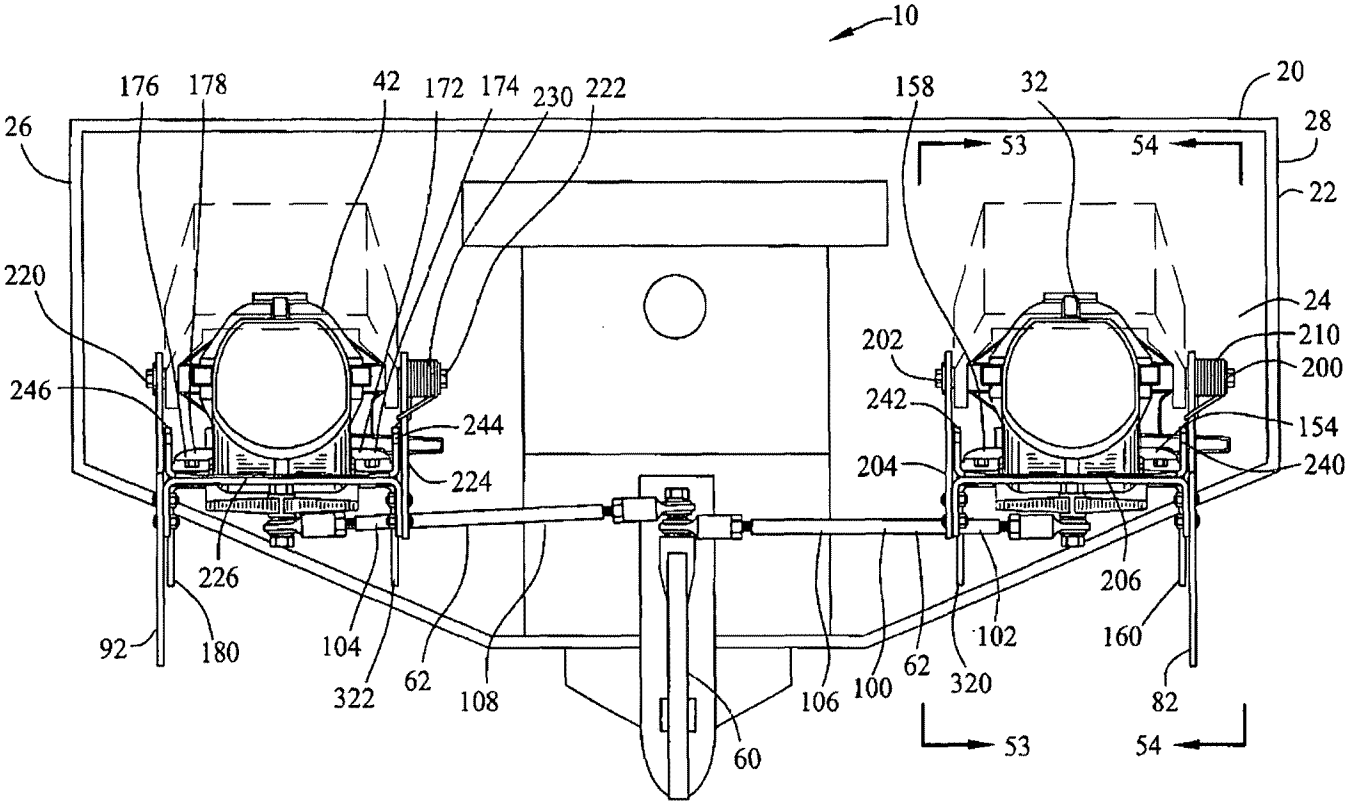
FIG. 51 is a rear view of a hydrojet vessel incorporation a fifth embodiment of the present invention.
Figure 52:
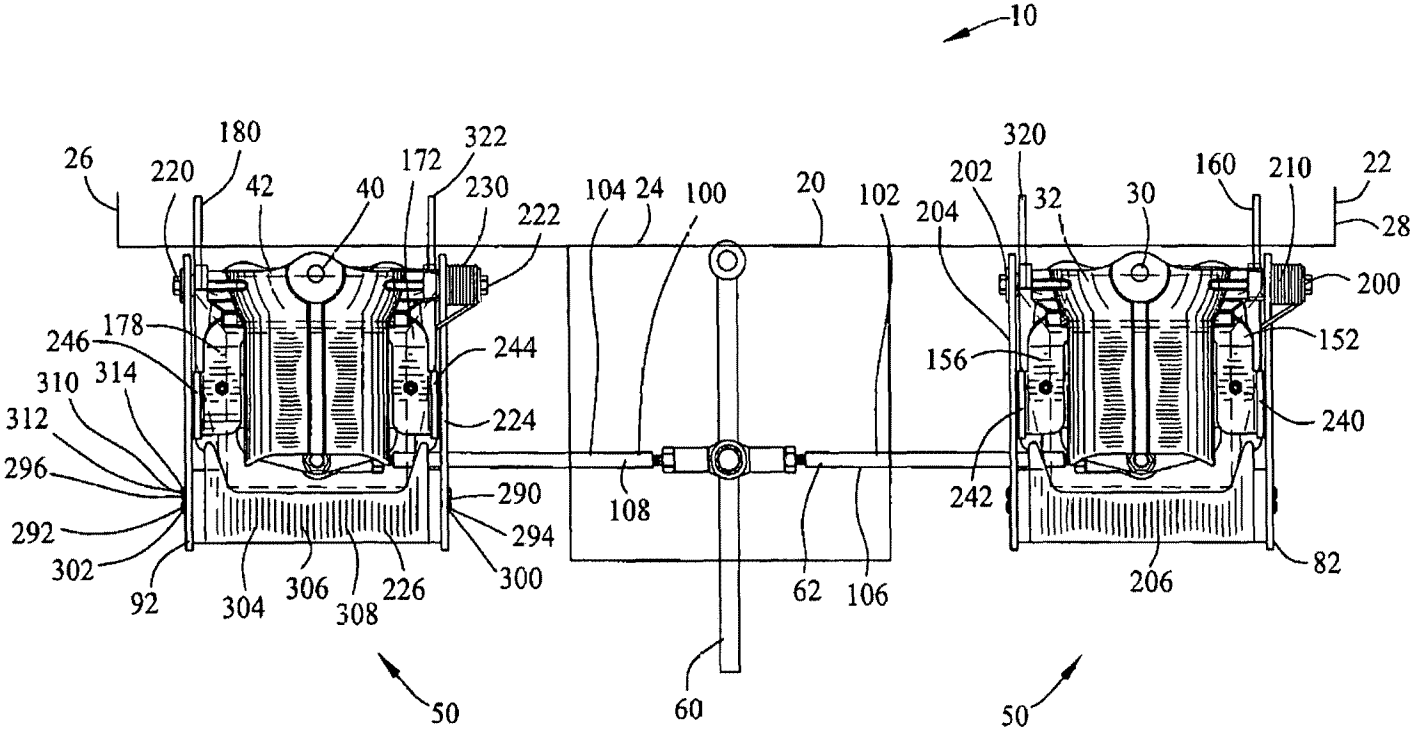
FIG. 52 is a top view of FIG. 51.
Figure 53:
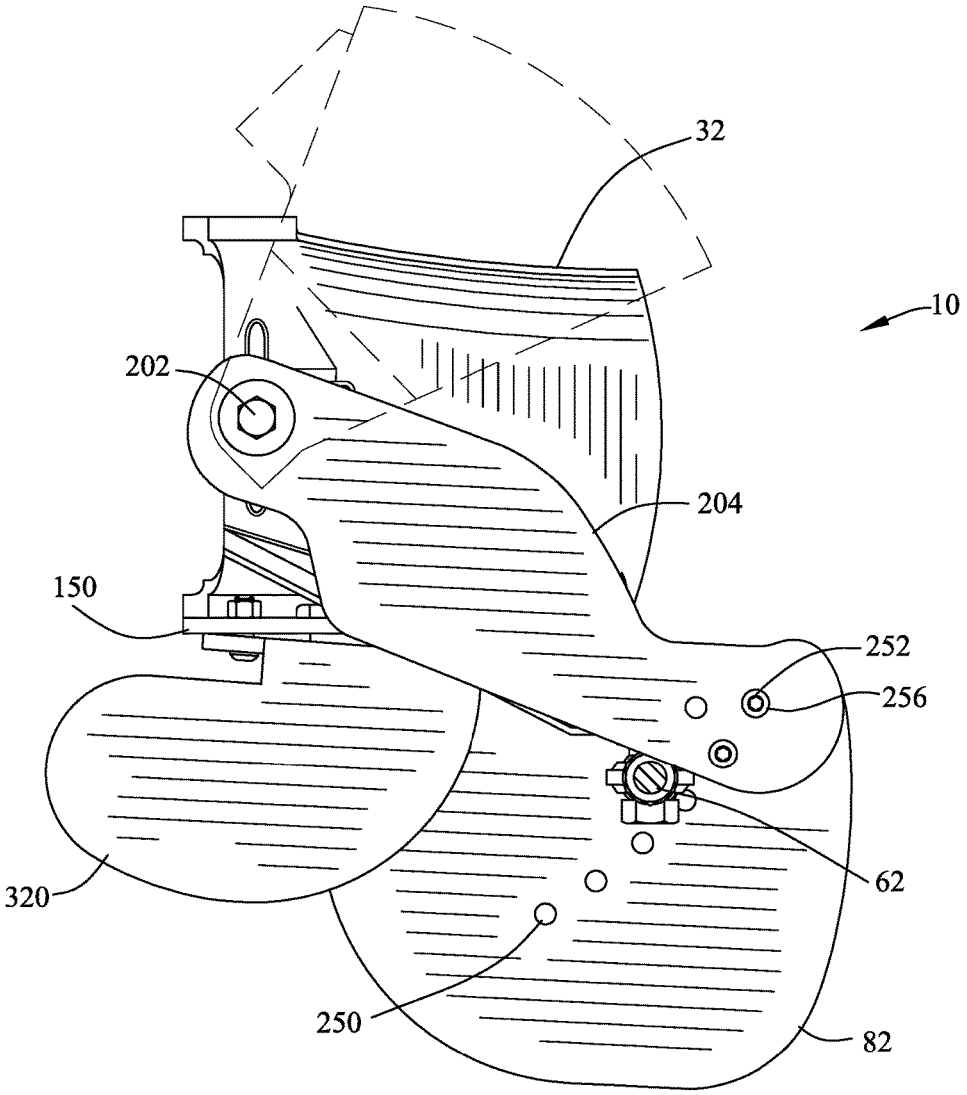
FIG. 53 is a view along line 53-53 of FIG. 51.
Figure 54:
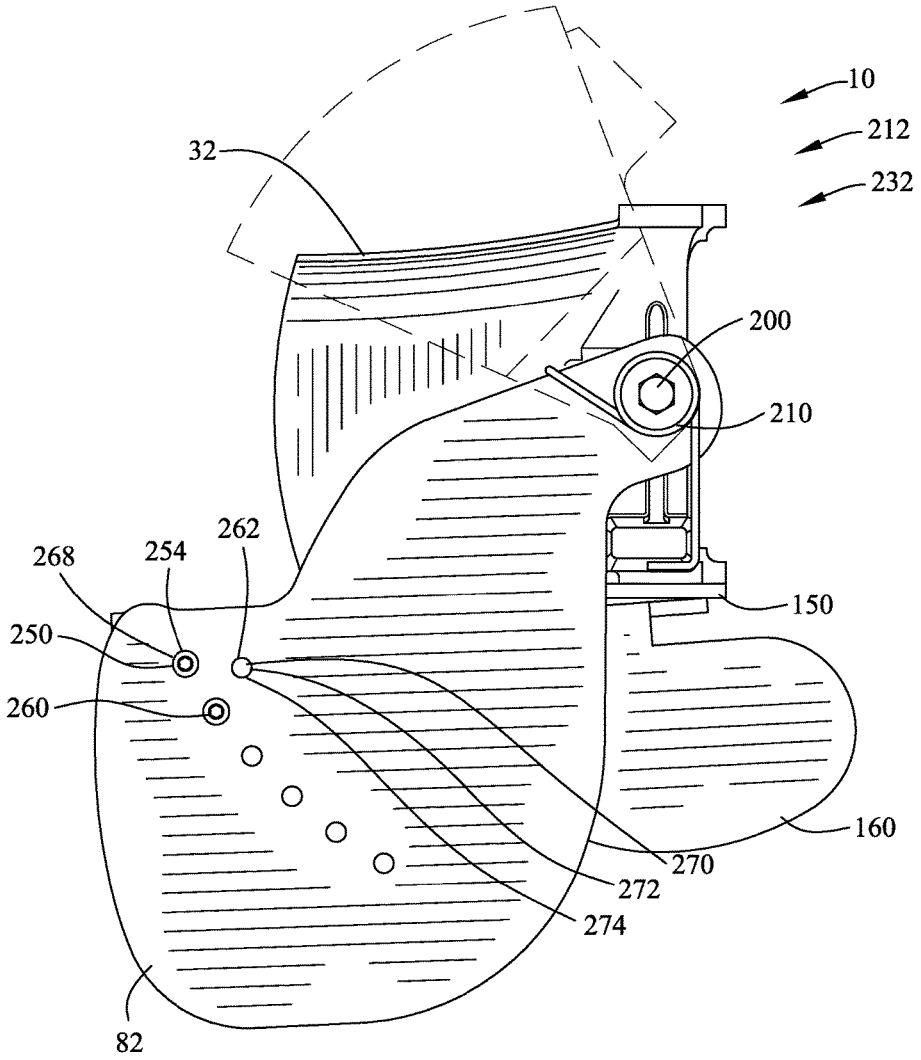
FIG. 54 is a view along line 54-54 of FIG. 51.
Figure 55:
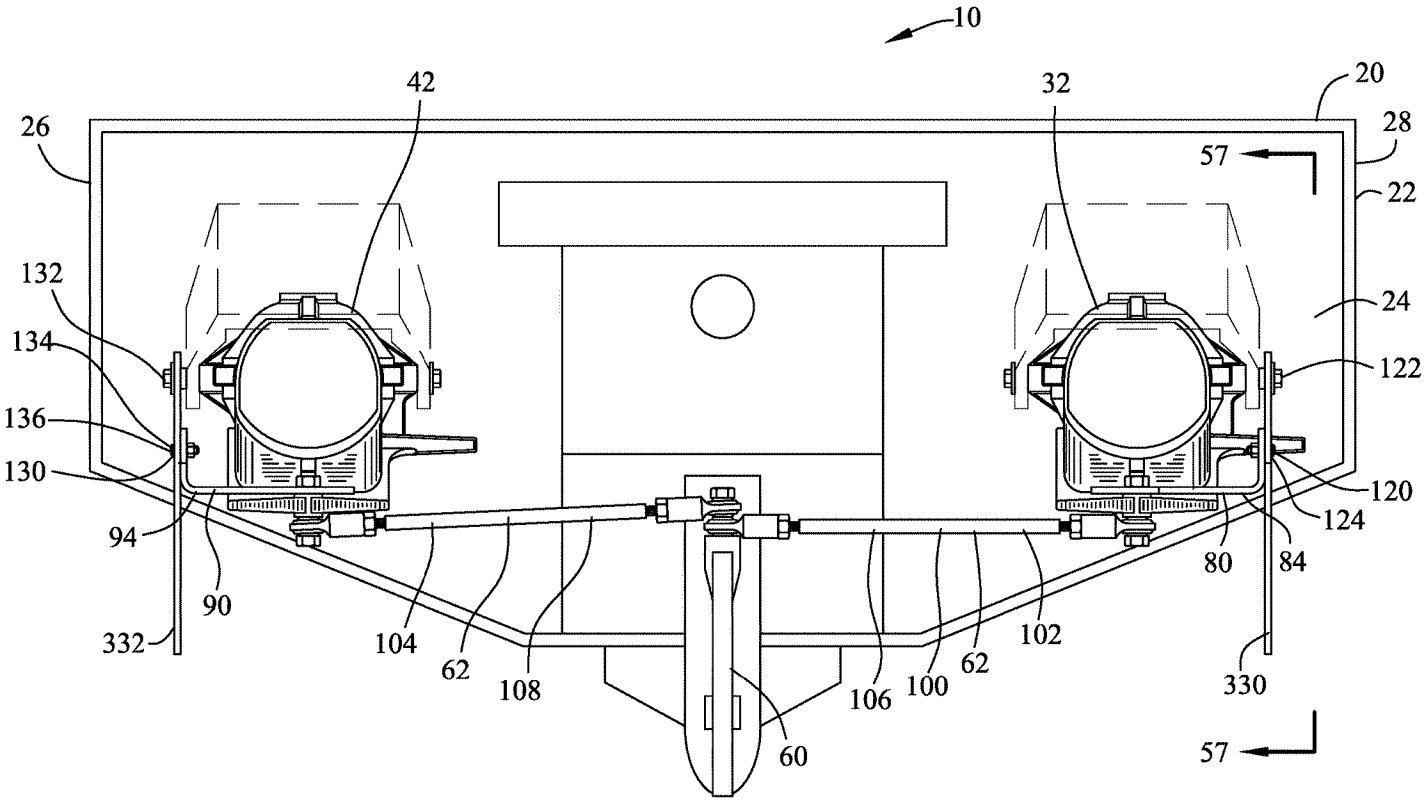
FIG. 55 is a rear view of a hydrojet vessel incorporation a sixth embodiment of the present invention.
Figure 56:
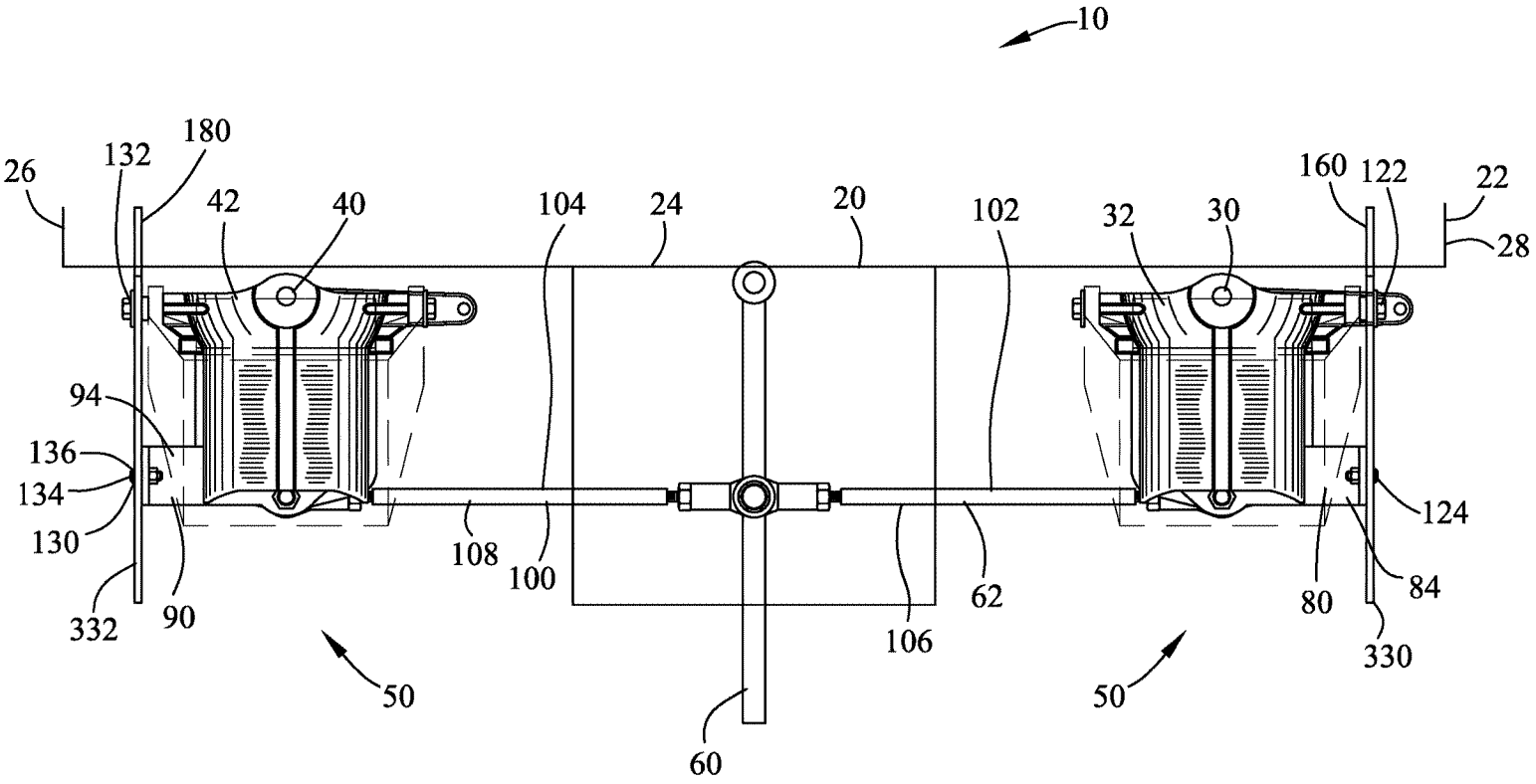
FIG. 56 is a top view of FIG. 55.
Figure 57:
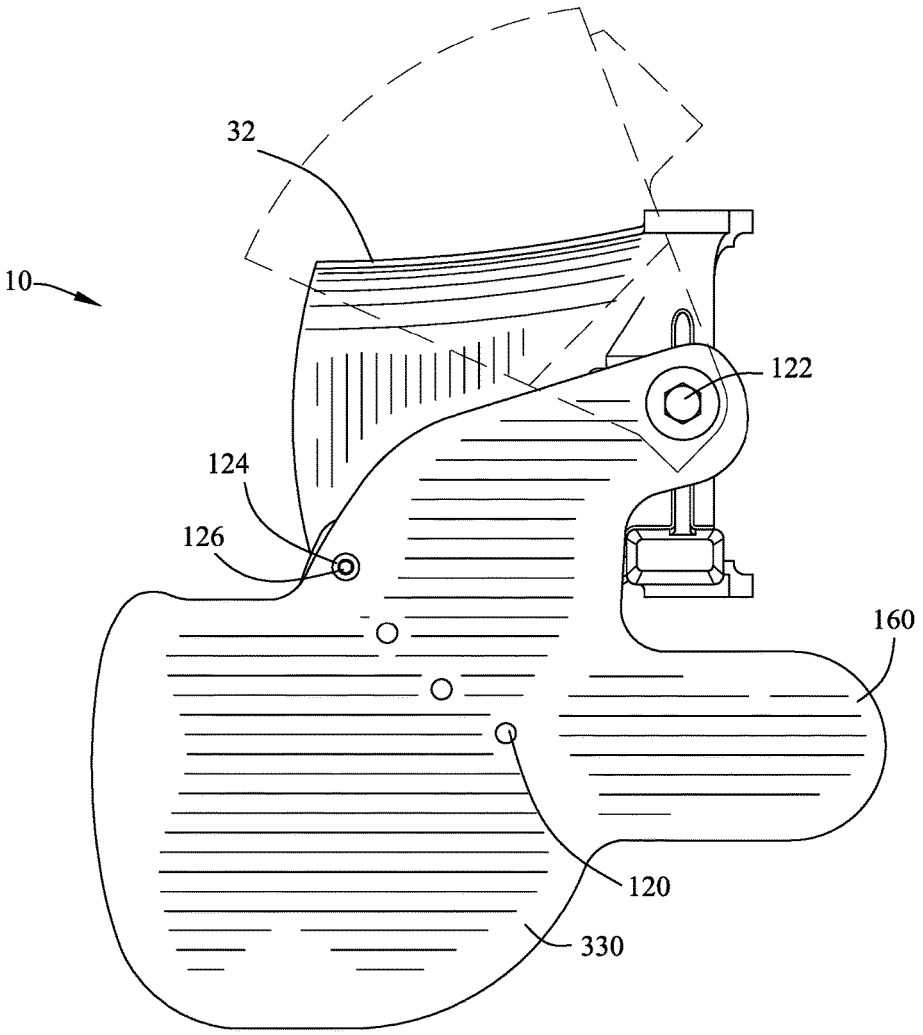
FIG. 57 is a view along line 57-57 of FIG. 55.
Figure 58:
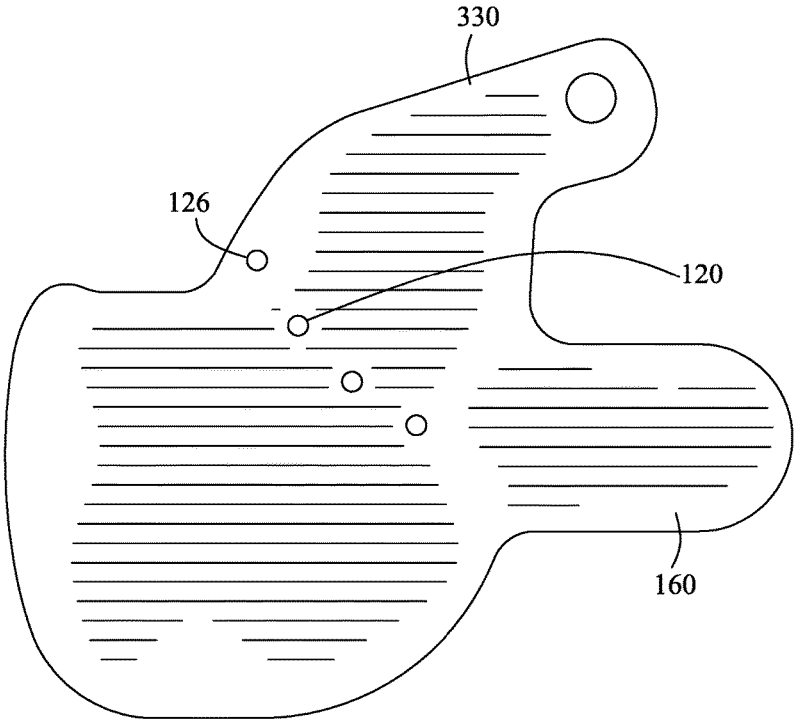
FIG. 58 is a side view of a rudder and a steering assist rudder defining an integral one piece unit of FIG. 57.
Figure 59:
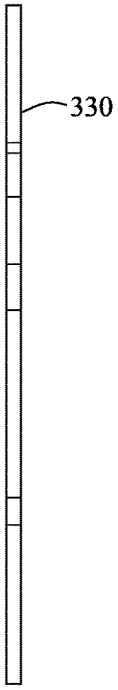
FIG. 59 is a right side view of FIG. 58.
Figure 60:
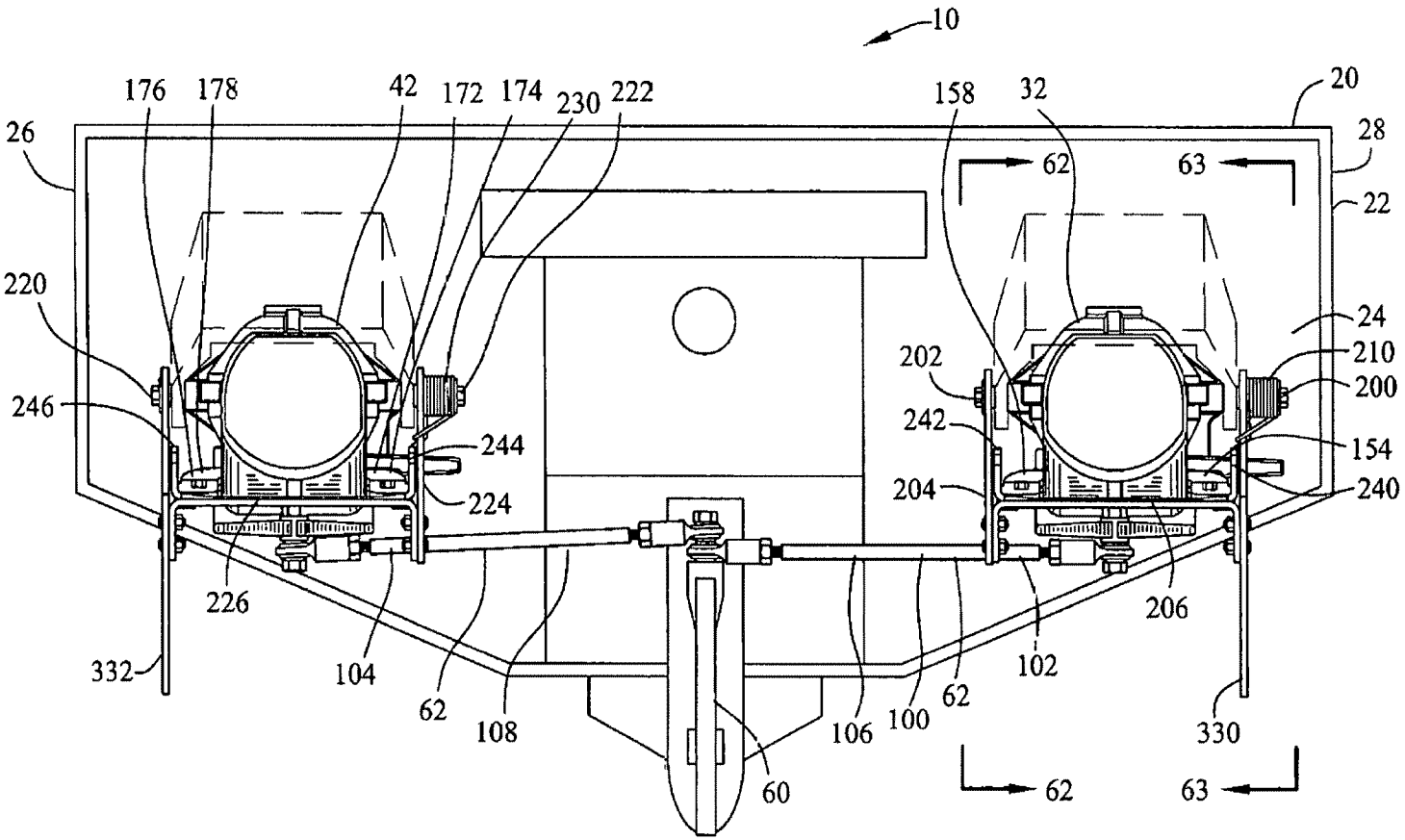
FIG. 60 is a rear view of a hydrojet vessel incorporation a seventh embodiment of the present invention.
Figure 61:
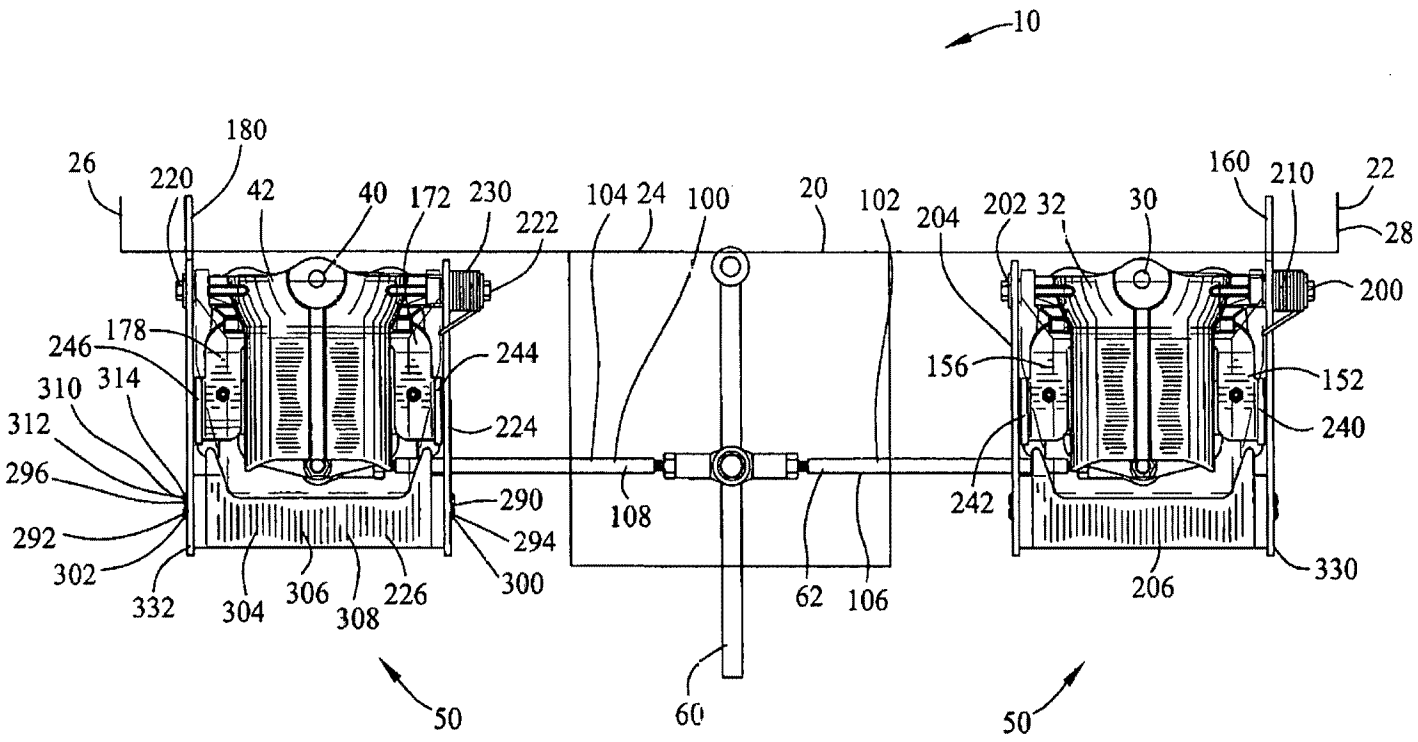
FIG. 61 is a top view of FIG. 60.
Figure 62:
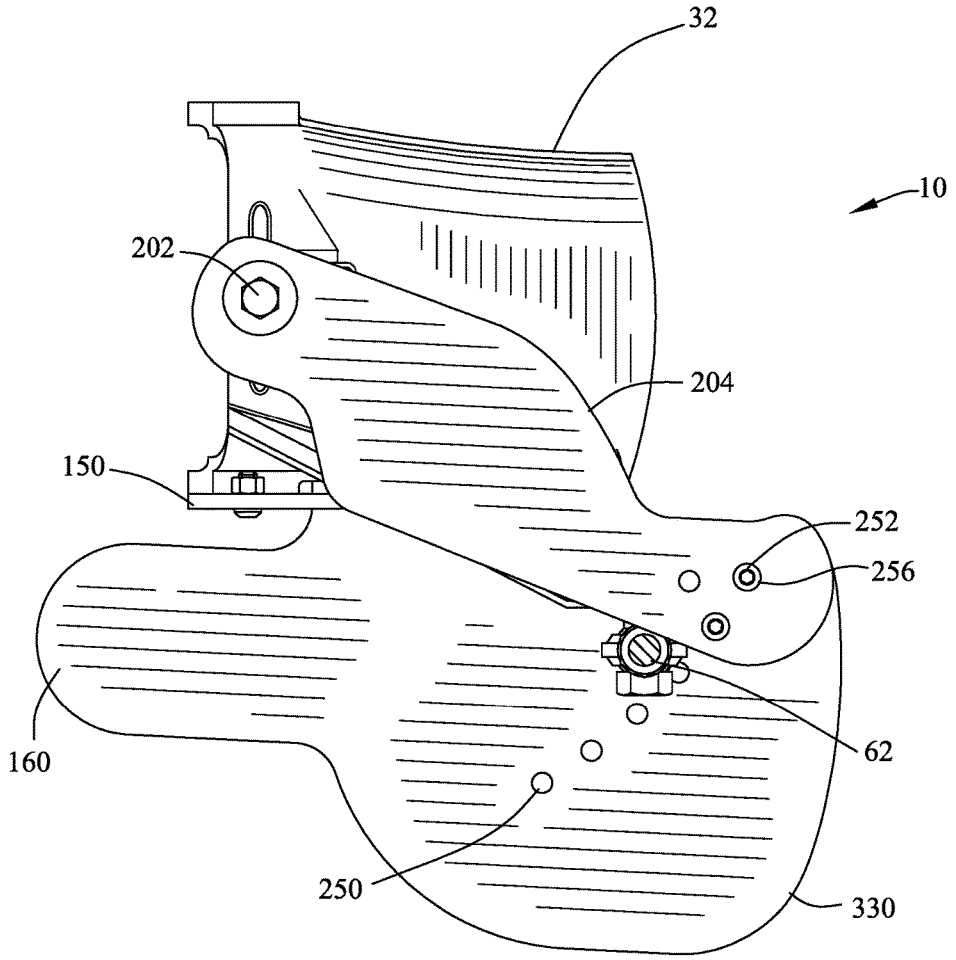
FIG. 62 is a view along line 62-62 of FIG. 60.
Figure 63:
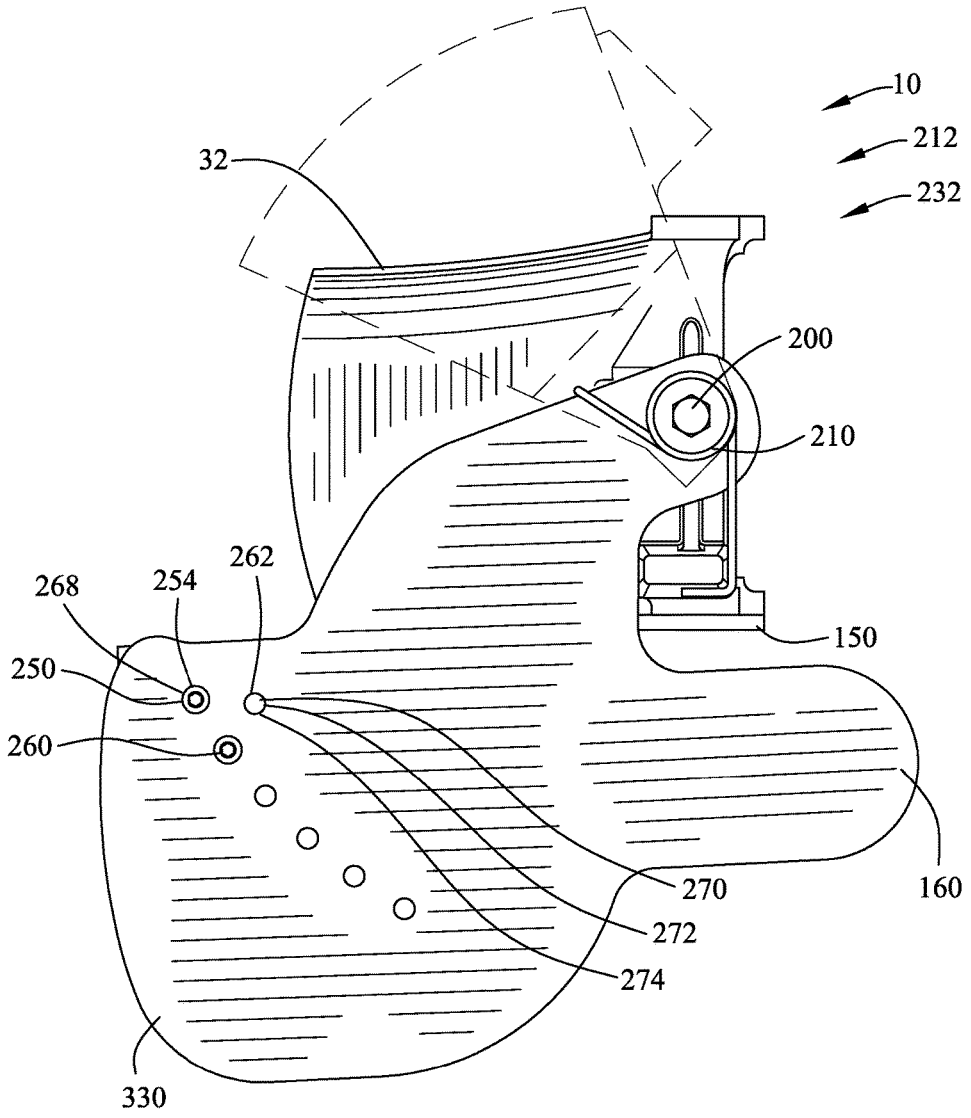
FIG. 63 is a view along line 63-63 of FIG. 60.
Figure 64:
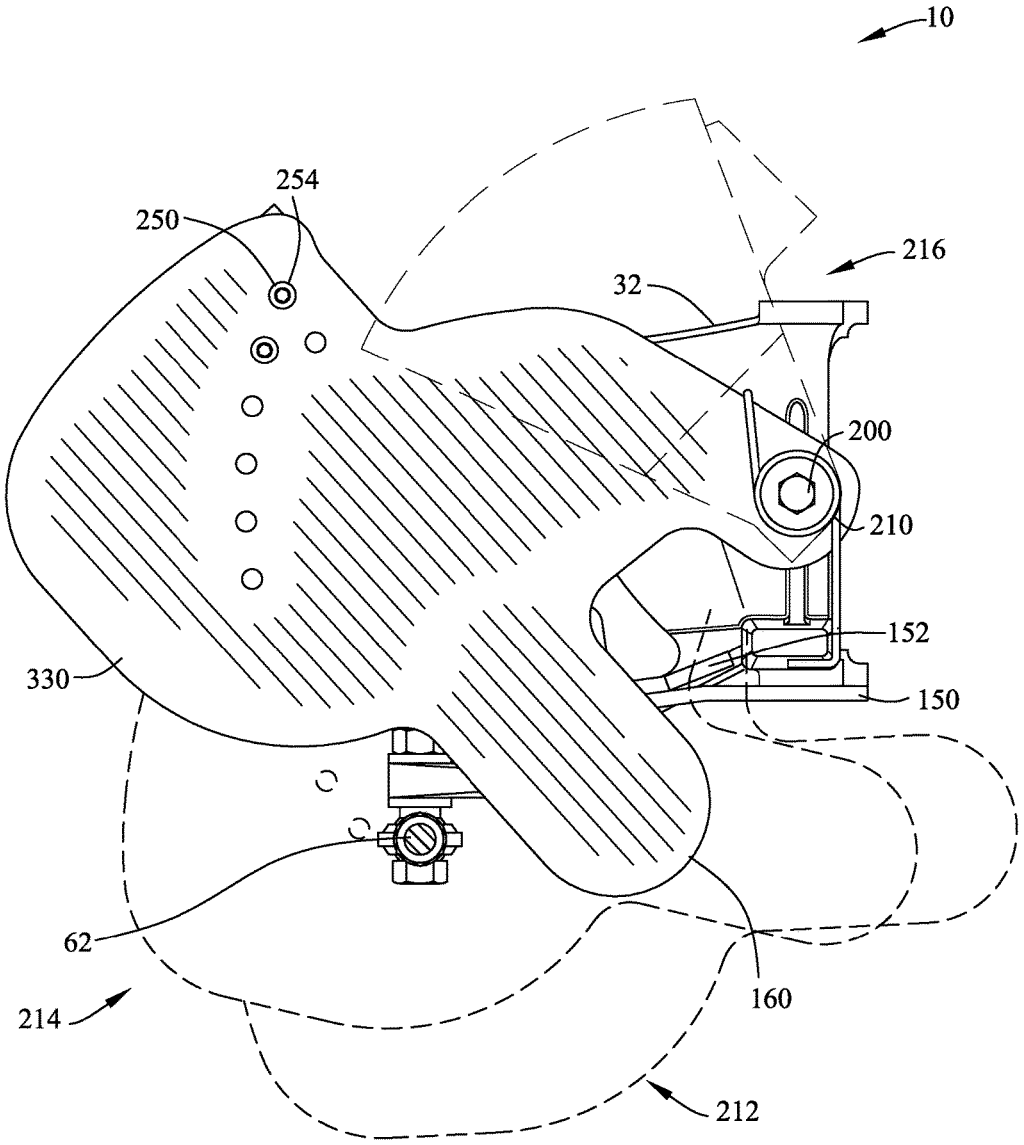
FIG. 64 is a view similar to FIG. 63 illustrating pivoting of a rudder and a steering assist rudder defining an integral one piece.
Figure 65:
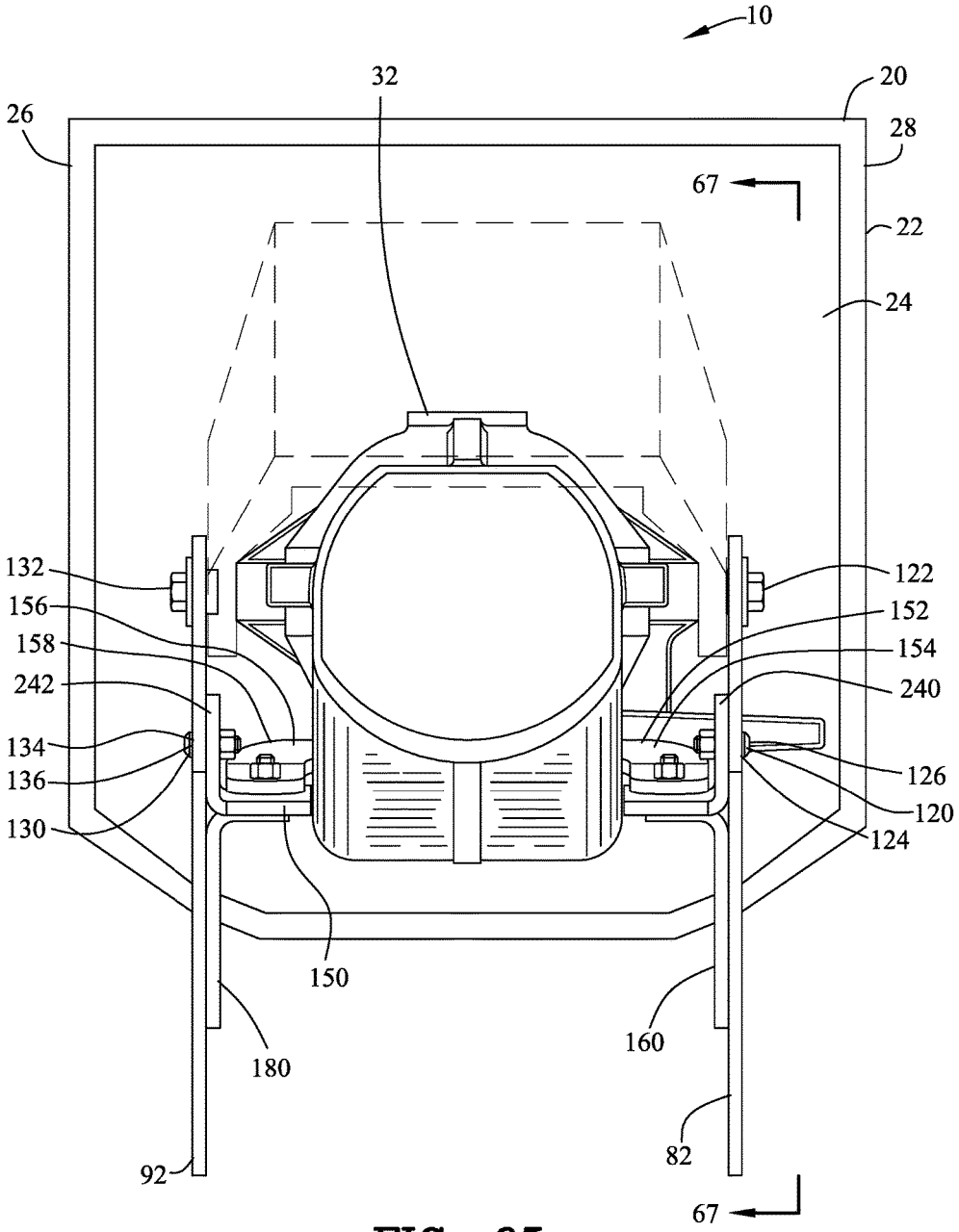
FIG. 65 is a rear view of a hydrojet vessel incorporation an eighth embodiment of the present invention.
Figure 66:
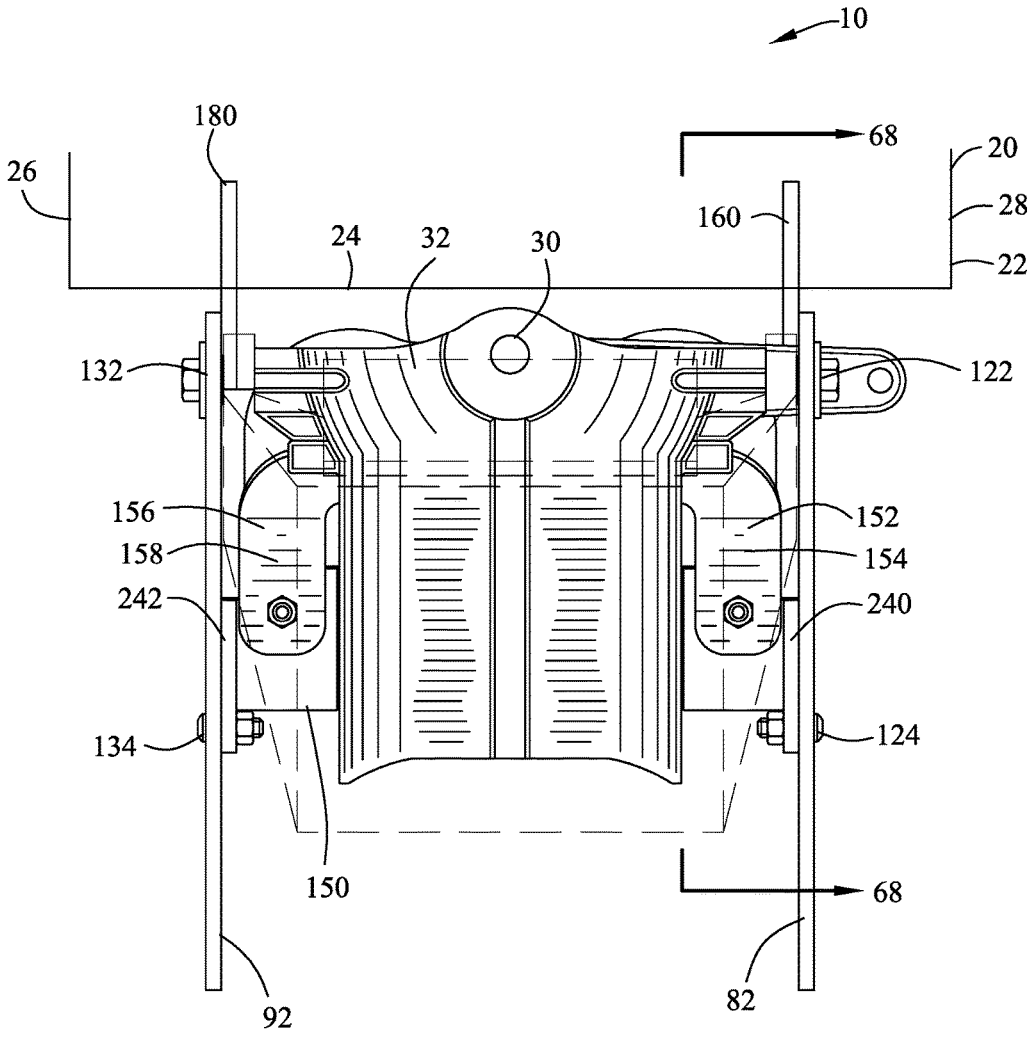
FIG. 66 is a top view of FIG. 65.
Figure 67:
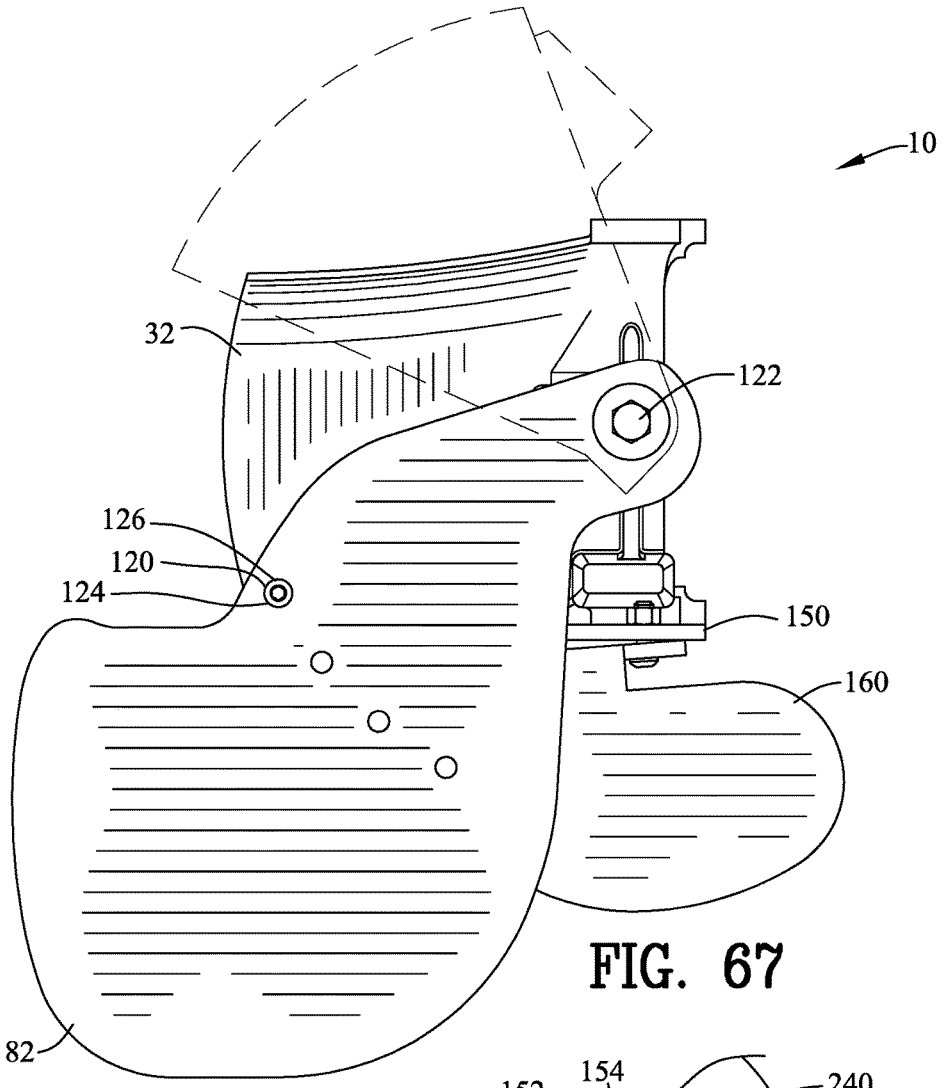
FIG. 67 is a view along line 67-67 of FIG. 65.
Figure 68:
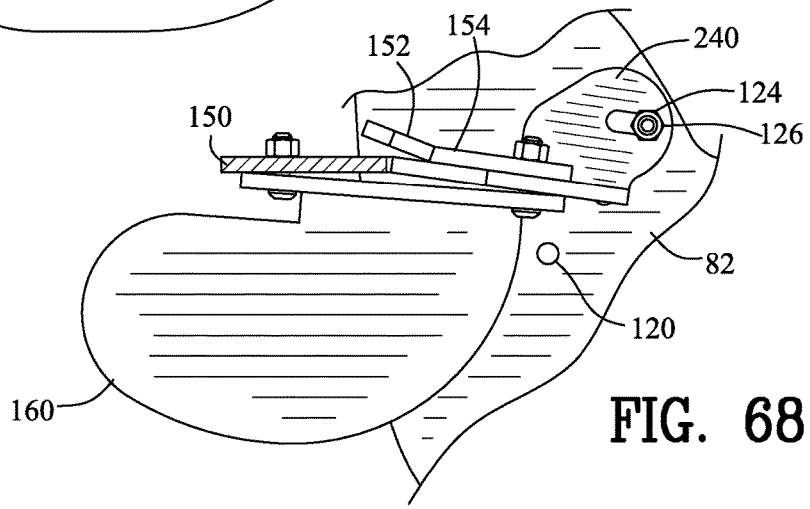
FIG. 68 is a sectional view along line 68-68 in FIG. 66.
Figure 69:
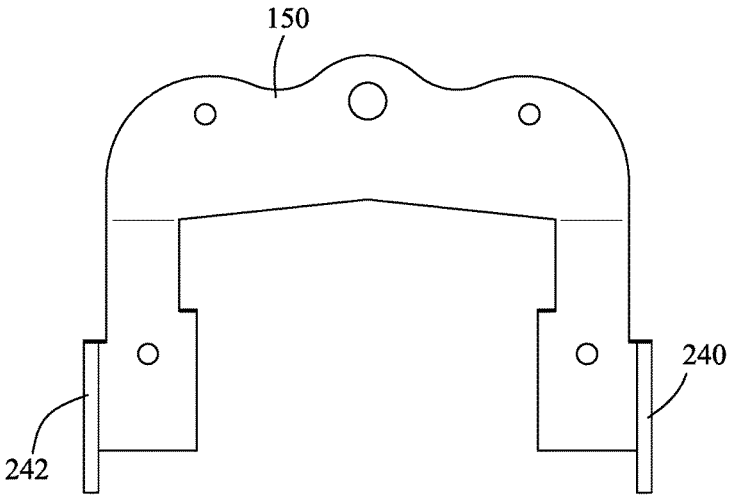
FIG. 69 is a top view of a general U-shaped mounting bracket having a vertical side stabilizing plate defining an integral one piece unit of FIG. 65.
Figure 70:
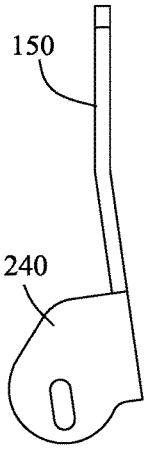
FIG. 70 is a right side view of FIG. 69.
Figure 71:
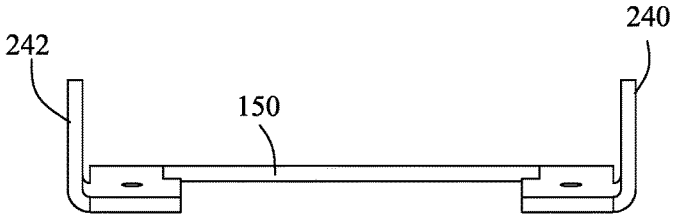
FIG. 71 is a front view of FIG. 69.
Figure 72:
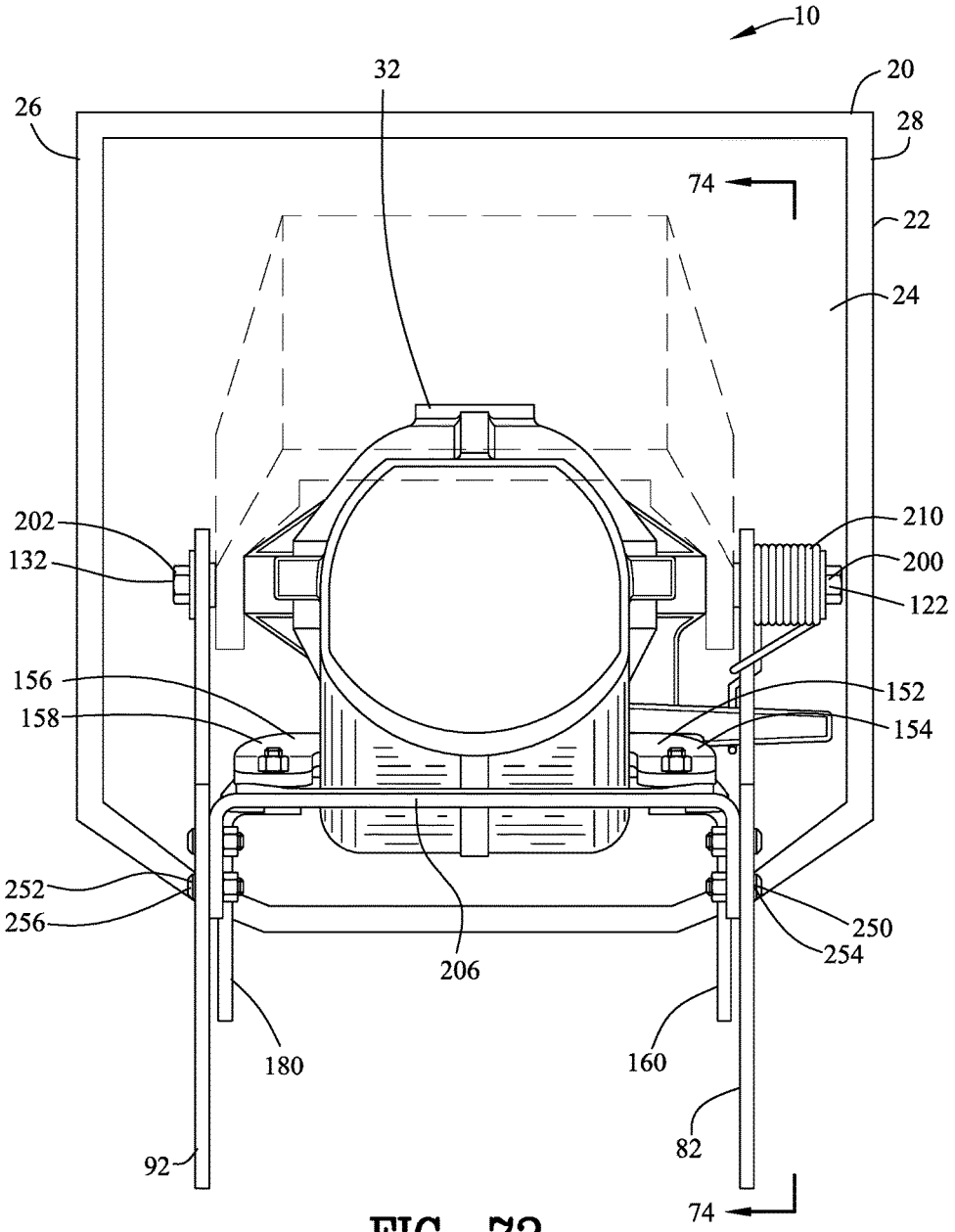
FIG. 72 is a rear view of a hydrojet vessel incorporation an ninth embodiment of the present invention.
Figure 73:
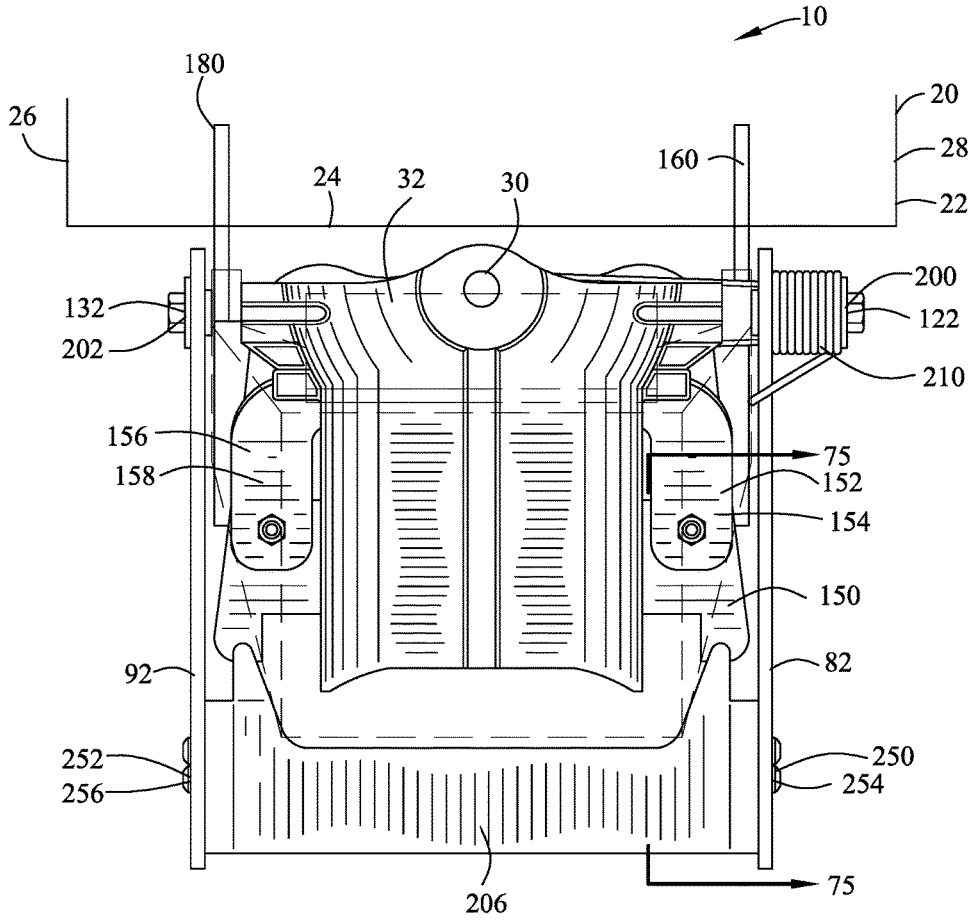
FIG. 73 is a top view of FIG. 72.
Figure 74:
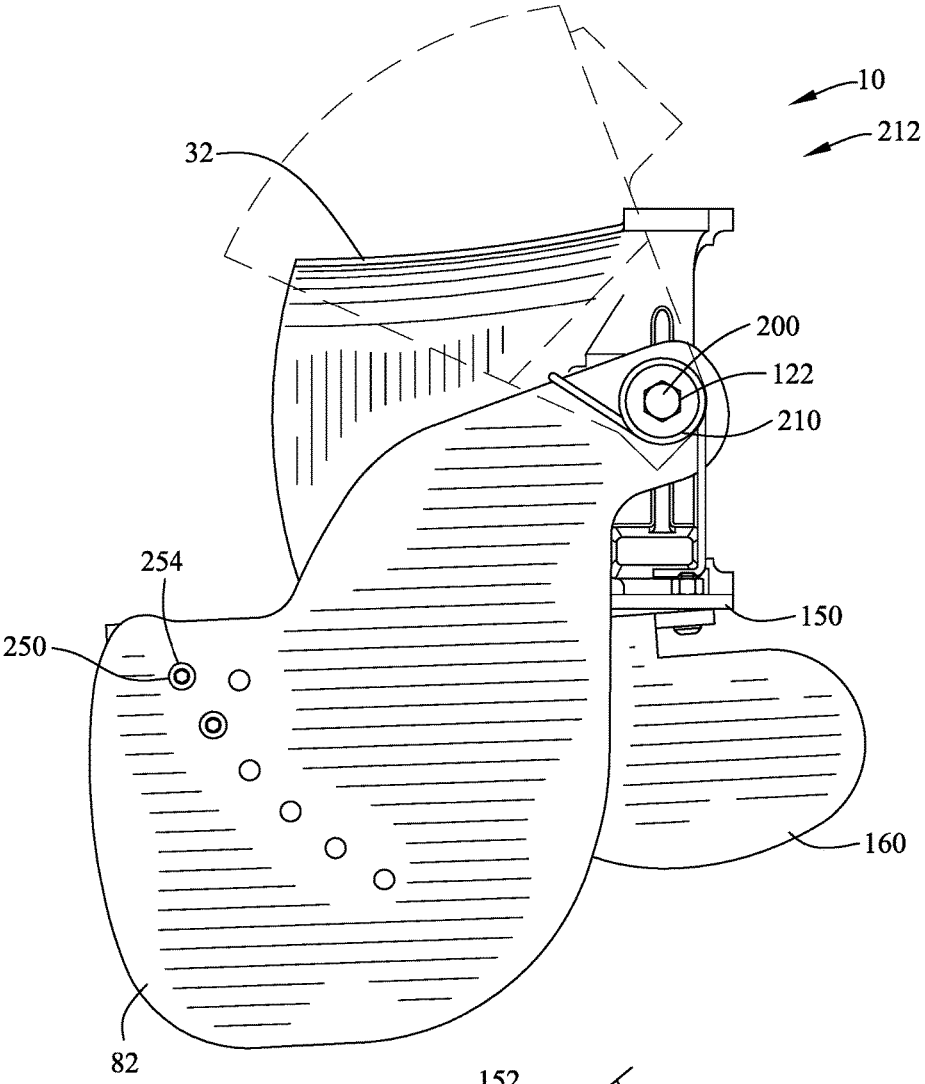
FIG. 74 is a view along line 74-74 of FIG. 72.
Figure 75:
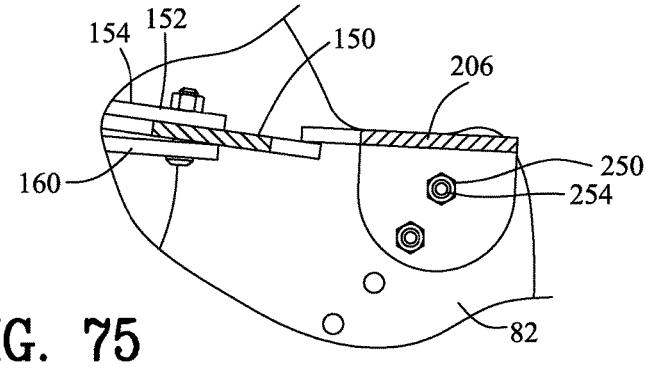
FIG. 75 is a sectional view along line 75-75 in FIG. 73.
Figure 76:
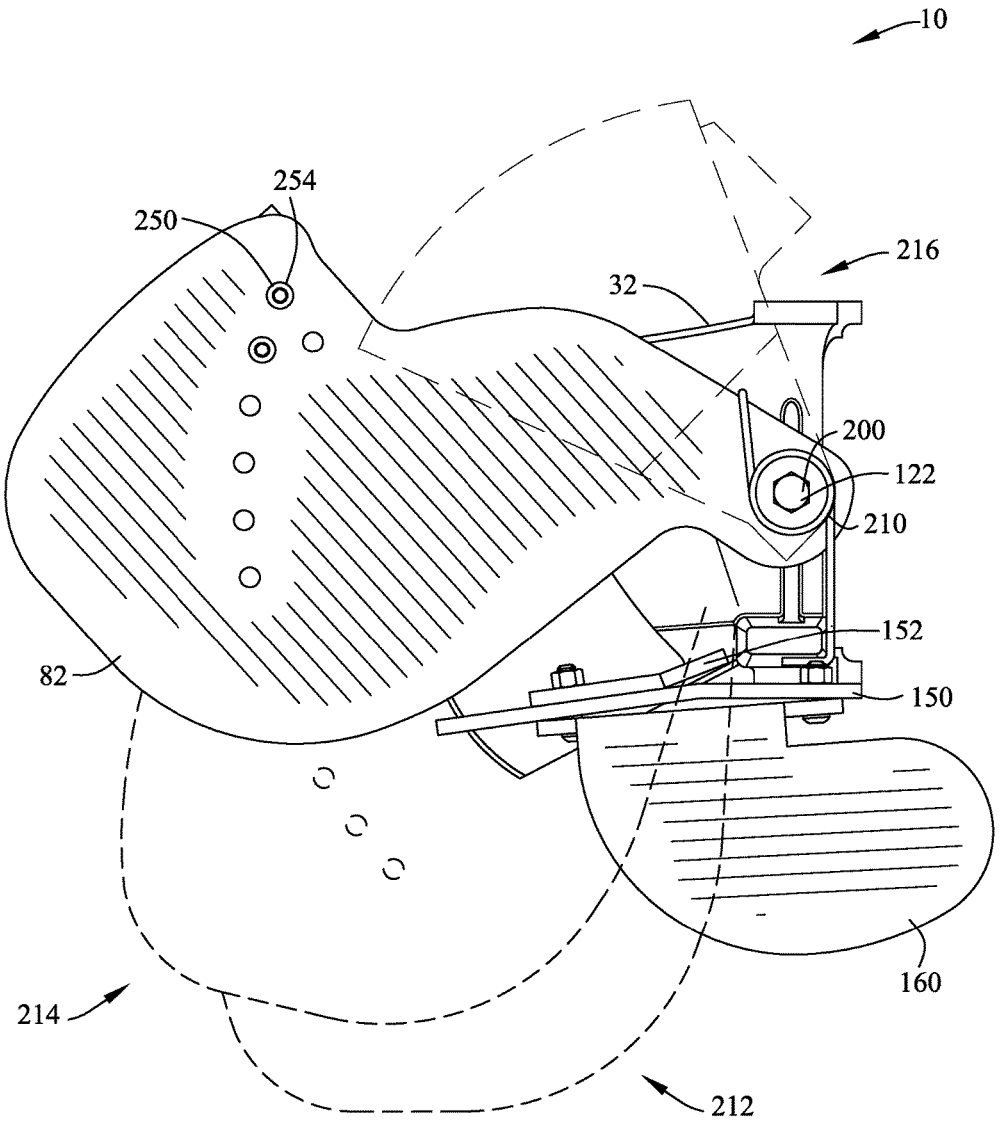
FIG. 76 is a view similar to FIG. 74 illustrating pivoting of a rudder relative to the hydrojet.
Figure 77:
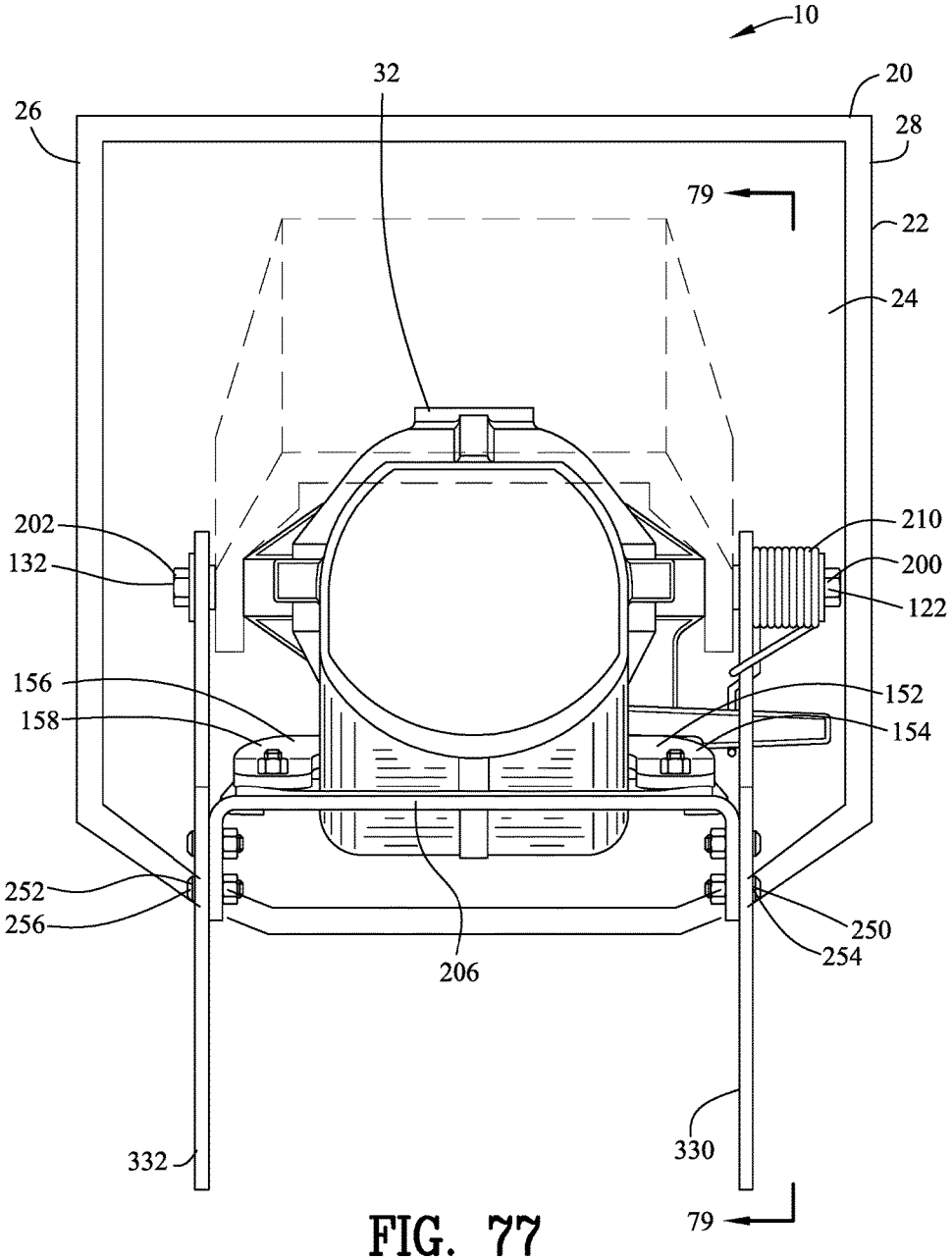
FIG. 77 is a rear view of a hydrojet vessel incorporation a tenth embodiment of the present invention.
Figure 78:
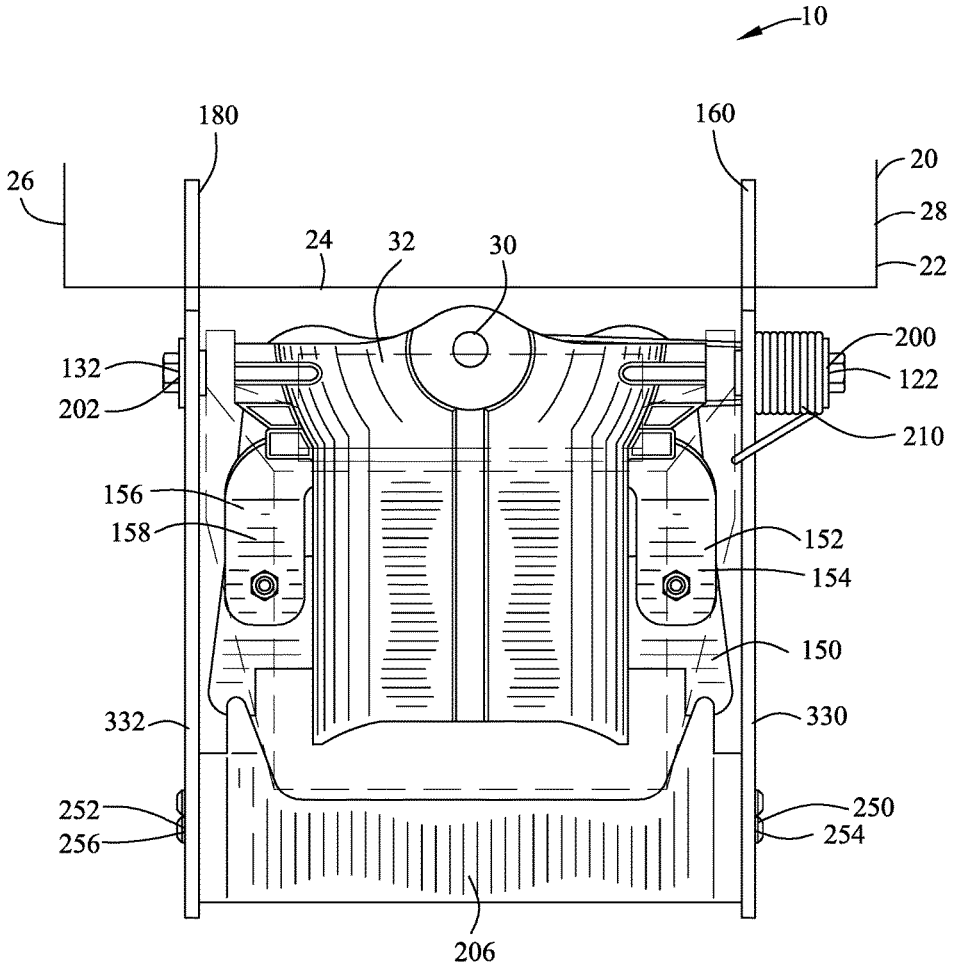
FIG. 78 is a top view of FIG. 77.
Figure 79:
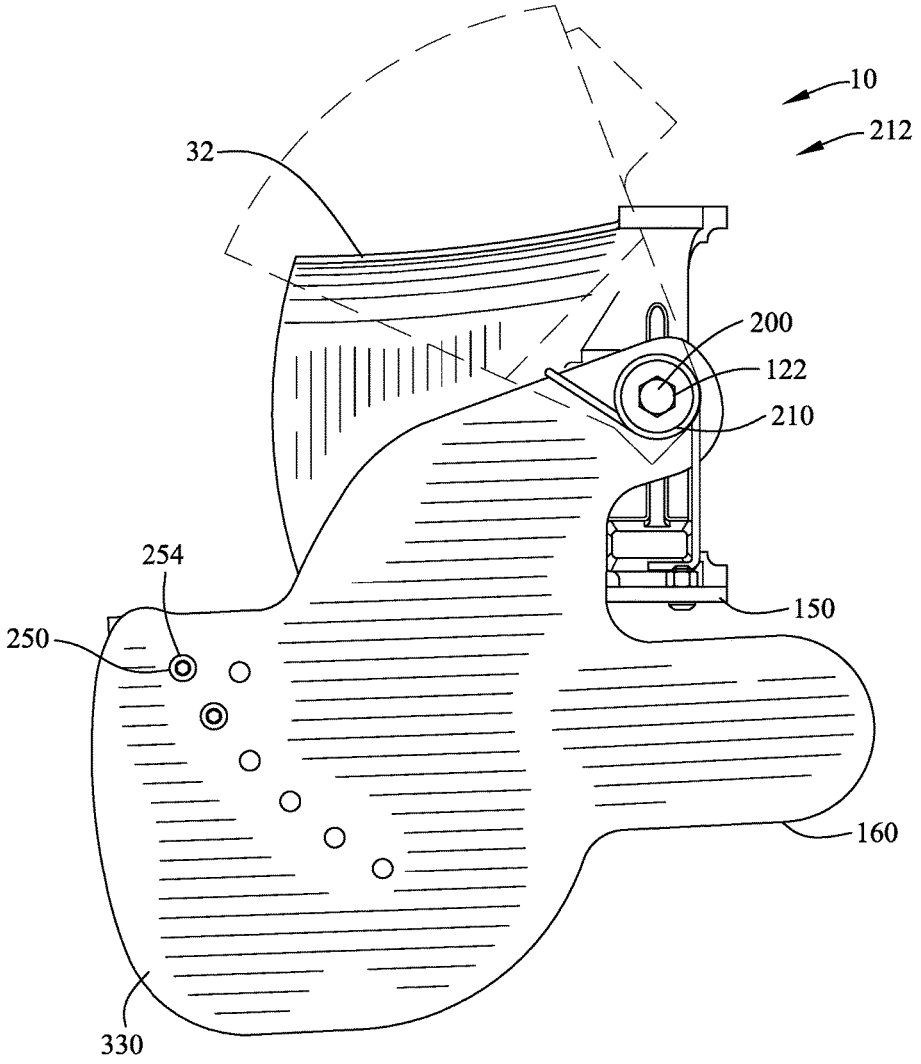
FIG. 79 is a view along line 79-79 of FIG. 77.
Figure 80:
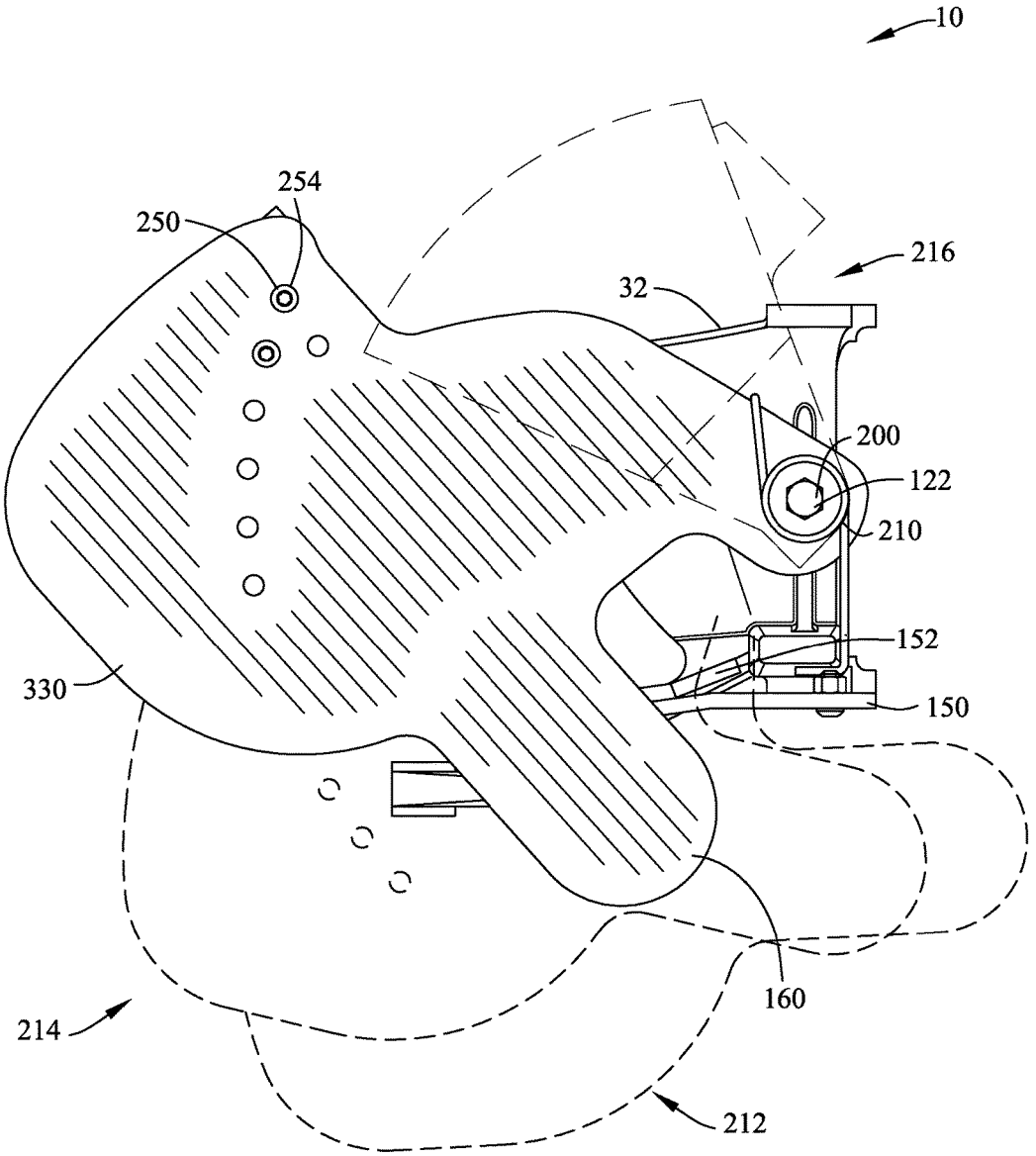
FIG. 80 is a view similar to FIG. 79 illustrating pivoting of a rudder and a steering assist rudder defining an integral one piece.
Figure 81:
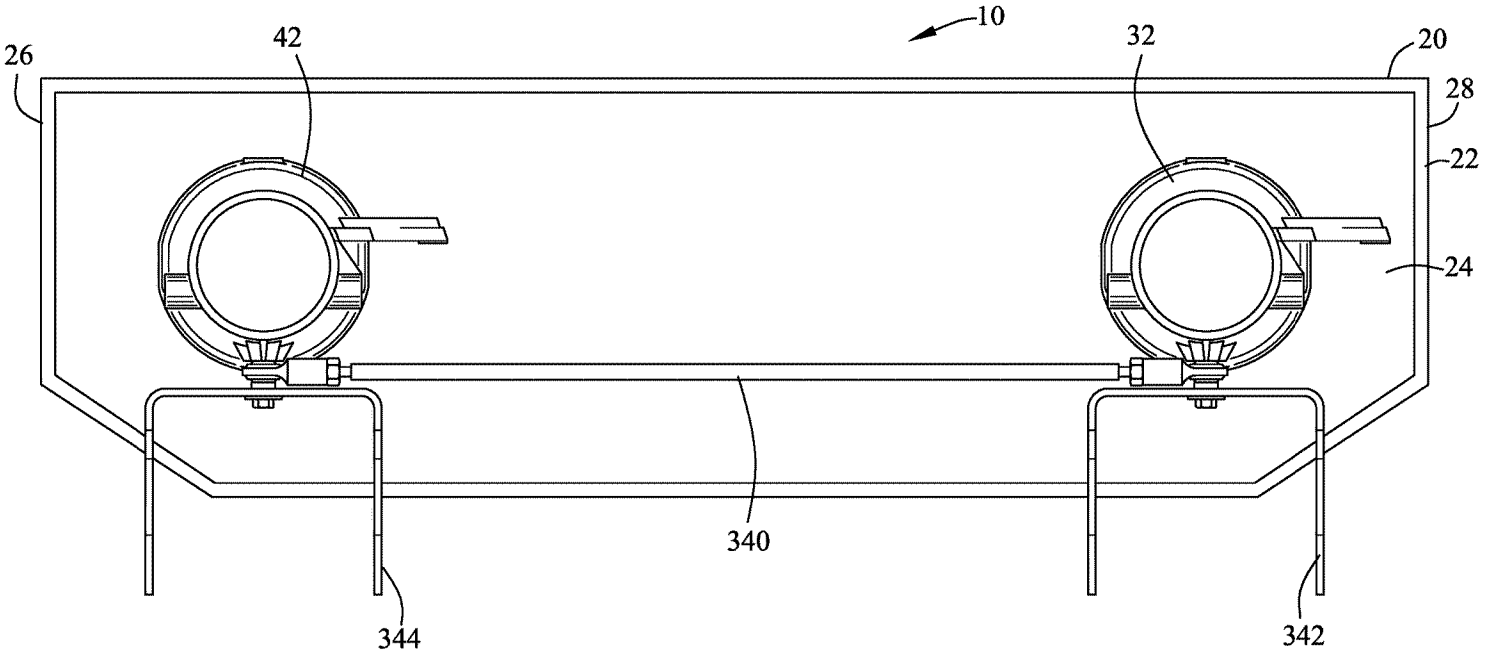
FIG. 81 is a rear view of a hydrojet vessel incorporation an eleventh embodiment of the present invention.
Figure 82:
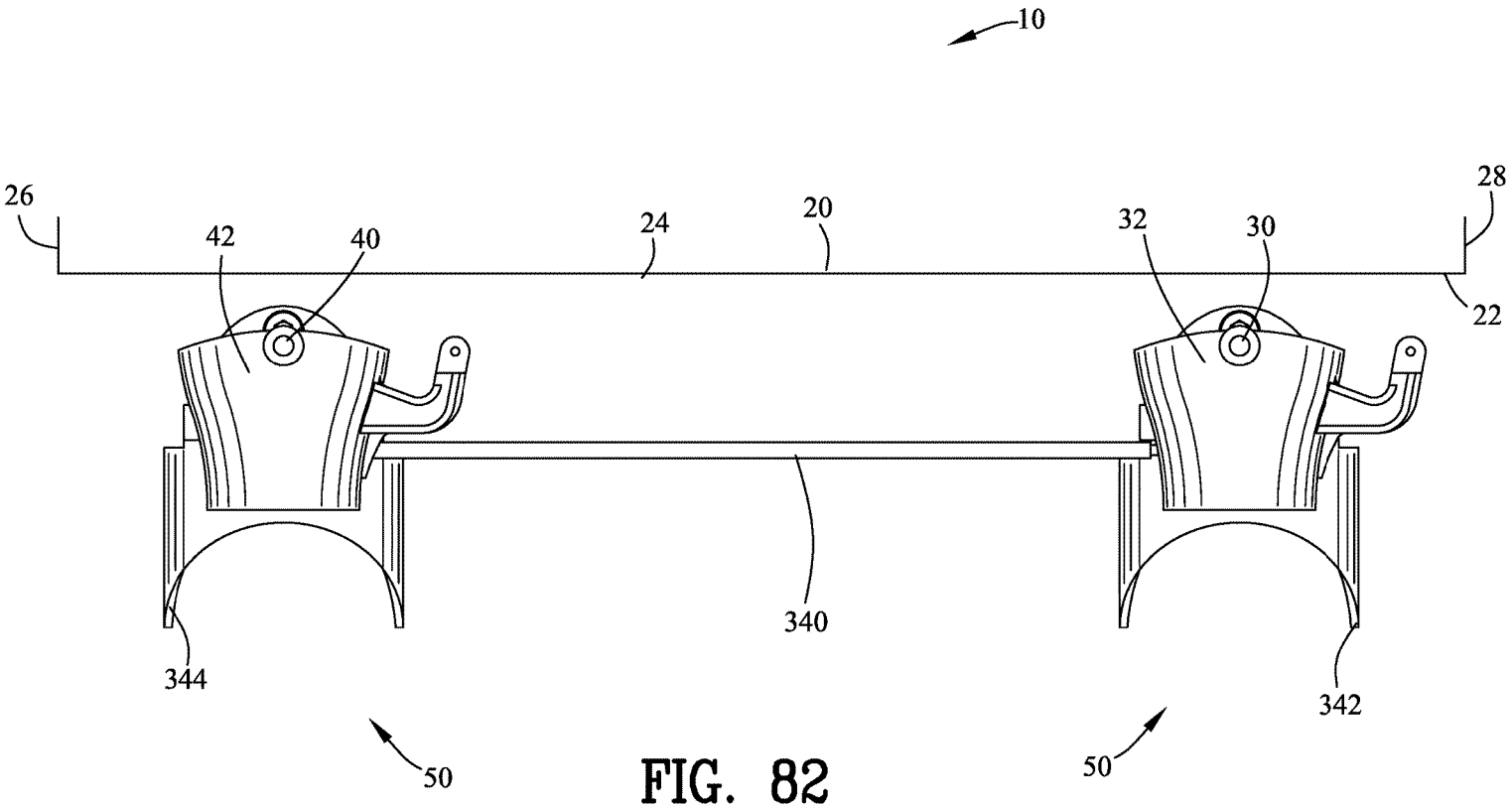
FIG. 82 is a top view of FIG. 81.
Figure 83:
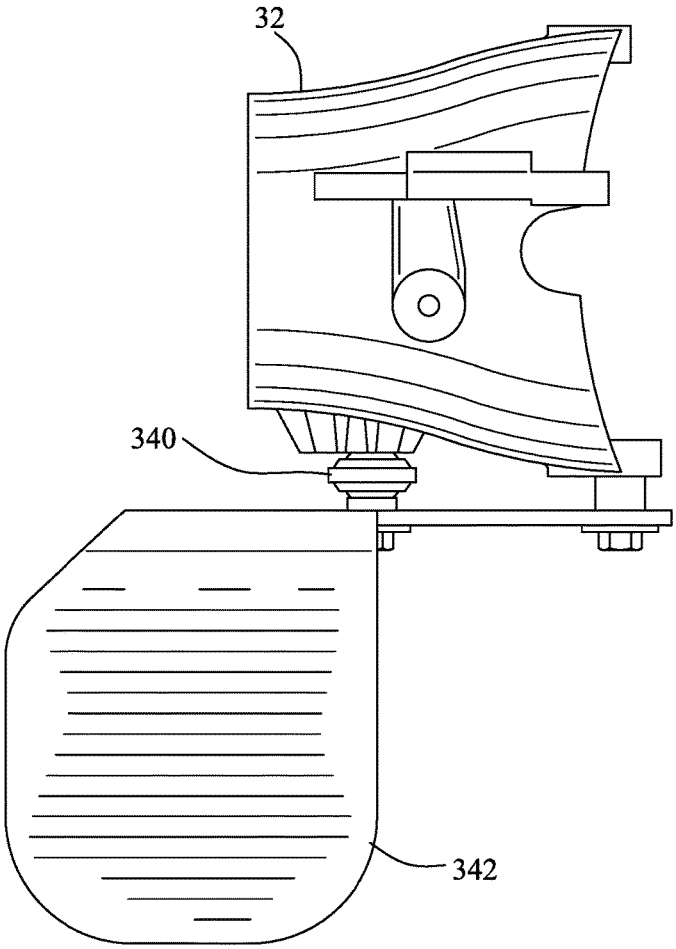
FIG. 83 is a view along line 83-83 of FIG. 81.
Figure 84:
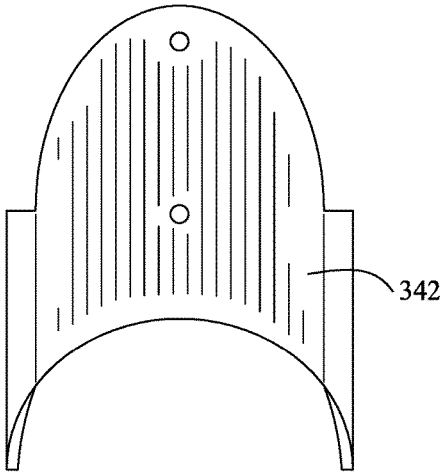
FIG. 84 is a top view of an elongated general inverted U-shape rudder of FIG. 81.
Figure 85:
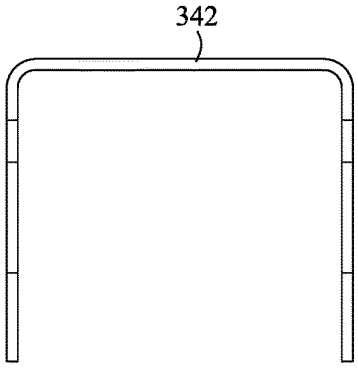
FIG. 85 is a front view of FIG. 84.
Figure 86:
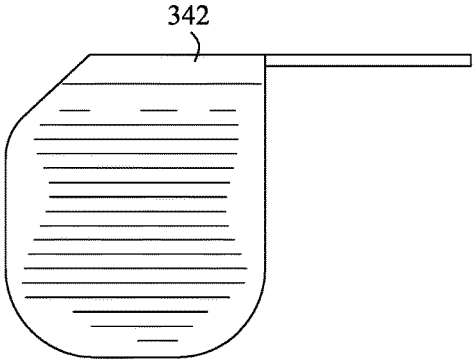
FIG. 86 is a left side view of FIG. 85.

The first primary horizontal pivot 200 and the second primary horizontal pivot 220 further provide the first rudder 82 and the second rudder 92 to pivot into a partial pivot position 214 at shown in FIG. 43 if they come into contact with an obstruction 12. The obstruction 12 may include a rock, object within the water or individual body parts. The pivoting of the first rudder 82 and the second rudder 92 provides a safety mechanism for preventing damage to the first rudder 82 and or the second rudder 92. Furthermore the pivoting of the first rudder 82 and the second rudder 92 provides a safety mechanism by being displaced upon a contact with an individual body parts. The first primary horizontal pivot 200 and the second primary horizontal pivot 220 further provide the first rudder 82 and the second rudder 92 to pivot into a fully pivoted position 216 at shown in FIG. 44.

FIGS. 51-54 and 92 illustrate a first secondary steering assist rudder 320 coupled to the first general U-shape mounting bracket 150. The first secondary steering assist rudder 320 is positioned ahead of the first vertical pivot 30 for further assisting in pivoting the first hydrojet 32 during forward displacement of the vessel 20 through a body of water 52. A second secondary steering assist rudder 322 is coupled to the second general U-shape mounting bracket 170. The second secondary steering assist rudder 322 is positioned ahead of the second vertical pivot 40 for assisting in pivoting the second hydrojet 42 during forward displacement of the vessel 20 through a body of water 52.

FIGS. 55-59 illustrate the first steering assist rudder 160 extending forward of the first rudder 82. More specifically, the first steering assist rudder 160 and the first rudder 82 are a first integral one piece unit 330. The first steering assist rudder 160 is positioned ahead of the first vertical pivot 30 for assisting in pivoting the first hydrojet 32 during forward displacement of the vessel 20 through a body of water 52.

The second steering assist rudder 180 extends forward of the second rudder 92. More specifically, the second steering assist rudder 180 and the second rudder 92 are a second integral one piece unit 332. The second steering assist rudder 180 is positioned ahead of the second vertical pivot 40 for assisting in pivoting the second hydrojet 42 during forward displacement of the vessel 20 through a body of water 52.

FIGS. 60-64 illustrate the rudder device 10 comprising the first general U-shaped mounting bracket 150 coupled to the first hydrojet 32 and partially encircling the first hydrojet 32. The first rudder 82 is pivotably coupled to the first hydrojet 32 by a first primary horizontal pivot 200. A first side plate 204 is pivotably coupled to the first hydrojet 32 by a first secondary horizontal pivot 202. A first coupling plate 206 is coupled between the first rudder 82 and the first side plate 204. A first coil spring 210 engages the first primary horizontal pivot 200 for promoting the first rudder 82 and the first side plate 204 being positioned in a non-pivoted position 212.

The second general U-shaped mounting bracket 170 is coupled to the second hydrojet 42 and partially encircling the second hydrojet 42. The second rudder 92 is pivotably coupled to the second hydrojet 42 by a second primary horizontal pivot 220. A second side plate 224 is pivotably coupled to the second hydrojet 42 by a second secondary horizontal pivot 222. A second coupling plate 226 is coupled between the second rudder 92 and the second side plate 224. A second coil spring 230 engages the second primary horizontal pivot 220 for promoting the second rudder 92 and the second side plate 224 being positioned in a non-pivoted position 232.

A coupling rod 100 is pivotably coupled to the first hydrojet 32, the second hydrojet 42 and the hull rudder 60 for pivoting in alignment and in unison the first rudder 82 with the first hydrojet 32 and the second rudder 92 with the second hydrojet 42 relative to the hull rudder 60. A first steering assist rudder 160 extends forward of the first rudder 82. The first steering assist rudder 160 is positioned ahead of the first vertical pivot 30 for assisting in pivoting the first hydrojet 32 during forward displacement of the vessel 20 through a body of water 52. A second steering assist rudder 180 extends forward of the second rudder 92. The second steering assist rudder 180 is positioned ahead of the second vertical pivot 40 for assisting in pivoting the second hydrojet 42 during forward displacement of the vessel 20 through a body of water 52.

FIGS. 65-71 illustrate the rudder device 10 for use with a hydrojet vessel 20. The vessel 20 has a hull 22 including a stern 24, a port side 26 and a starboard side 28, a vertical pivot 30 pivotably coupling a hydrojet 32 to the stern 24 for producing a directional thrust and propelling the hydrojet vessel 20 through a body of water 52. The rudder device 10 comprises a general U-shaped mounting bracket 150 coupled to the hydrojet 32 and partially encircling the hydrojet 32.

A first rudder 82 is pivotably coupled to the hydrojet 32 by a first horizontal pivot 122. A second rudder 92 is pivotably coupled to the hydrojet 32 by a second horizontal pivot 132. A first primary J-shaped locking tab 152 is coupled to the general U-shaped mounting bracket 150. The first general U-shape mounting bracket 150 and the first primary J-shaped locking tab 152 compress the hydrojet 32 there between for defining a first primary clamp 154.

A first secondary J-shaped locking tab 156 is coupled to the general U-shaped mounting bracket 150. The general U-shape mounting bracket 150 and the first secondary J-shaped locking tab 156 compress the hydrojet 32 there between for defining a first secondary clamp 158.

A first steering assist rudder 160 is coupled to the general U-shape mounting bracket 150. The first steering assist rudder 160 is positioned ahead of the vertical pivot 30 for assisting in pivoting the hydrojet 32 during forward displacement of the vessel 20 through a body of water 52. A second steering assist rudder 180 is coupled to the general U-shape mounting bracket 150. The second steering assist rudder 180 is positioned ahead of the vertical pivot 30 for assisting in pivoting the hydrojet 32 during forward displacement of the vessel 20 through a body of water 52.

FIGS. 72-76 illustrate the rudder device 10 comprising a general U-shaped mounting bracket 150 coupled to the hydrojet 32 and partially encircling the hydrojet 32. A first rudder 82 is pivotably coupled to the hydrojet 32 by a first horizontal pivot 122. A second rudder 92 is pivotably coupled to the hydrojet 32 by a second horizontal pivot 132. A coupling plate 206 is coupled between the first rudder 82 and the second rudder 92. A coil spring 210 engages the first horizontal pivot 122 for promoting the first rudder 82 and the second rudder 92 being positioned in a non-pivoted position 212.

A first primary J-shaped locking tab 152 is coupled to the general U-shaped mounting bracket 150. The general U-shape mounting bracket 150 and the first primary J-shaped locking tab 152 compress the hydrojet 32 there between for defining a first primary clamp 154. A first secondary J-shaped locking tab 156 is coupled to the general U-shaped mounting bracket 150. The general U-shape mounting bracket 150 and the first secondary J-shaped locking tab 156 compress the hydrojet 32 there between for defining a first secondary clamp 158.

FIGS. 77-80 illustrate the rudder device 10 comprising a general U-shaped mounting bracket 150 coupled to the hydrojet 32 and partially encircling the hydrojet 32. A first rudder 82 is pivotably coupled to the hydrojet 32 by a first horizontal pivot 122. A second rudder 92 is pivotably coupled to the hydrojet 32 by a second horizontal pivot 132. A coupling plate 206 is coupled between the first rudder 82 and the second rudder 92. A coil spring 210 engages the first horizontal pivot 122 for promoting the first rudder 82 and the second rudder 92 being positioned in a non-pivoted position 212.

A first primary J-shaped locking tab 152 is coupled to the general U-shaped mounting bracket 150. The general U-shape mounting bracket 150 and the first primary J-shaped locking tab 152 compress the hydrojet 32 there between for defining a first primary clamp 154. A first secondary J-shaped locking tab 156 is coupled to the general U-shaped mounting bracket 150. The general U-shape mounting bracket 150 and the first secondary J-shaped locking tab 156 compress the hydrojet 32 there between for defining a first secondary clamp 158.

A first steering assist rudder 160 extends forward of the first rudder 82 defining a first integral one piece unit 330. The first steering assist rudder 160 is positioned ahead of the first vertical pivot 30 for assisting in pivoting the first hydrojet 32 during forward displacement of the vessel 20 through a body of water 52. A second steering assist rudder 180 extends forward of the second rudder 92 defining a second integral one piece unit 332. The second steering assist rudder 180 is positioned ahead of the second vertical pivot 40 for assisting in pivoting the second hydrojet 42 during forward displacement of the vessel 20 through a body of water 52.

FIGS. 81-86 and 93 illustrate a linkage 340 coupling the first hydrojet 32 with the second hydrojet 42 for pivoting the first hydrojet 32 and the second hydrojet 42. The rudder device 10 comprises a first elongated general inverted U shape rudder 342 coupled to the first hydrojet 32. A second elongated general inverted U shape rudder 344 coupled to the second hydrojet 42. The first elongated general inverted U shape rudder 342 and the second elongated general inverted U shape rudder 344 provide steerage to the vessel 20 during non directional thrust created by the first hydrojet 32 and the second hydrojet 42.

Figure 87:
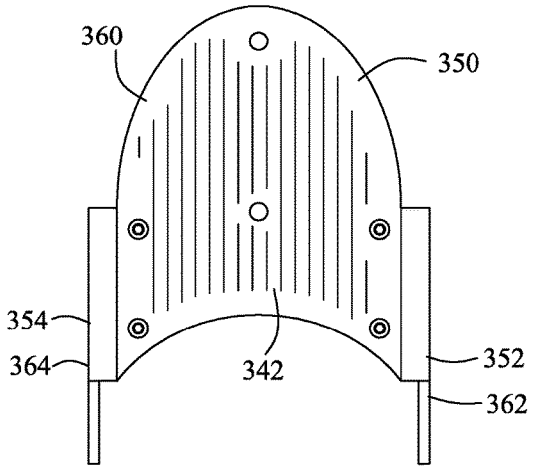
FIG. 87 is a view similar to FIG. 84 wherein the elongated general inverted U-shape rudder includes a horizontal plate, a first removable primary rudder and a second removable primary rudder.
Figure 88:
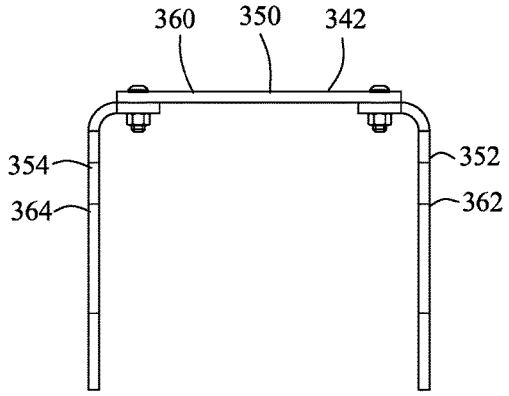
FIG. 88 is a front view of FIG. 87.
Figure 89:
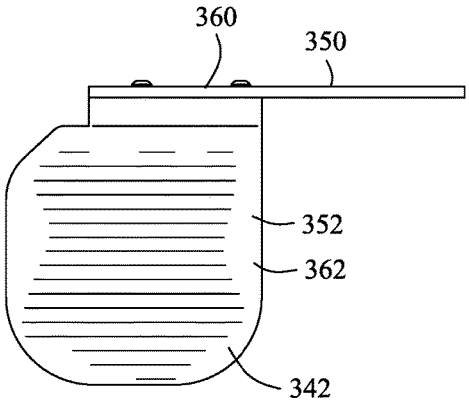
FIG. 89 is a left side view of FIG. 88.
Figure 90:
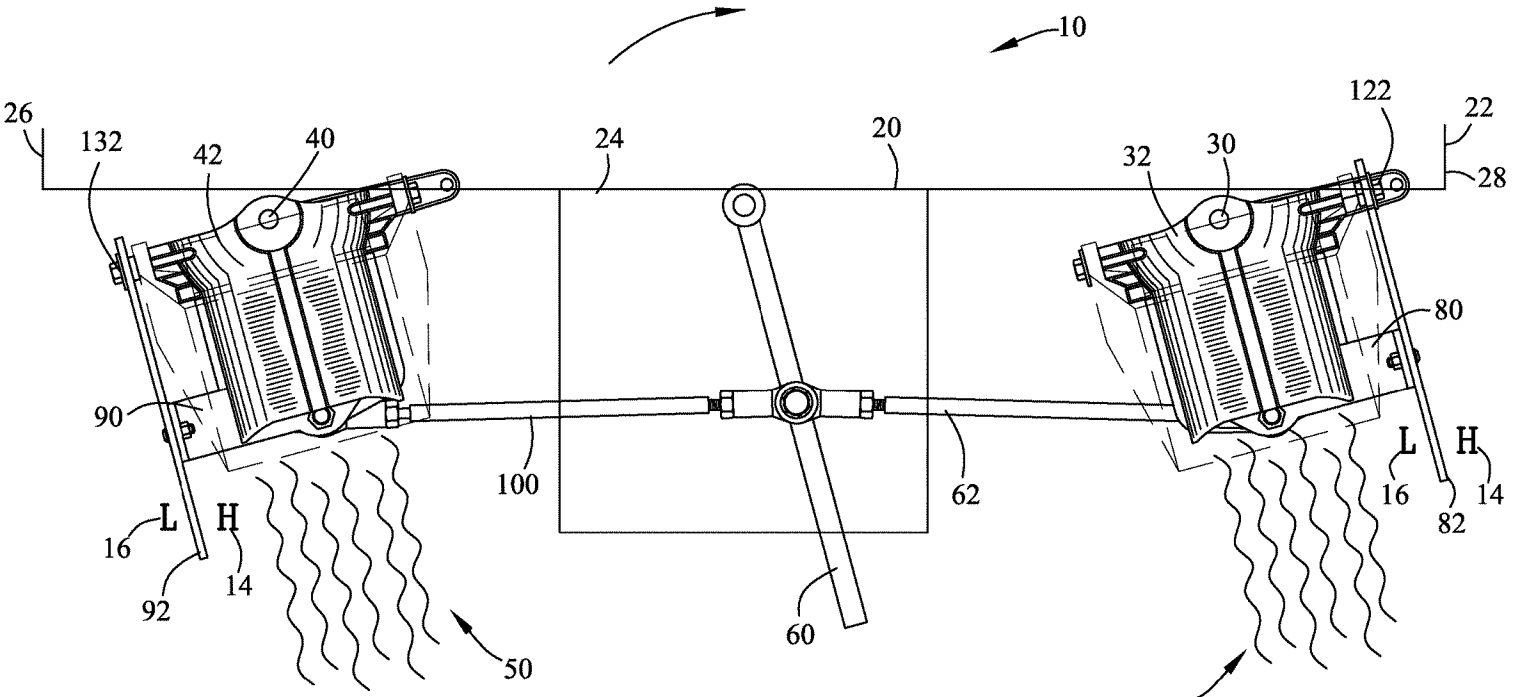
FIG. 90 is a view similar to FIG. 2 illustrating the rudder device within the body of water providing steerage to the vessel during non directional thrust and during directional thrust from the hydrojet.
Figure 91:
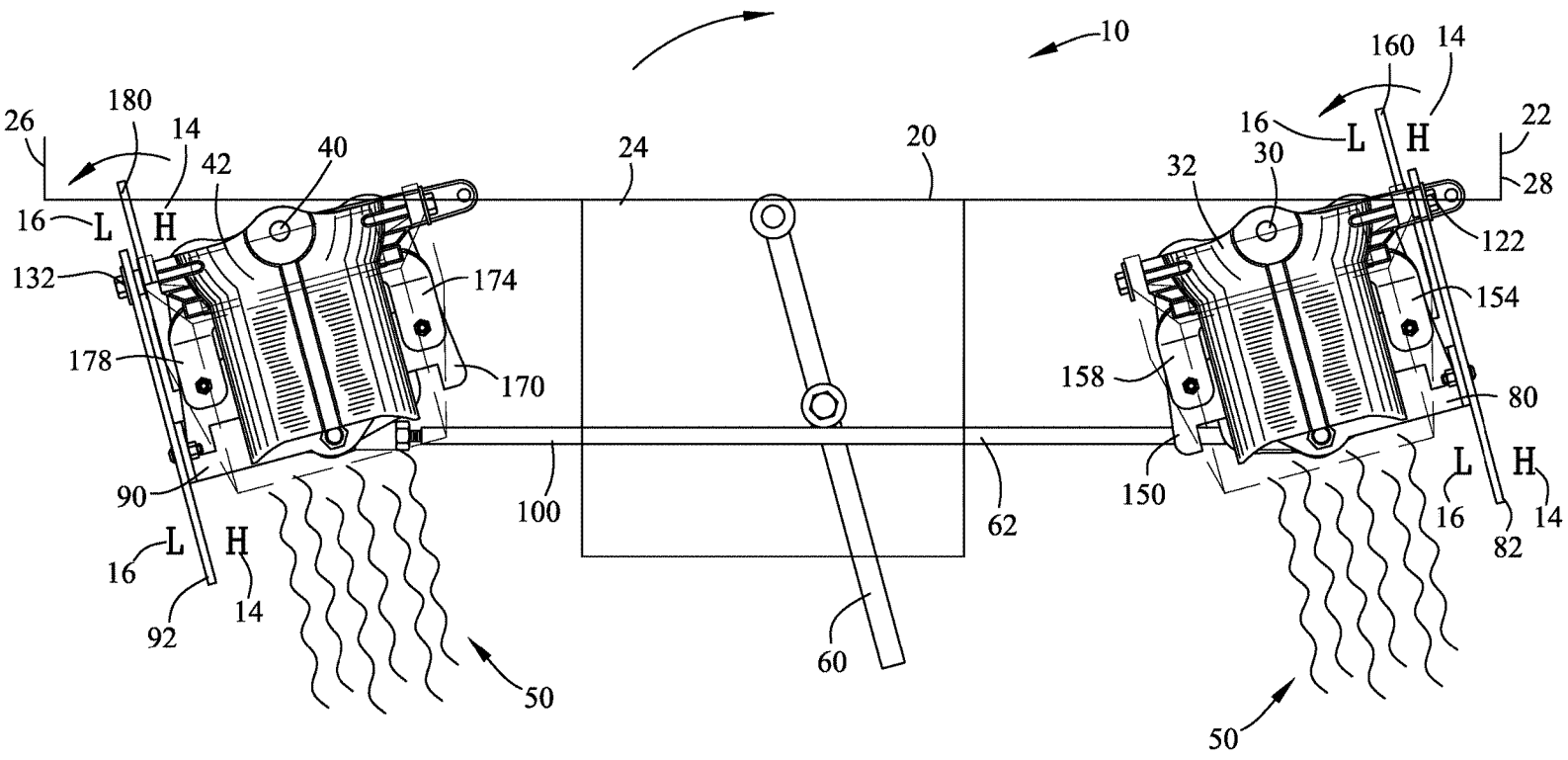
FIG. 91 is a view similar to FIG. 12 illustrating the rudder device within the body of water providing steerage to the vessel during non directional thrust and during directional thrust from the hydrojet and providing steering assist to the vessel during non directional thrust and during directional thrust from the hydrojet.
Figure 92:
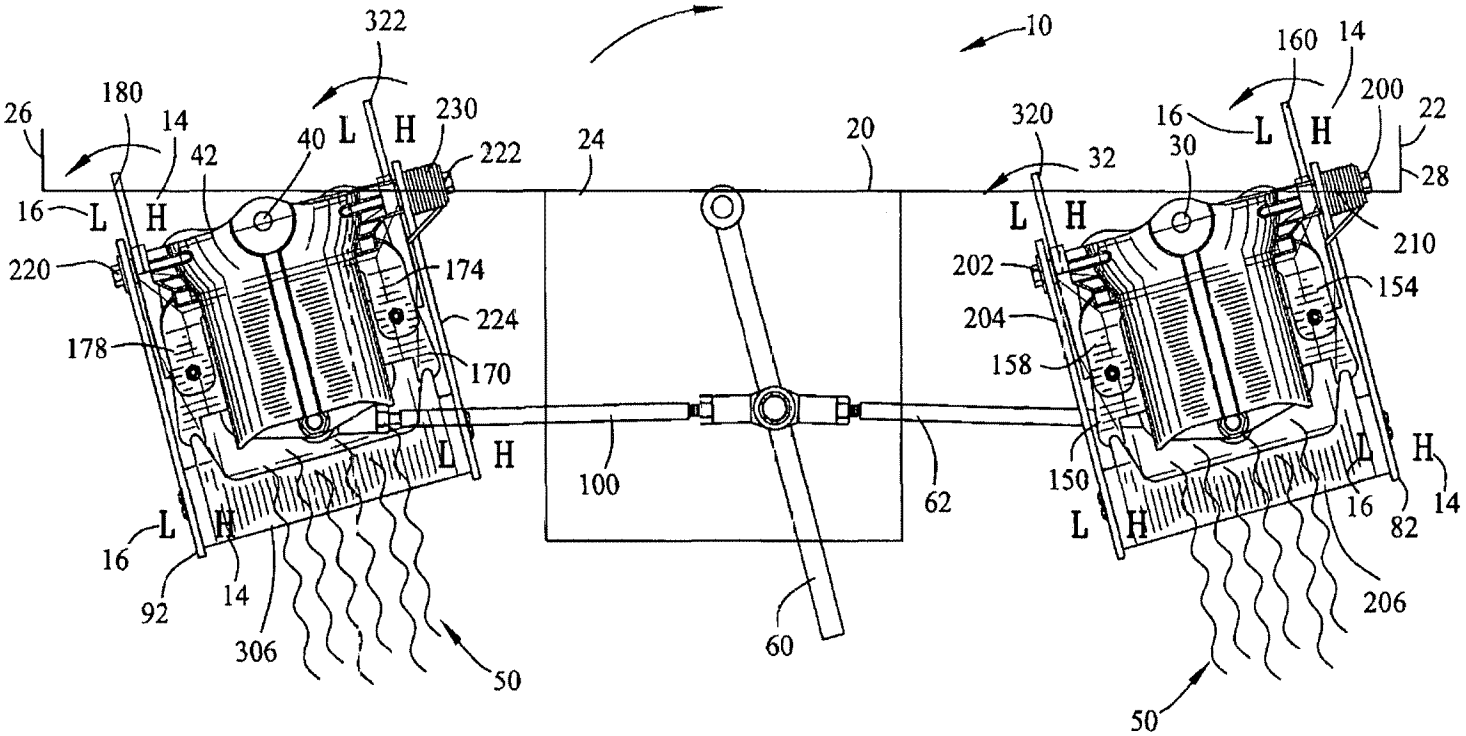
FIG. 92 is a view similar to FIG. 52 illustrating the rudder device within the body of water providing steerage to the vessel during non directional thrust and during directional thrust from the hydrojet and providing steering assist to the vessel during non directional thrust and during directional thrust from the hydrojet.

FIGS. 87-89 illustrate the first elongated general inverted U shape rudder 342 including a first horizontal plate 350, a first removable primary rudder 352 and a first removable secondary rudder 354 for permitting varying sized the first removable primary rudder 352 and the first removable secondary rudder 354. The second elongated general inverted U shape rudder 344 includes a second horizontal plate 360, a second removable primary rudder 362 and a second removable secondary rudder 364 for permitting varying sized the second removable primary rudder 362 and the second removable secondary rudder 364.

FIGS. 94-101 illustrate a twelfth embodiment of the rudder device 10. The rudder device 10 includes a mounting plate 400 having a front edge 410, a rear edge 412, a primary side 414 and a secondary side 416. The mounting plate 400 includes an upper side 406 and a lower side 408. The mounting plate 400 may further include a front mounting plate 402 and a rear mounting plate 404.

Preferably, the front mounting plate 402 includes a generally horizontal orientation or generally horizontal position when secured to the hydrojet 32. Furthermore, the rear mounting plate 404 preferably includes a descending slope 452 or deflecting downward 454 when secured to the hydrojet 32.

The mounting plate 400 includes a mounting plate hydrojet aperture 420 for positioning the mounting plate 400 around the hydrojet 32. The mounting plate 400 further includes a plurality of coupling apertures 422 for securing the mounting plate 400 to the hydrojet 32.

The front edge 410 of the mounting plate 400 may include a front serpentine edge 424. Similarly, the rear edge 412 may include a rear serpentine edge 426. The front serpentine edge 424 and the rear serpentine edge 426 is believed to create a more laminate flow of water above and below the mounting plate 400 during a forward displacement of the vessel 20 through the body of water 52.

The rudder device 10 in FIGS. 94-101 further includes a primary rudder 430 coupled to the primary side 414 of the mounting plate 400 and a secondary rudder 440 coupled to the secondary side 416 of the mounting plate 400. The mounting plate 400, the primary rudder 430 and the secondary rudder 440 define an elongated general inverted U shape rudder 450. The elongated general inverted U-shaped rudder 450 provides steerage to the vessel 20 during non directional thrust created by the hydrojet 32 and during directional thrust created by the hydrojet 32. The primary rudder 430 and the secondary rudder 440 may include a primary arcuate rear edge 432 and a secondary arcuate rear edge 442 respectively for providing a more laminate water flow off the primary rudder 430 and the secondary rudder 440.

As noted above the rear mounting plate 404 preferably includes a descending slope 452 or deflecting downward 454 when secured to the hydrojet 32. More specifically, the descending slope 452 or deflecting downward 454 is defined from generally the front edge 410 of the mounting plate 400 to generally the rear edge 412 of the mounting plate 400. The descending slope 452 or deflecting downward for 54 provides an ascending force 460 against the mounting plate 400 by the body of water 52 during forward displacement of the vessel 20 and creates an upward force 462 against the stern 24 of the vessel 20. The upward force 462 on the mounting plate 400 creates upward pressure raising the stern 24 and reducing hull resistance. In addition, the upward force 462 reduces the vertical elevation displacement of the bow of the vessel during acceleration of the vessel 20.

The rudder device 10 in FIGS. 94-101 further includes a primary steering assist rudder 470 extending forward of the primary rudder 430. A secondary steering assist rudder 474 extends forward of the secondary rudder 440. The primary steering assist rudder 470 and the secondary steering assist rudder 474 extend ahead of the vertical pivot 30 for assisting in pivoting the hydrojet 32 during forward displacement of the vessel 20 through a body of water 52. Preferably, the primary steering assist rudder 470 includes a primary arcuate front edge 472 and the secondary steering assist rudder 474 includes a secondary arcuate front edge 476.

The rudder device 10 in FIGS. 94-101 is preferably constructed of a integral one-piece unit 478 wherein the mounting plate 400, the primary rudder 430, the secondary rudder 440, the primary steering assist rudder 470 and the secondary steering assist rudder 474 are made of the integral one piece unit 478. The integral one piece unit 478 maybe constructed of a metallic material, polymeric material or other rigid materials.

The rudder device 10 in FIGS. 94-101 maybe further secured to the hydrojet 20 by a primary J-shaped locking tab 480 coupled to the mounting plate 400 and a secondary J shaped locking tab 490 coupled to the mounting plate 400. More specifically, the mounting plate 400 and the primary J-shaped locking tab 480 compress the hydrojet 20 there between for defining a primary clamp 482. Furthermore, the mounting plate 400 and the secondary J-shaped locking tab 490 compress the hydrojet 20 there between for defining a secondary clamp 492.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A rudder device for a hydrojet vessel, the hydrojet vessel having a hull including a stern, a port side and a starboard side, a first vertical pivot pivotably coupling a first hydrojet and a second vertical pivot pivotably coupling a second hydrojet to the stern for producing a directional thrust and propelling the hydrojet vessel through a body of water, a hull rudder pivotably coupled to the stern between the first hydrojet and the second hydrojet, a linkage coupling the first hydrojet and the second hydrojet with the hull rudder for pivoting the first hydrojet and the second hydrojet with the hull rudder, the rudder device comprising:

a first general U-shaped mounting bracket coupled to the first hydrojet and partially encircling the first hydrojet, a first rudder pivotably coupled to the first hydrojet by a first primary horizontal pivot;

a first side plate pivotably coupled to the first hydrojet by a first secondary horizontal pivot;

a first coupling plate coupled between said first rudder and said first side plate;

a first coil spring engaging said first primary horizontal pivot for promoting said first rudder and said first side plate being positioned in a non-pivoted position;

a second general U-shaped mounting bracket coupled to the second hydrojet and partially encircling the second hydrojet;

a second rudder pivotably coupled to the second hydrojet by a second primary horizontal pivot;

a second side plate pivotably coupled to the second hydrojet by a second secondary horizontal pivot;

a second coupling plate coupled between said second rudder and said second side plate;

a second coil spring engaging said second primary horizontal pivot for promoting said second rudder and said second side plate being positioned in a non-pivoted position; and said first rudder with the first hydrojet and said second rudder with the second hydrojet pivoting in alignment and in unison with the hull rudder for improving the steerability of the vessel.

2. A rudder device for a hydrojet vessel as set forth in claim 1, further including a first primary J-shaped locking tab coupled to said first general U-shaped mounting bracket;

said first general U-shape mounting bracket and said first primary J-shaped locking tab compressing the first hydrojet there between for defining a first primary clamp;

a first secondary J-shaped locking tab coupled to said first general U-shaped mounting bracket;

said first general U-shape mounting bracket and said first secondary J-shaped locking tab compressing the first hydrojet there between for defining a first secondary clamp;

a second primary J-shaped locking tab coupled to said second general U-shaped mounting bracket;

said second general U-shape mounting bracket and said second primary J-shaped locking tab compressing the second hydrojet there between for defining a second primary clamp;

a second secondary J-shaped locking tab coupled to said second general U-shaped mounting bracket; and said second general U-shape mounting bracket and said second secondary J-shaped locking tab compressing the second hydrojet there between for defining a second secondary clamp.

3. A rudder device for a hydrojet vessel as set forth in claim 2, further including a first primary vertical side stabilizing plate coupled to said first primary J-shaped locking tab for preventing lateral displacement of said first rudder;

a first secondary vertical side stabilizing plate coupled to said first secondary J-shaped locking tab for preventing lateral displacement of said first side plate;

a second primary vertical side stabilizing plate coupled to said second primary J-shaped locking tab for preventing lateral displacement of said second rudder; and a second secondary vertical side stabilizing plate coupled to said second secondary J-shaped locking tab for preventing lateral displacement of said second side plate.

4. A rudder device for a hydrojet vessel as set forth in claim 2, further including a first steering assist rudder coupled to said first general U-shape mounting bracket;

said first steering assist rudder positioned ahead of the first vertical pivot for assisting in pivoting the first hydrojet during forward displacement of the vessel through a body of water;

a second steering assist rudder coupled to said second general U-shape mounting bracket; and said second steering assist rudder positioned ahead of the second vertical pivot for assisting in pivoting the second hydrojet during forward displacement of the vessel through a body of water.

5. A rudder device for a hydrojet vessel as set forth in claim 2, further including a first secondary steering assist rudder coupled to said first general U-shape mounting bracket;

said first secondary steering assist rudder positioned ahead of the first vertical pivot for assisting in pivoting the first hydrojet during forward displacement of the vessel through a body of water;

a second secondary steering assist rudder coupled to said second general U-shape mounting bracket; and said second secondary steering assist rudder positioned ahead of the second vertical pivot for assisting in pivoting the second hydrojet during forward displacement of the vessel through a body of water.

6. A rudder device for a hydrojet vessel as set forth in claim 1, further including a first primary plurality of apertures in said first rudder;

a first secondary plurality of apertures in said first side plate;

a first primary removable fastener engaging said first coupling plate and one of said first primary plurality of apertures in said first rudder;

a first secondary removable fastener engaging said first coupling plate and one of said first secondary plurality of apertures in said first side plate;

said first primary removable fastener, said first secondary removable fastener, said first coupling plate and said first plurality of apertures defining a first adjustable rudder elevation for pivoting said first rudder on said first horizontal pivot and altering the elevation of said first rudder;

said first primary removable fastener, said first secondary removable fastener, said first coupling plate and said first plurality of apertures defining an adjustable angle of said first coupling plate relative to the first hydrojet;

said adjustable angle defining a non-angle of said first coupling plate relative to the first hydrojet for providing a non-upward force during forward displacement of the vessel through a body of water and maintaining said first rudder in a non-elevated position;

said adjustable angled defining an angle of said first coupling plate relative to the first hydrojet for providing an upward force during forward displacement of the vessel through a body of water and pivoting said first rudder in an elevated position;

a second primary plurality of apertures in said second rudder;

a second secondary plurality of apertures in said second side plate;

a second primary removable fastener engaging said second coupling plate and one of said second primary plurality of apertures in said second rudder;

a second secondary removable fastener engaging said second coupling plate and one of said second secondary plurality of apertures in said second side plate;

said second primary removable fastener, said second secondary removable fastener, said second coupling plate and said second plurality of apertures defining a second adjustable rudder elevation for pivoting said second rudder on said second horizontal pivot and altering the elevation of said second rudder;

said second removable fastener, said second secondary removable fastener, said second coupling plate and said second plurality of apertures defining an adjustable angled of said second coupling plate relative to the second hydrojet;

said adjustable angled defining a non-angle of said second coupling plate relative to the second hydrojet for providing a non-upward force during forward displacement of the vessel through a body of water and maintaining said second rudder in a non-elevated position; and said adjustable angled defining an angle of said second coupling plate relative to the second hydrojet for providing an upward force during forward displacement of the vessel through a body of water and pivoting said second rudder in an elevated position.

7. A rudder device for a hydrojet vessel, the hydrojet vessel having a hull including a stern, a port side and a starboard side, a first vertical pivot pivotably coupling a first hydrojet and a second vertical pivot pivotably coupling a second hydrojet to the stern for producing a directional thrust and propelling the hydrojet vessel through a body of water, a hull rudder pivotably coupled to the stern between the first hydrojet and the second hydrojet, a linkage coupling the first hydrojet and the second hydrojet with the hull rudder for pivoting the first hydrojet and the second hydrojet with the hull rudder, the rudder device comprising:

a first general U-shaped mounting bracket coupled to the first hydrojet and partially encircling the first hydrojet;

a first rudder pivotably coupled to the first hydrojet by a first primary horizontal pivot;

a first side plate pivotably coupled to the first hydrojet by a first secondary horizontal pivot;

a first coupling plate coupled between said first rudder and said first side plate;

a first coil spring engaging said first primary horizontal pivot for promoting said first rudder and said first side plate being positioned in a non-pivoted position;

a second general U-shaped mounting bracket coupled to the second hydrojet and partially encircling the second hydrojet;

a second rudder pivotably coupled to the second hydrojet by a second primary horizontal pivot;

a second side plate pivotably coupled to the second hydrojet by a second secondary horizontal pivot;

a second coupling plate coupled between said second rudder and said second side plate;

a second coil spring engaging said second primary horizontal pivot for promoting said second rudder and said second side plate being positioned in a non-pivoted position;

said first rudder with the first hydrojet and said second rudder with the second hydrojet pivoting in alignment and in unison with the hull rudder for improving the steerability of the vessel;

a first steering assist rudder extending forward of said first rudder;

said first steering assist rudder positioned ahead of the first vertical pivot for assisting in pivoting the first hydrojet during forward displacement of the vessel through a body of water;

a second steering assist rudder extending forward of said second rudder; and said second steering assist rudder positioned ahead of the second vertical pivot for assisting in pivoting the second hydrojet during forward displacement of the vessel through a body of water.

8. A rudder device for a hydrojet vessel, the hydrojet vessel having a hull including a stern, a port side and a starboard side, a first vertical pivot pivotably coupling a first hydrojet and a second vertical pivot pivotably coupling a second hydrojet to the stern for producing a directional thrust and propelling the hydrojet vessel through a body of water, a hull rudder pivotably coupled to the stern between the first hydrojet and the second hydrojet, a linkage coupling the first hydrojet and the second hydrojet with the hull rudder for pivoting the first hydrojet and the second hydrojet with the hull rudder, the rudder device comprising:

a first mounting bracket coupled to the first hydrojet;

a first rudder pivotably coupled to the first hydrojet;

a first side plate pivotably coupled to the first hydrojet;

a first coupling plate coupled between said first rudder and said first side plate;

a first spring engaging said first rudder for promoting said first rudder and said first side plate being positioned in a non-pivoted position;

a second mounting bracket coupled to the second hydrojet;

a second rudder pivotably coupled to the second hydrojet;

a second side plate pivotably coupled to the second hydrojet;

a second coupling plate coupled between said second rudder and said second side plate;

a second spring engaging said second rudder for promoting said second rudder and said second side plate being positioned in a non-pivoted position;

said first rudder with the first hydrojet and said second rudder with the second hydrojet pivoting with the hull rudder for improving the steerability of the vessel.

9. A rudder device for a hydrojet vessel, the hydrojet vessel having a hull including a stern, a port side and a starboard side, a first vertical pivot pivotably coupling a first hydrojet and a second vertical pivot pivotably coupling a second hydrojet to the stern for producing a directional thrust and propelling the hydrojet vessel through a body of water, a hull rudder pivotably coupled to the stern between the first hydrojet and the second hydrojet, a linkage coupling the first hydrojet and the second hydrojet with the hull rudder for pivoting the first hydrojet and the second hydrojet with the hull rudder, the rudder device comprising:

a first mounting bracket coupled to the first hydrojet;

a first rudder coupled to the first hydrojet;

a first side plate coupled to the first hydrojet;

a first coupling plate coupled between said first rudder and said first side plate;

a second mounting bracket coupled to the second hydrojet;

a second rudder coupled to the second hydrojet;

a second side plate coupled to the second hydrojet;

a second coupling plate coupled between said second rudder and said second side plate;

a first steering assist rudder coupled to said first mounting bracket;

said first steering assist rudder positioned ahead said first rudder for assisting in pivoting the first hydrojet during forward displacement of the vessel through a body of water;

a second steering assist rudder coupled to said second mounting bracket; and said second steering assist rudder positioned ahead of said second rudder for assisting in pivoting the second hydrojet during forward displacement of the vessel through a body of water.

* * * * *